US006916132B2

(12) United States Patent
Otsuka et al.

(10) Patent No.: US 6,916,132 B2
(45) Date of Patent: Jul. 12, 2005

(54) DOUBLE-SIDED PRINTING APPARATUS

(75) Inventors: Kazuo Otsuka, Nagano-ken (JP); Masanori Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 09/947,670

(22) Filed: Sep. 6, 2001

(65) Prior Publication Data

US 2002/0051669 A1 May 2, 2002

(30) Foreign Application Priority Data

Sep. 7, 2000 (JP) ..... 2000-271086
Aug. 29, 2001 (JP) ..... 2001-260385

(51) Int. Cl.[7] ..... B41J 15/04; B41J 11/70; B41J 3/60

(52) U.S. Cl. ..... 400/621; 400/613; 400/188

(58) Field of Search ..... 400/124.08, 124.09, 400/619, 188, 149, 613, 621

(56) References Cited

U.S. PATENT DOCUMENTS

| | | | | | |
|---|---|---|---|---|---|
| 4,881,132 | A | * | 11/1989 | Lajos | 358/296 |
| 5,221,035 | A | * | 6/1993 | Suzuki et al. | 226/181 |
| 5,365,844 | A | | 11/1994 | Miyashige | 101/228 |
| 5,505,550 | A | * | 4/1996 | Kitahara et al. | 400/618 |
| 5,548,390 | A | * | 8/1996 | Sugisaki et al. | 399/364 |
| 5,764,263 | A | * | 6/1998 | Lin | 347/101 |
| 6,089,487 | A | * | 7/2000 | Imai et al. | 242/348.4 |
| 6,238,113 | B1 | * | 5/2001 | Dodge | 400/613 |
| 6,493,098 | B1 | * | 12/2002 | Cornell | 358/1.12 |

FOREIGN PATENT DOCUMENTS

| | | | | |
|---|---|---|---|---|
| EP | 0 317 762 A2 | | 5/1989 | |
| EP | 0 700 788 A2 | | 3/1996 | |
| JP | 54006534 | | 1/1979 | G03B/27/14 |
| JP | 7-237336 | | 9/1995 | B41J/29/00 |
| JP | 08337011 A | * | 12/1996 | B41J/3/54 |
| JP | 10166566 A | * | 6/1998 | B41J/2/01 |
| JP | 11034403 A | * | 2/1999 | B41J/3/54 |
| JP | 2000335028 A | * | 12/2000 | B41J/11/66 |
| JP | 2001146006 A | * | 5/2001 | B41J/2/01 |

OTHER PUBLICATIONS

Machine translation of JP 11034403 to Togashi et al. from Japanese Patent Office website.*

Communication for European Patent Office Re Application No. 01 120 768. 5–2304 dated Jan. 16, 2003.

* cited by examiner

*Primary Examiner*—Daniel J. Colilla
(74) *Attorney, Agent, or Firm*—Edwards & Angell, LLP; John J. Penny, Jr.

(57) ABSTRACT

The present invention is made to provide a double-sided printing apparatus at a relatively lower cost having little possibilities of dust generation or slowing feed speed of a continuous paper without complex mechanical structure nor control process, which includes: a first printer including a first transporting unit; a first recording unit disposed on upper or lower side of a transportation path of a recording medium, the recording medium being horizontally transported from the first transporting unit; and a first discharging unit for discharging the recording medium after printing; a second printer including a second transporting unit; a second recording unit disposed on upper or lower side of the transportation path of the recording medium horizontally transported from the first transporting unit, wherein the second recording unit is disposed on the same side where the first recording unit is disposed; and a second discharging unit for discharging the recording medium; and a guiding path disposed from the first discharging unit to the second discharging unit through which the recording medium printed by the first recording unit is guided, wherein surface of the recording medium is maintained in a plane while the recording medium is guided by the guiding path.

16 Claims, 37 Drawing Sheets

PRIOR ART

DOUBLE-SIDED PRINTING APPARATUS

This patent application claims priority from Japanese patent applications Nos. 2000-271086 filed on Sep. 7, 2000 and 2001-260385 filed on Aug. 29, 2001, the contents of which are incorporated herein by reference.

BACKGROUND OF THE INVENTION

1. Field of the Invention

The present invention relates to a printing apparatus having a so-called "double-sided printing" function.

2. Related Art

According to a Japanese Patent Publication No. Hei. 7-237336, which is incorporated herein by reference, there is provided a conventional double-sided printing system which uses two (2) printers for printing on both faces of a continuous paper. An intermediate buffer device absorbing the paper feed speed difference between first and second printers is provided between the first and second printers, and a residence quantity detector detects residence quantity of the continuous paper in the intermediate buffer device. The conventional double-sided printing system is controlled as follows: the printing and paper transporting by the second printer is stopped when the residence quantity becomes a first set value or less, and the printing and paper transporting by the first printer is stopped when the residence quantity becomes a second set value or more.

However, since the conventional double-sided printing system has the intermediate buffer device, the transportation path of the continuous paper between the first and second printers tends to be long and complex. As shown in FIG. 4, since there is also provided an overturning unit 61 to and from which the continuous paper is fed at an angle, the continuous paper 63 past the unit 61 can easily bend in the inclination direction. The passing position of the continuous paper through the unit 61 can be shifted to the left or right of the central passing position, so that edges of the continuous paper 63 can be torn off which causes jamming.

According to the conventional printing system including the intermediate buffer, since the continuous paper must be transported as it is until the double-sided printing is completed, it is required to have a plurality devices, such as the intermediate buffer, for controlling transportation of the continuous paper. Therefore, total cost is increased. This is the first task of the present invention.

In general, a roll paper as a continuous paper can be used as a recording medium for printing of a conventional recording apparatus, such as a facsimile or a printer. The roll paper is useful in that it can be used for a continuous long-range printing job and proper for multiple-size printing function.

On the other hand, in case of the roll paper, the roll paper must be cut at a desired position after a printing job is completed. In case the roll paper is manually cut, the cutting process requires human labor and edge profile is not desirable. So, in some conventional recording apparatus, an automatic cutting device is installed to perform the cutting job automatically.

When the above described cutting device is installed on the conventional recording apparatus, unnecessary cutting dust is generated. Then, a dust stacker is additionally installed under the cutting device to gather the cutting dust. In this case, the dust stacker needs to be discarded after some time. However, if the user leaves alone the dust stacker without discarding it, the cutting dust in the dust stacker can flow over to give bad effects to the recording apparatus.

Further, this problem is not only in the case of continuous paper but also in the case of discrete paper which is cut at a predetermined position. This is the second task of the present invention.

Further, as the roll paper becomes longer, or as unit weight of the roll paper increases, total weight of one roll paper also increases. As the total weight of the roll paper increases, the forces required to feed the roll paper also must be increased. The roll paper of increased weight has increased transporting load (or transportation load), so that paper transporting precision of a transporting roller or a sheet feed roller, which transports the continuous paper at a predetermined pitch, toward the recording unit is degraded, and the printing quality is also degraded. This is the third task of the present invention.

The transporting device of the conventional recording apparatus has a recording medium nipped between a transporting roller and a slave transporting roller, and transporting of the recording medium is performed by rotating the transporting roller. Here, the nipping of the recording medium between the transporting roller and slave transporting roller has an important role because the recording medium is fed by being nipped and the transporting position of the recording medium is also governed by the nipping between the transporting roller and the slave transporting roller.

The firm nipping of the recording medium between the transporting roller and the slave transporting roller may be embodied by a roller pressing device which provides pressing forces to either or both of the two (2) transporting rollers to make them closely contact with each other. The roller pressing device, the transporting roller and the slave transporting roller comprise a transporting device, which is removably installed on the recording apparatus. In this case, since the transporting roller and the slave transporting roller are closely contacted with each other by the roller pressing device, a user much first make sure that the recording medium is nipped between the transporting roller and the slave transporting roller, and then install the transporting device on the recording apparatus.

However, the nipping job done by a user is not only complex and troublesome, but also incomplete. Therefore, when the transporting device is dismantled from the recording apparatus, it is greatly desirable that the transporting roller and the slave transporting roller may not be closely contacted with each other and that the recording medium may be simply put in between the two (2) transporting rollers. Further, it is also desirable that when the transporting device is installed on the recording apparatus, the roller pressing device is automatically moved to provide the pressing force to the transporting rollers for the recording medium to be nipped between the transporting roller and the slave transporting roller. To sum up, by making the recording medium nipping job simple, manipulatability of the transporting device can be increased. Further, the above description is applied not only to a transporting device which transporting device which transports a continuous paper or a discrete paper, but also to a roll paper cassette for setting a roll type recording medium (the fourth task of the present invention).

SUMMARY OF THE INVENTION

It is the first object corresponding to the first task of the present invention to provide a double-sided printing apparatus at a relatively lower cost having little possibilities of dust generation or slowing feed speed of a continuous paper without complex mechanical structure nor control process by simplifying transportation path of the continuous paper from a first printer to a second printer.

It is the second object corresponding to the second task of the present invention to maintain a normal recording operation of a recording apparatus by preventing a user from forgetting to cleanup cutting dust in a dust stacker, the cutting dust generated from a cutting device.

It is the third object corresponding to the third task of the present invention to maintain normal printing quality by performing a minute transportation operation of a transporting roller even when a roll paper of increased weight is used.

It is the fourth object corresponding to the fourth task of the present invention to provide a transporting device removably installed on a recording apparatus for performing a printing job on a recording medium, where the transporting device includes a transporting roller, a slave transporting roller and a roller pressing device for providing pressing forces for closely contacting the transporting rollers with each other and can make the recording medium easily nipped between the transporting roller and the slave transporting roller.

The object of the present invention can be achieved by the present invention of claim 1 providing a double-sided printing apparatus including: a first printer including a first transporting unit; a first recording unit disposed on upper or lower side of a transportation path of a recording medium, the recording medium being horizontally transported from the first transporting unit; and a first discharging unit for discharging the recording medium after printing; a second printer including a second transporting unit; a second recording unit disposed on upper or lower side of the transportation path of the recording medium horizontally transported from the first transporting unit, wherein the second recording unit is disposed on the same side where the first recording unit is disposed; and a second discharging unit for discharging the recording medium; and a guiding path disposed from the first discharging unit to the second discharging unit through which the recording medium printed by the first recording unit is guided, wherein surface of the recording medium is maintained in a plane while the recording medium is guided by the guiding path.

A second aspect of the present invention provides a double-sided printing apparatus further including a cutting device for cutting a portion of the recording medium printed by the first printer before the second printer begins printing on the recording medium, wherein the recording medium is continuous paper.

A third aspect of the present invention provides a double-sided printing apparatus including: a first printer including a first transporting unit; a first recording unit disposed on upper or lower side of a transportation path of a continuous recording medium, the recording medium being horizontally transported from the first transporting unit; and a first discharging unit for discharging the recording medium after printing; a second printer including a second transporting unit; a second recording unit disposed on upper or lower side of the transportation path of the recording medium horizontally transported from the first transporting unit, wherein the second recording unit is disposed on the same side where the first recording unit is disposed; and a second discharging unit for discharging the recording medium; a guiding path disposed from the first discharging unit to the second discharging unit through which the recording medium printed by the first printer is guided, wherein the guiding path includes a U-shaped reversing path; and a cutting device for cutting a portion of the recording medium printed by the before the second printer begins printing on the recording medium, wherein the first discharging unit and the second transporting unit are disposed on the same side of the double-sided printing apparatus.

Another aspect of the present invention provides a double-sided printing apparatus, wherein distance from the first discharging unit to the second discharging unit is longer than length of a printed area performed by the first printer, wherein the length of a printed area is measured in the direction of transportation of the recording medium.

Still another aspect of the present invention provides a double-sided printing apparatus further including one or more of transportation roller(s) on the guiding path.

Still another aspect of the present invention provides a double-sided printing apparatus, wherein the recording medium is wound in a roll shape, and transporting and releasing of the recording medium are performed on one side of the double-sided printing apparatus by forming the transportation path in a U-shape, and further including a roll paper cassette for setting the recording medium wound in a roll shape, wherein the roll paper cassette can be removably installed on the double-sided printing apparatus, wherein, the roll paper cassette includes a cover having a dust stacker, in which cutting dust generated by a cutting device for cutting the discharged recording medium at a predetermined position falls into and gathers, and opening operation of the cover of the roll paper cassette includes cleaning operation of the cutting dusts.

Still another aspect of the present invention provides a double-sided printing apparatus, wherein the cover further includes a released paper stacker for stacking the recording medium which is cut by the cutting device to be of a predetermined size.

Still another aspect of the present invention provides a double-sided printing apparatus, wherein the cover includes a rotating axle on a portion of the roll paper cassette at a side of dismantle direction of the roll paper cassette from the double-sided printing apparatus, and the opening operation of the cover is performed by rotating the cover to the dismantle direction on the rotating axle.

Still another aspect of the present invention provides a double-sided printing apparatus, wherein capacity of the dust stacker for stacking the cutting dust is more than amount of cutting dusts generated during printing one whole roll of the recording medium in roll shape.

Still another aspect of the present invention provides a double-sided printing apparatus further including a transporting cassette, which can be removably installed on the double-sided printing apparatus, for setting a plurality of discrete recording media, wherein transporting and releasing of the recording medium are performed on one side of the double-sided printing apparatus by forming the transportation path in a U-shape, the transporting cassette includes a cover having a dust stacker, in which cutting dust generated by a cutting device for cutting the discharged recording medium at a predetermined position falls into and gathers, and opening operation of the cover of the roll paper cassette includes cleaning operation of the cutting dusts.

Still another aspect of the present invention provides a double-sided printing apparatus further including: a transportation roller for transporting the recording medium in a roll shape to the first printer; and a roll paper looseness generating device disposed on an upstream side of the transportation roller in the direction of the roll paper transportation, wherein the roll paper looseness generating device includes a looseness detector for detecting looseness of the recording medium and a roll paper rotating device for rotating the recording medium of a roll shape in forward or reverse direction, and when the looseness detector detects improper looseness of the roll paper, the roll paper rotating device rotates the recording medium in forward direction, and when the looseness detector detects proper looseness of the roll paper, the roll paper rotating device rotates the recording medium in reverse direction.

Still another aspect of the present invention provides a double-sided printing apparatus further including a means for making the recording medium movable, wherein the means for making the recording medium movable can move the recording medium in a roll shape in a direction of the axle.

Still another aspect of the present invention provides a double-sided printing apparatus, wherein the roll paper rotating device includes: a rotating drum including a drum axle, which penetrates center hollow of the recording medium in a roll shape and provides a rotational force to the center hollow, and lobes, of which radius is larger than that of the recording medium in a roll shape, disposed on both ends of the drum axle; and a drum rotating roller for providing a rotating force to the lobes and supporting the rotating drum.

Still another aspect of the present invention provides a double-sided printing apparatus, wherein the looseness detector includes: a rotating unit, which can rotate in clockwise or counterclockwise direction, including a contact terminal contacted with the recording medium at inside of the looseness generating device, a rotating center disposed apart from the contact terminal, and a sensor engaging unit disposed apart from the rotating center; a sensor detector for detecting a rotating state of the rotating unit by engaging with the sensor engaging unit; and a pressing unit for pressing the rotating unit toward the direction of looseness detection, wherein when the looseness of the recording medium changes from "proper" state to "improper" state, the recording medium rotates the rotating unit against the pressing unit, thereby an engagement state of the sensor engaging unit and the sensor detector is changed.

Still another aspect of the present invention provides a double-sided printing apparatus, wherein the contacting terminal includes a guide roller which dependently rotates by contacting with the recording medium.

Still another aspect of the present invention provides a double-sided printing apparatus, wherein the roll paper rotating device can drive the recording medium wound in a roll shape to be rotated in reverse direction, and if the looseness detector detects a "proper" looseness of the recording medium, the roll paper rotating device is driven to rotate the recording medium wound in a roll shape in reverse direction.

Still another aspect of the present invention provides a double-sided printing apparatus further including a transporting device, which can be removably installed on the double-sided printing apparatus, for transporting the recording medium, wherein the first transporting unit includes a paper transporting roller for transporting the recording medium, a paper transporting slave roller dependently rotating for nipping the recording medium between the paper transporting roller and itself, and a roller pressing unit for embodying transportation of the recording medium by pressing the paper transporting roller or paper transporting slave roller in a closely contacting direction, and the roller pressing unit provides a pressing force to the transporting roller or the transporting slave roller which is engaged with a portion of the double-sided printing apparatus when the transporting device is installed on the double-sided printing apparatus, and the roller pressing unit does not provide the pressing force when the transporting device is dismantled from the double-sided printing apparatus.

Still another aspect of the present invention provides a double-sided printing apparatus further including a transporting device, which can be removably installed on the double-sided printing apparatus, for transporting the recording medium, wherein the first transporting unit includes a paper transporting roller for transporting the recording medium, a paper transporting slave roller dependently rotating for nipping the recording medium between the paper transporting roller and itself, a roller pressing unit for embodying transportation of the recording medium by pressing the paper transporting roller or paper transporting slave roller in a closely contacting direction, and the roller pressing unit includes a pressing force supporting unit for engaging with a portion of the double-sided printing apparatus when the paper transporting device is installed on the double-sided printing apparatus and being released from the portion of the double-sided printing apparatus when paper transporting device is dismantled from the double-sided printing apparatus, and a pressing force acting unit for acting the pressing force on the paper transporting roller or the paper transporting slave roller by using the pressing force supporting unit engaged with the portion of the double-sided printing apparatus as a supporting point of the pressing force.

Still another aspect of the present invention provides a double-sided printing apparatus, wherein the roller pressing unit is a screwed coil spring in an L-shape, both ends of the screwed coil spring is the body side engaging unit and the pressing force acting unit, and opening side of the L-shaped screwed coil spring is in the direction of dismantle of the paper transporting device.

Still another aspect of the present invention provides a double-sided printing apparatus, wherein the paper transporting slave roller is installed on a rotating unit having an rotating axle parallel to a rotating axle of the paper transporting slave roller, and the roller pressing unit makes the paper transporting slave roller be in close contact with the paper transporting roller by pressing the rotating unit.

Still another aspect of the present invention provides a double-sided printing apparatus further including: a paper transporting roller gear, which can be engaged with and released from a power transmitting gear installed on the double-sided printing apparatus, for transmitting rotating force of the power transmitting gear to the paper transporting roller by engaging with the power transmitting gear; and an installation position fixing unit, disposed at a place near from the paper transporting roller gear, for fixing relative position of the paper transporting device to the double-sided printing apparatus by engaging with a locking unit disposed on a place near from the power transmitting gear on the double-sided printing apparatus when the paper transporting device is installed on the double-sided printing apparatus.

Still another aspect of the present invention provides a double-sided printing apparatus further including a roll paper cassette, which can be removably installed on the double-sided printing apparatus, for setting the recording medium wound in a roll shape, wherein the roll paper cassette includes the paper transporting device.

BRIEF DESCRIPTION OF THE DRAWINGS

A further understanding of the nature and advantage of the present invention will become apparent by reference to the remaining portions of the specification and drawings.

DETAILED DESCRIPTION OF THE PREFERRED EMBODIMENT

Now, referring to attached drawings, embodiments of the present invention are described in detail.

Figure 1:
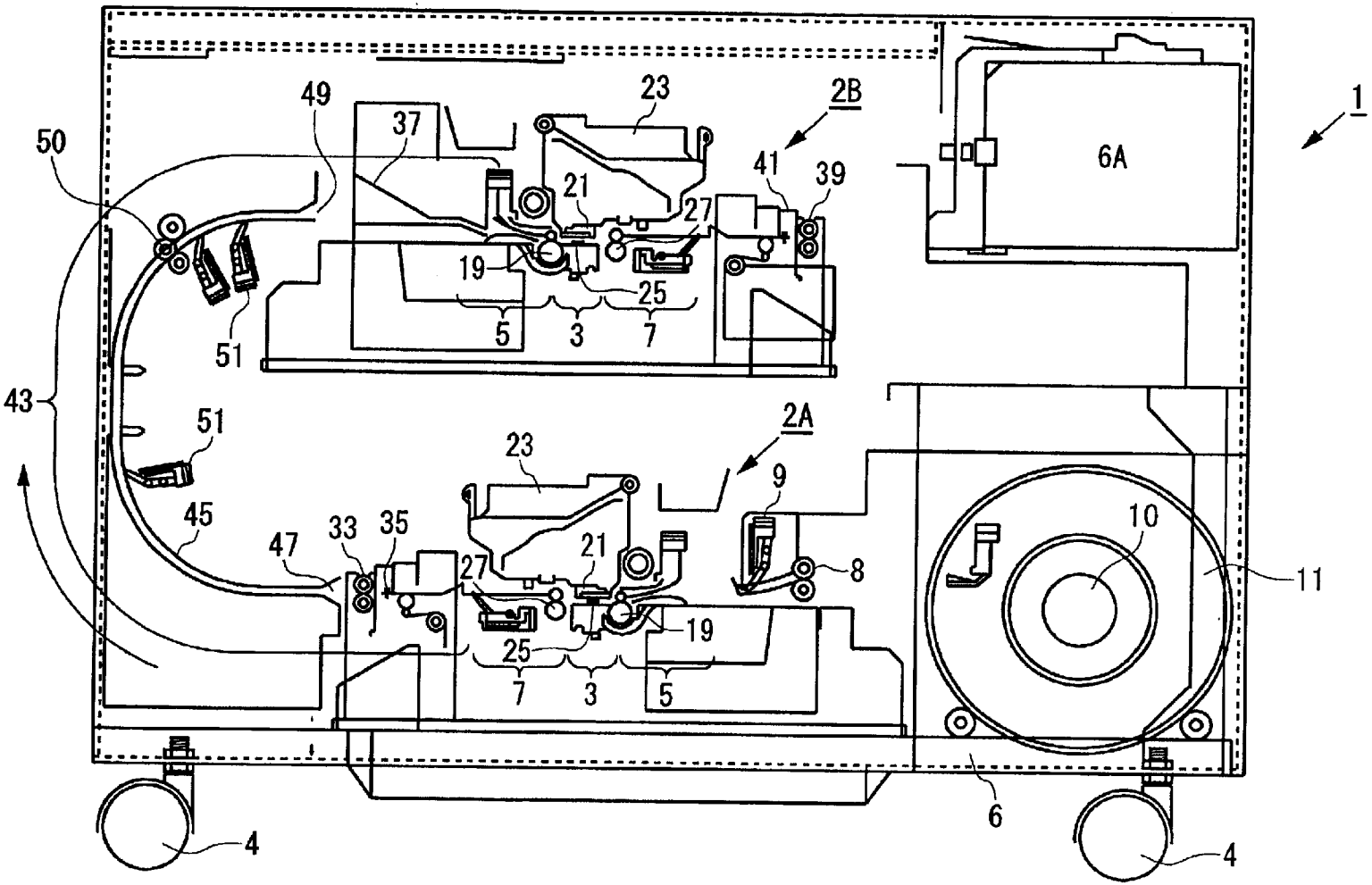
FIG. 1 shows a cross-sectional side view of an embodiment of the double-sided printing apparatus of the present invention.
Figure 2:
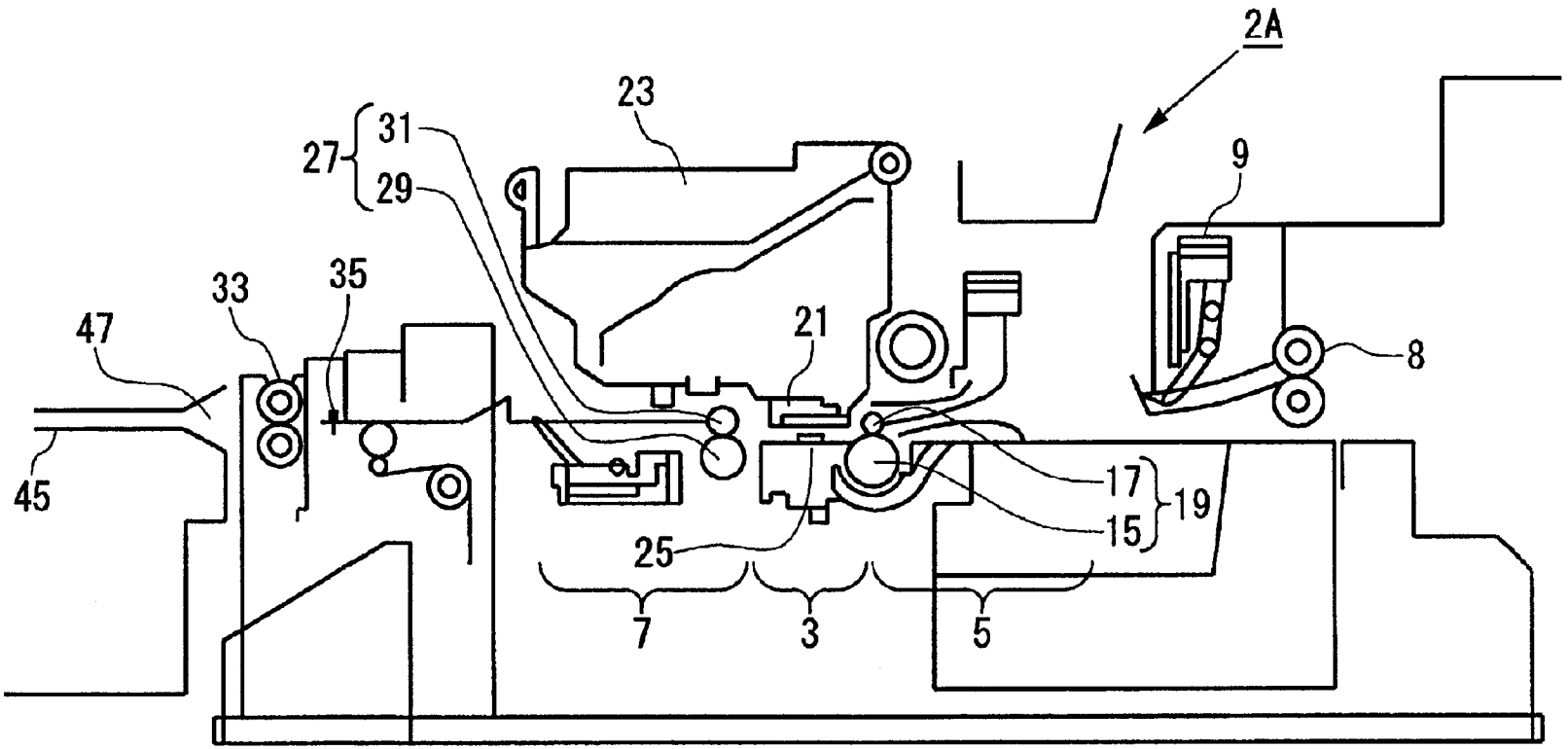
FIG. 2 shows an enlarged view of a first ink-jet printer.
Figure 3:
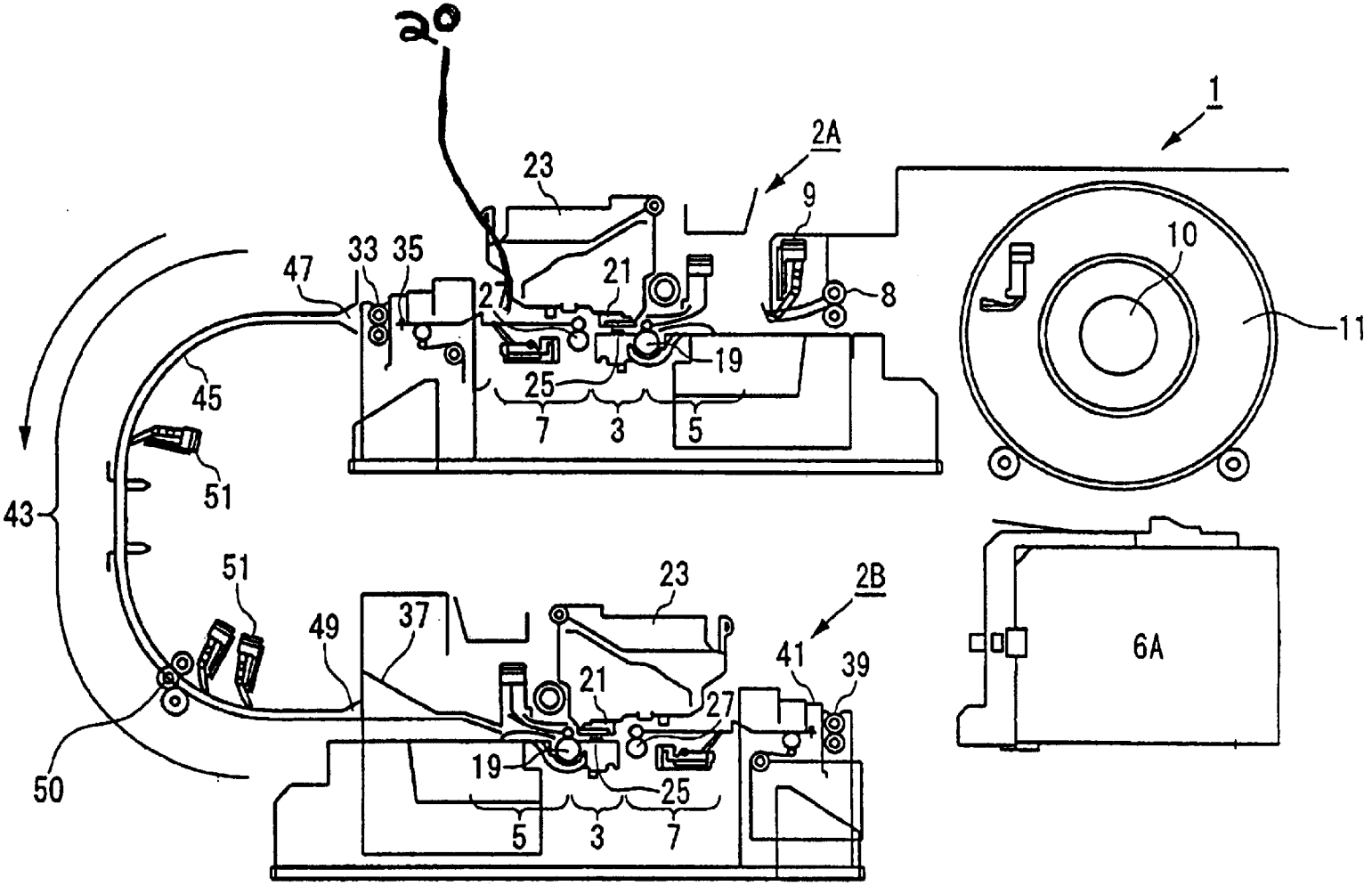
FIG. 3 shows a cross-sectional side view of another embodiment of the double-sided printing apparatus of the present invention.
Figure 4:
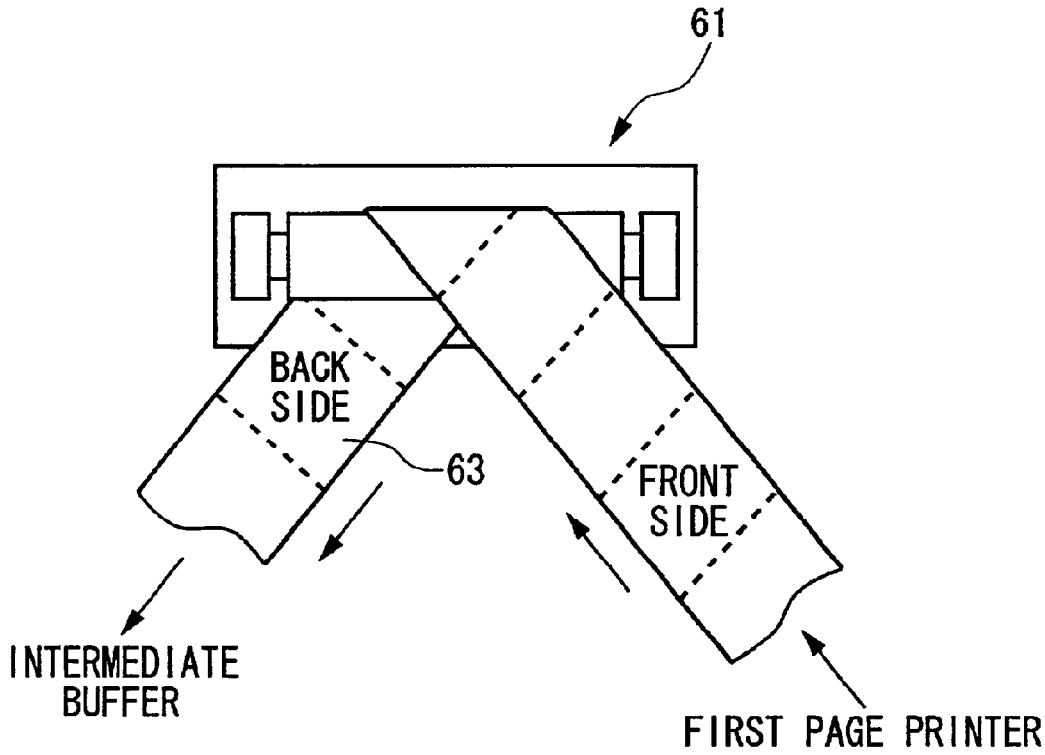
FIG. 4 shows a portion of a conventional double-sided printing apparatus.

Now, referring to FIG. 1, FIG. 2 and FIG. 3, there are shown a cross-sectional side view of an embodiment of the double-sided printing apparatus of the present invention, an enlarged view of a first ink-jet printer and a cross-sectional side view of another embodiment of the double-sided printing apparatus of the present invention.

In FIG. 1, reference number 1 designates a double-sided printing apparatus of the present invention. The double-sided printing apparatus 1 includes a first and second ink-jet printers 2A and 2B disposed at a relatively lower and a relatively upper positions, respectively. The two ink-jet printers 2A and 2B are supported by a rest 6 having casts 4. In the rest 6, an ink cartridge 6A for providing ink to the ink-jet printers 2A and 2B is installed.

The first ink-jet printer 2A located at relatively lower position includes a printing section 3, a paper transporting unit 5 disposed at upstream side of the printing section 3 in the paper flowing (or transporting) direction, and a paper discharging unit 7 disposed at downstream side of the printing section 3 in the paper flowing direction.

At an upstream side of the paper transporting unit 5, an auto loading roller 8 is disposed, and an auto loading detector 9 is disposed near the auto loading roller 8. A roll paper holder 10 is disposed at an upstream side of the auto loading roller 8, where a roll paper 11 as a recording medium is rotatably set. A predetermined amount of roll paper 11 is drawn out of the roll by passing through the auto loading roller 8. Further, except for the roll paper 11, discrete papers can be used as recording media for the printing apparatus of the present invention.

Drawn out roll paper 11 is arrived at a paper transporting roller 19 (see FIG. 2) composed of a paper feed driving roller 15 and a paper transporting slave roller 17, where the roll paper 11 is further transported to a printing head (recording unit) 21 located at a downstream side of the paper transporting roller 19 along a horizontal transportation path 20 while the paper transportation is minutely controlled. According to the present embodiment, the printing head 21 is located at an upstream side in the roll paper 11 flowing direction.

The printing head 21 is supported by a carriage 23, and the carriage 23 is installed to be able to move back and forth in a direction perpendicular to the paper flowing direction. On the opposite side of the printing head 21, a platen 25 is disposed to support the roll paper 11 when the printing head 21 performs a printing job. Distance between the printing head 21 and the platen 25 is controlled to be appropriate for a roll paper of any thickness, so that high quality printing is achieved as the roll paper passes over the platen 25. The roll paper printed by the printing head 21 is transported by a paper discharging roller 27 installed at the paper discharging unit 7.

The paper discharging roller 27 includes a paper discharge driving roller 29 disposed at under side of the roll paper 11 and a paper discharging slave roller 31 disposed at upper side of the roll paper 11, where the roll paper 11 is discharged by rotational driving of the paper discharge driving roller 29. A first transportation driving roller 33 is disposed at the downstream side of the paper discharging roller 27, and provides a transportation driving force to the roll paper 11 transported by the paper discharging roller 27 to be transported to the second ink-jet printer 2B located at a relatively upper position to the first ink-jet printer 2A.

Just in front of the first transportation driving roller 33, a cutter 35 is disposed to cut the roll paper 11. This cutter 35 has a function of cutting the roll paper 11 to make the printed portion of the roll paper 11 become a sheet of discrete paper, on one face of which a printing job is performed by the first ink-jet printer 2A, before the second ink-jet printer 2B starts another printing job on the other face of the cut roll paper 11. Therefore, in case discrete papers are used as recording media, the cutter is not needed to be included.

The second ink-jet printer 2B, located at an upper position, basically has a similar structure to the first ink-jet printer 2A, and the same functional elements are designated by the same reference numerals. A printing head 21 of the second ink-jet printer 2B is located over the lower face (which becomes the upper face when the roll paper 11 arrived at the second ink-jet printer 2B) of the roll paper 11, which is similar to the case of the first ink-jet printer 2A.

The second ink-jet printer 2B is located directly over the first ink-jet printer 2A, and has a printing body 3, a paper transporting unit 5 located toward the paper discharging unit 7 of the first ink-jet printer 2A, and a paper discharging unit 7.

The second ink-jet printer 2B further includes an auto loading roller 50 corresponding to the auto loading roller 8. A guide 37 is disposed at a downstream side of the auto loading roller 50. A paper releasing roller 39 is disposed at a downstream side of the paper discharging roller 27 of the second ink-jet printer 2B, and a cutter 41 is disposed just in front of the paper releasing roller 39.

A guiding path 43 is disposed between the paper discharging unit 7 of the first ink-jet printer 2A and the paper transporting unit 5 of the second ink-jet printer 2B, and guides the roll paper 11, on which a printing job is done by the first ink-jet printer 2A, to the second ink-jet printer 2B while the surface of the roll paper 11 is maintained to be in a plane. The above described first transportation driving roller 33 is disposed on the guiding path 43, and a paper edge guide 37 composes a portion of the guiding path 43.

As shown in FIG. 1, a reversing path 45 of U-shaped cross-section is formed on the guiding path 43. The reversing path 45 is bended to form a U-shaped portion through which the roll paper 11 is passed while the surface of the roll paper 11 is maintained to be relatively flat, and has an entrance 47 located near the first ink-jet printer 2A and an exit 49 located near the second ink-jet printer 2B. The roll paper 11, which has passed the first transportation driving roller 33, horizontally enters the reversing path 45 through the entrance 47, upwardly proceeds through the U-shaped portion of the reversing path 45, and horizontally comes out of the exit 49 of the reversing path 45 to the paper edge guide 37.

On the reversing path 45, the auto loading roller 50 functions as a second transporting roller for providing a transportation driving force to the discrete paper cut by the cutter 35. An auto loading detector is disposed just after the auto loading roller 50. Two (2) paper piling detectors 51 are disposed on the reversing path 45 in order to detect piling of the discrete paper cut by the cutter 35 and the roll paper 11. If the piling is detected the paper feed functioning section at the first inkjet printer 2A side is stopped to resolve the piling and, after that, the paper feed functioning section at the first inkjet printer 2A side is driven, i.e., lifting off the stopping state. Alternatively, the transportation speed of the roll paper 11 may be adjusted to resolve the piling status, if appropriate.

Now, length of the guiding path 43 is described in detail. The length of the guiding path 43 is measured from the paper discharging unit 7 of the first ink-jet printer 2A to the printing head 21 of the second ink-jet printer 2B along the path 43, and is required to be longer than the size of a print area of the roll paper 11 in the direction of transportation of the roll paper 11 printed by the first ink-jet printer 2A. By fulfilling this requirement, it is possible to prevent the tail of the roll paper 11 from being left in the first ink-jet printer 2A when the print area of the roll paper 11 printed by the first ink-jet printer 2A is arrived at the printing head 21 of the second ink-jet printer 2B.

In other words, if the tail of the print area of the roll paper 11 printed by the first ink-jet printer 2A is left in the first ink-jet printer 2A when the top of the print area is arrived at the second ink-jet printer 2B, it is needed to synchronize the transportation speed of the paper transporting roller 19 of the second ink-jet printer 2B with that of the paper discharging roller 27 (or the paper transporting roller 19) of the first ink-jet printer 2A, so that whole structure becomes very complex. However, by specifying the length of the guiding path 43 as described above, it is possible to cut the roll paper 11 before the top of the roll paper 11 is arrived at the printing head 21 of the second ink-jet printer 2B, and the paper transporting of the second ink-jet printer 2B is not needed to be synchronized with that of the first ink-jet printer 2A.

Now, the operation of the printing apparatus 1 according to the first embodiment of the present invention is described in detail, hereinafter. By driving the paper transporting roller 19 of the first ink-jet printer 2A, the roll paper 11 horizontally passes under the printing head 21 and a printing job is performed on the upper face of the roll paper 11. The print area enters the reversing path 45 through the paper discharging unit 7 and the first transportation driving roller 33, and the roll paper 11 is reversed as the paper moves upwardly along the U-shaped path of the path 45. At this moment, since the surface of the roll paper 11 is maintained to be in a plane, there is little possibility for the roll paper 11 to be shook, twisted or bent. After the printing job is completed by the first ink-jet printer 2A and the tail of the print area completely passed the location where the cutter 35 is disposed, the cutter 35 cuts the roll paper 11 at a predetermined position.

After cutting, the roll paper 11 is in the form of a sheet of discrete paper, and transported to the paper transporting roller 19 of the second ink-jet printer 2B through the paper edge guide 37 by the driving force of the second transportation driving roller 50. The second ink-jet printer 2B performs a printing job on the opposite face (the face on which the first ink-jet printer 2A does not perform a printing job) of the discrete paper as the first ink-jet printer 2A does, and the paper is released by the paper discharge driving roller 29 and the paper releasing roller 39.

The cutter 41 cuts the roll paper 11 at positions before and after the print area of the roll paper 11 to make the discrete paper have appropriate length. For example, in case the front portion of the roll paper 11 is already clearly cut at an exact position, it is possible to use the cutter 41 to cut the paper 11 only at a position after the print area in order to make the cut paper 11 have an exact length. Further, it is also possible to use the cutter 41 to eliminate the top and/or tail margin of the discrete paper.

By doing as described above, the roll paper 11 is printed on its both faces and finally released as a sheet of discrete paper. This kind of double-sided printing can be applied to print a jacket and its inner page of a CD-R in series.

Now, another embodiment of the double-sided printing apparatus of the present invention is described. According to this embodiment, as shown in FIG. 3, the first ink-jet printer 2A, which performs a printing job at first, is disposed at a relatively upper position, and the second ink-jet printer 2B is disposed under the first ink-jet printer 2A. In this case, the roll paper holder 10 is disposed on side of the first ink-jet printer 2A, and the ink cartridge 6A is disposed under the roll paper holder 10. The reversing path 45 is formed to transport the roll paper 11 downwardly from the paper discharging unit 7 of the first ink-jet printer 2A to the paper transporting unit 5 of the second ink-jet printer 2B. Further, positions of the second transportation driving roller 50 and paper piling detectors 51 are adjusted as appropriate.

Further, according to the embodiment shown FIG. 1, the printing heads 21 and 21 of the first and second ink-jet printers 2A and 2B are disposed over the paper 11 passage, but it is also possible to dispose the printing heads 21 and 21 of the first and second ink-jet printers 2A and 2B under the paper 11 passage.

Now, by referring to FIG. 5 to FIG. 37, another embodiment of the present invention is described in detail.

Figure 5:
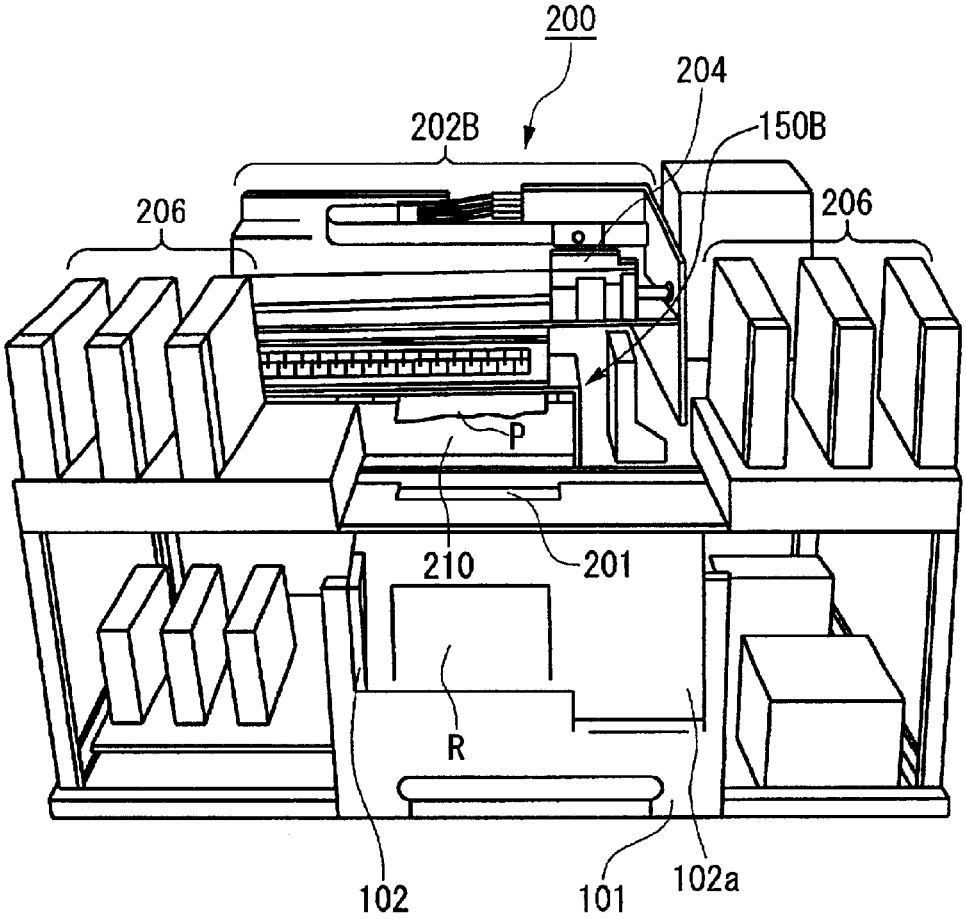
FIG. 5 shows an elevational view of still another embodiment of the double-sided printing apparatus of the present invention.
Figure 6:
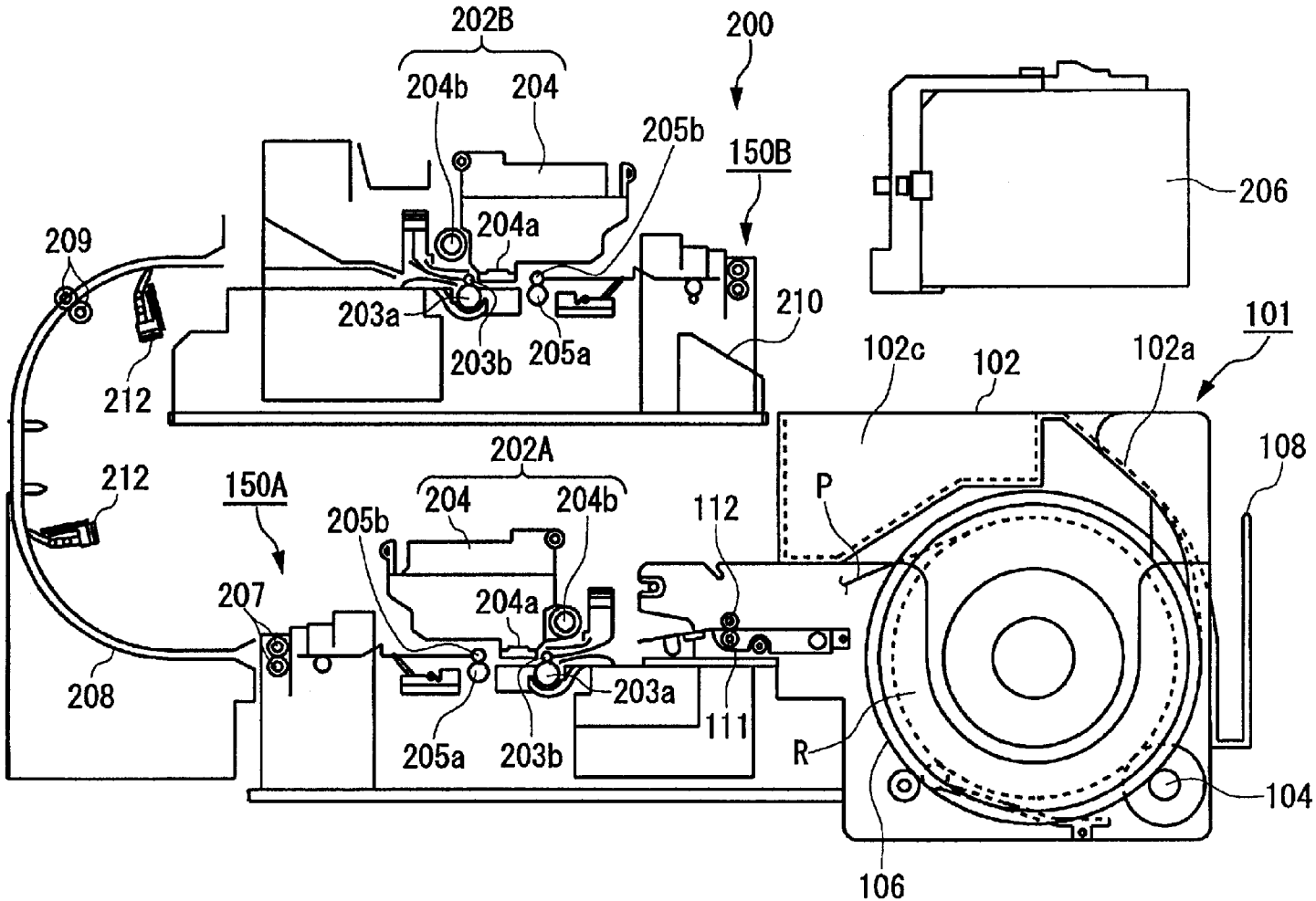
FIG. 6 shows a cross-sectional side view of the double-sided printing apparatus shown in FIG. 5.

1. Outline of the Double-sided Printing Apparatus:

Referring to FIG. 5 and FIG. 6, outline of the double-sided printing apparatus as a "recording apparatus" of the present invention is described. FIG. 5 shows an elevational view of an embodiment of the double-sided printing apparatus of the present invention, and FIG. 6 shows a cross-sectional side view of the double-sided printing apparatus shown in FIG. 5. Reference number 200 designates the double-sided printing apparatus.

The double-sided printing apparatus 200 includes a roll type printing paper as a recording medium on center and front portion of the apparatus 200, and the printing paper is drawn from the center and front portion of the apparatus 200. The double-sided printing apparatus 200 also includes a transportation path having a U-shaped cross-section. In order for the convenience of description and understanding, the roll paper in wound state is designated as "roll paper R", and the roll paper which is printed or to be printed is designated as "roll paper P", hereinafter.

In FIG. 5, reference number 101 and 150B respectively designate a roll paper cassette for setting the roll paper R and a cutting device for cutting the printed roll paper P at a desired position. As shown in FIG. 5, the roll paper cassette 101 is disposed at a lower center and front portion of the apparatus 200, and can be easily dismantled from the double-sided printing apparatus 200 for replacing.

As shown in FIG. 6, the roll paper P, transported from the front side (right side of FIG. 6) of the apparatus 200, proceeds upwardly and toward the front side of the apparatus 200 through a U-shaped portion at the rear side (left side of FIG. 6) of the apparatus 200, and released from the front side of the apparatus 200 over the cassette 101 (also see FIG. 5). A cover 102 of the roll paper cassette 101 includes a dust stacker 102*c* (not shown in FIG. 5) for gathering cutting dusts generated when the roll paper P is cut by the cutting device 150B, and the cutting dusts generated by the cutting device 150B fall down through a hole 201 (see FIG. 5) disposed under the cutting device 150B to the dust stacker 102*c*. The printed roll paper P is stacked on a released paper stacker 108 (not shown in FIG. 5) disposed in front of the roll paper cassette 101 through sliding on a curved surface 102*a* of the cover 102.

Details of the roll paper cassette 101 and the cutting device 150B are described after.

Now, referring to FIG. 6, devices disposed on paths of the roll paper Pare described in detail, hereinafter. For convenience of description and understanding, the upstream and downstream sides of the paper flow path are respectively called simply as "upstream side" and "downstream side".

The double-sided printing apparatus 200 includes two (2) ink-jet type printing devices 202A and 202B respectively disposed at lower and upper positions. The first ink-jet type printing device 202A performs a printing job on the roll paper P first and, in this description, is simply called as a "first printer", and the second ink-jet type printing device 202B performs another printing job on the roll paper P last and, in this description, is simply called as a "second printer". The first printer 202A includes a paper transporting roller 203, which includes a paper transportation driving roller 203*a* for transporting the roll paper P and a paper transportation slave roller 203*b* closely contacted with the paper transportation driving roller 203*a*, a nozzle head 204*a* as a recording unit disposed under a carriage 204 and a paper discharging roller 205 which includes a paper discharge driving roller 205*a* disposed at a downstream side of the nozzle head 204*a* and a paper discharge slave roller 205*b*, where the roll paper P is nipped between the paper discharge driving roller 205*a* and the paper discharge slave roller 205*b*.

The transportation driving roller 203*a* is rotationally driven by a driving motor (not shown) and transports the roll paper P under the nozzle head 204*a* at a predetermined pitch. The carriage 204 is guided by a carriage axle 204*b* and move back and forth in the main scanning direction (in the direction perpendicular to the surface of the paper of FIG. 6). Ink cartridge 206 disposed at upper front portion (upper right portion of FIG. 6) of the apparatus 200 provides required ink to the nozzle head 204*a*, and the printing is performed by ejecting the ink from the nozzle head 204*a* to the roll paper P transported under the nozzle head 204*a*. The paper discharge driving roller 205*a* is rotationally driven by a driving motor (not shown) and transports the roll paper P on which a printing job is completed toward the downstream side.

The second printer 202B has similar structure to the first printer 202A, and, in FIG. 6, the same elements are designated by the same reference numerals and detailed descriptions of the same elements are omitted. However, the paper transporting roller 203, the nozzle header 204*a* and the paper discharging roller 205 included in the second printer 202B respectively have functions of "a second paper transporting roller", "a second nozzle header" and "a second paper discharging roller".

On the path between the roll paper cassette 101 and the first printer 202A, the roll paper P is fed to the first printer 202A by a paper transporting roller 111 disposed on the roll paper cassette 101. The first printer 202A performs a printing job on a single face (hereinafter, "upper face") of the roll paper P. Then, the top of the roll paper passes through the cutting device 150A, and is transported to enter a transporting guide 208 by rotational driving of a supplementary driving roller 207 disposed at a downstream side of the cutting device 150A.

The transporting guide 208 has a U-shaped cross-section. The roll paper P entered into the transporting guide 208 is reversed as it moves upwardly, and further proceeds to the second printer 202B with the face printed by the first printer 202A downward. Since the face of the roll paper P facing with the nozzle head 204*a* is the back of the face on which the first printer 202A, the double-sided printing is achieved by the second printer's 202B performing another printing job.

To be more particular, after the top of the roll paper P is nipped by the supplementary transporting roller 209 disposed on the U-shaped transportation path of the transporting guide 208, the roll paper P is cut by the cutting device 150A disposed at a downstream side of the first printer 202A. Then, the roll paper P is in the form of a discrete paper and transported to the second printer 202B for another printing job. In order to perform these transportation and transporting operations more precisely, a paper piling detector 212 is provided on the U-shaped transportation path formed by the transporting guide 208. The paper piling detector 212 detects piling of tail of the roll paper P cut in discrete paper form and top of the next roll paper P. The transportation speeds of the first and second printers 202A and 202B can be controlled to be synchronized if it is needed as a result of the detection by the paper piling detector 212. Further, in this case, the length of the U-shaped transportation path may be determined to be enough for the tail of the roll paper P in a discrete paper form not to be left in the first printer 202A when the top of the roll paper P in a discrete paper form is arrived at the second printer 202B.

Since the cutting device 150B is disposed at a downstream side of the second printer 202B, unnecessary portion (s) of top and/or tail of the roll paper P in a discrete paper form on which a double-sided printing job is performed is/are removed, or the roll paper P in a discrete paper form may be cut at a desired position, and then stacked in the released paper stacker 108. The above is the outline of the double-sided printing apparatus 200 of the present invention.

According to the present embodiment, the first printer 202A, which performs a printing job on the roll paper P first, is disposed at a relatively lower position, the second printer 202B, which performs another printing job on the roll paper P lastly, is disposed at a relatively upper position, and the roll paper P discharged from the first printer 202A is reversed as it moves upwardly. However, this construction can be reversed: the first printer 202A may be disposed at an upper position and the second printer 202B may be disposed at a lower position.

2. Structure of the Roll Paper Cassette:

2.1. Outline of the Roll Paper Cassette

Figure 7:
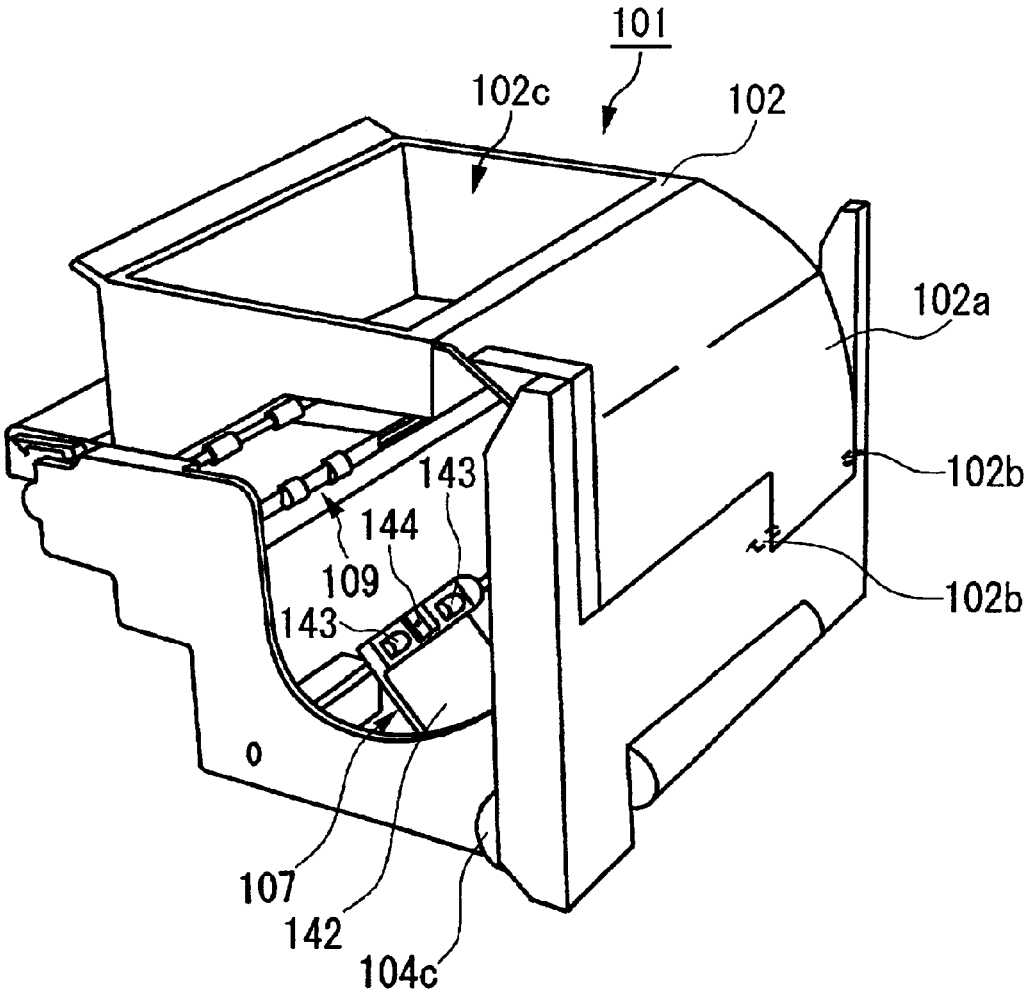
FIG. 7 shows an elevational view of a roll paper cassette with its cover closed.
Figure 8:
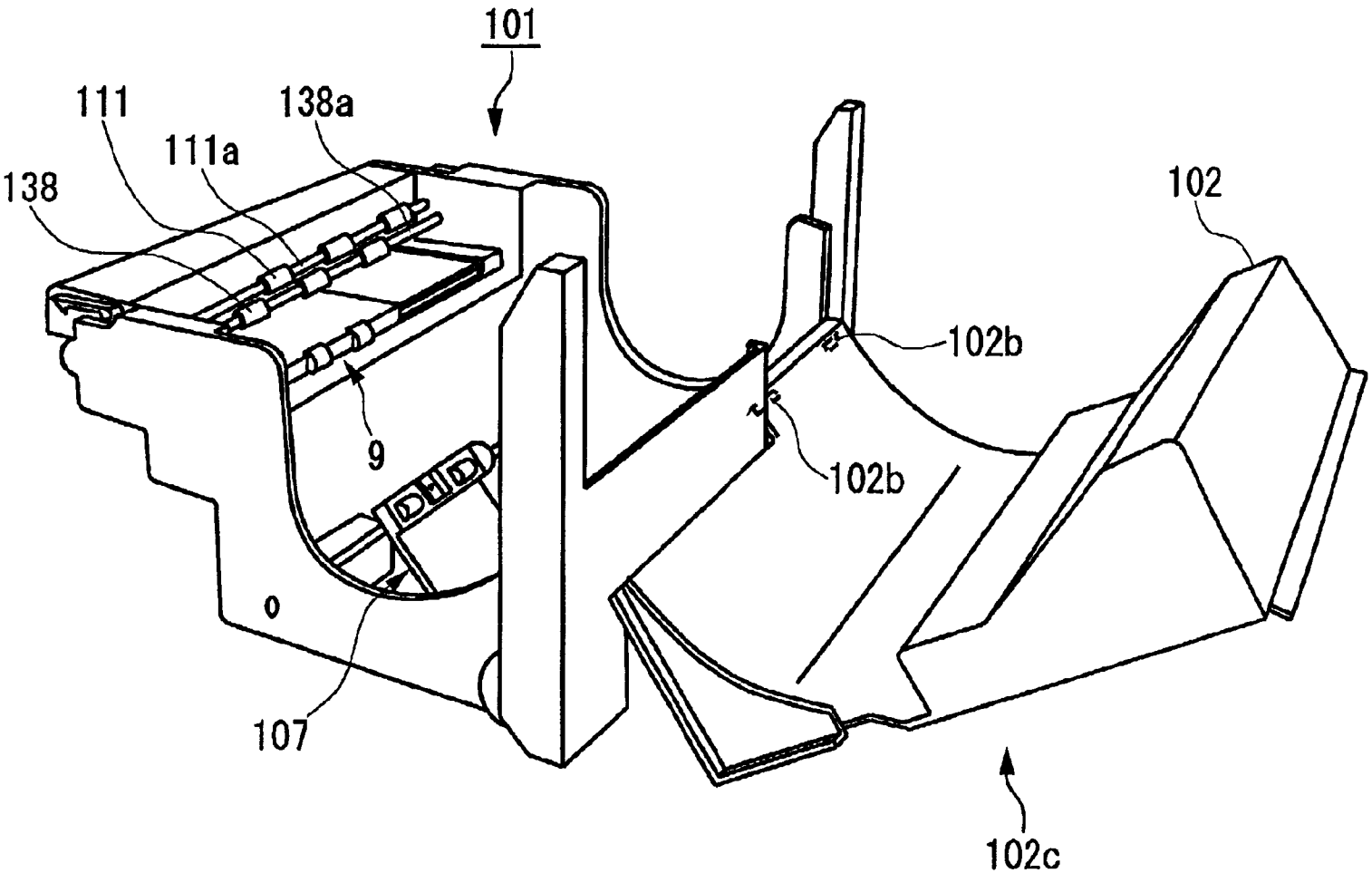
FIG. 8 shows an elevational view of a roll paper cassette with its cover open.
Figure 9:
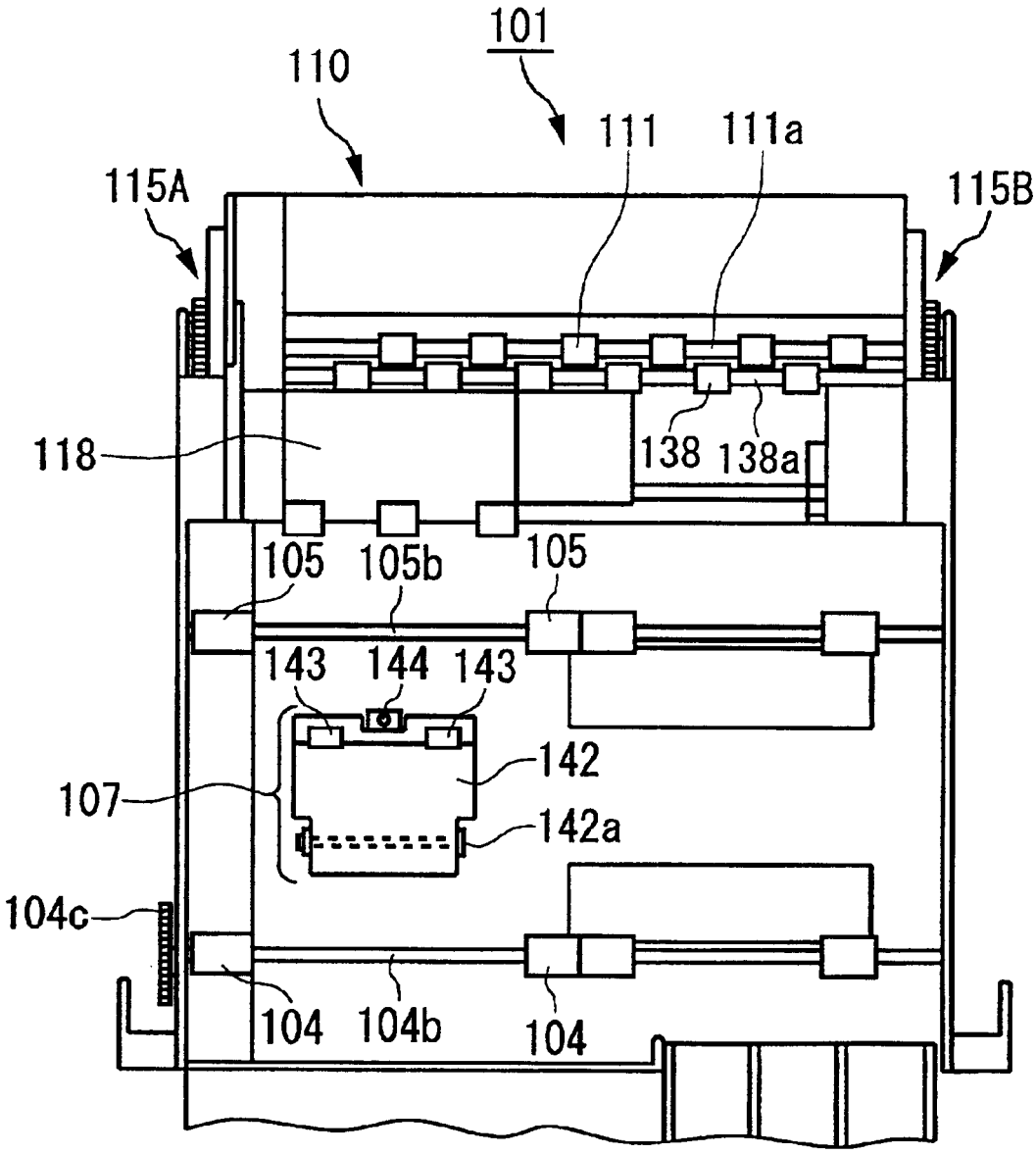
FIG. 9 shows a plane view of inside of a roll paper cassette.
Figure 10:
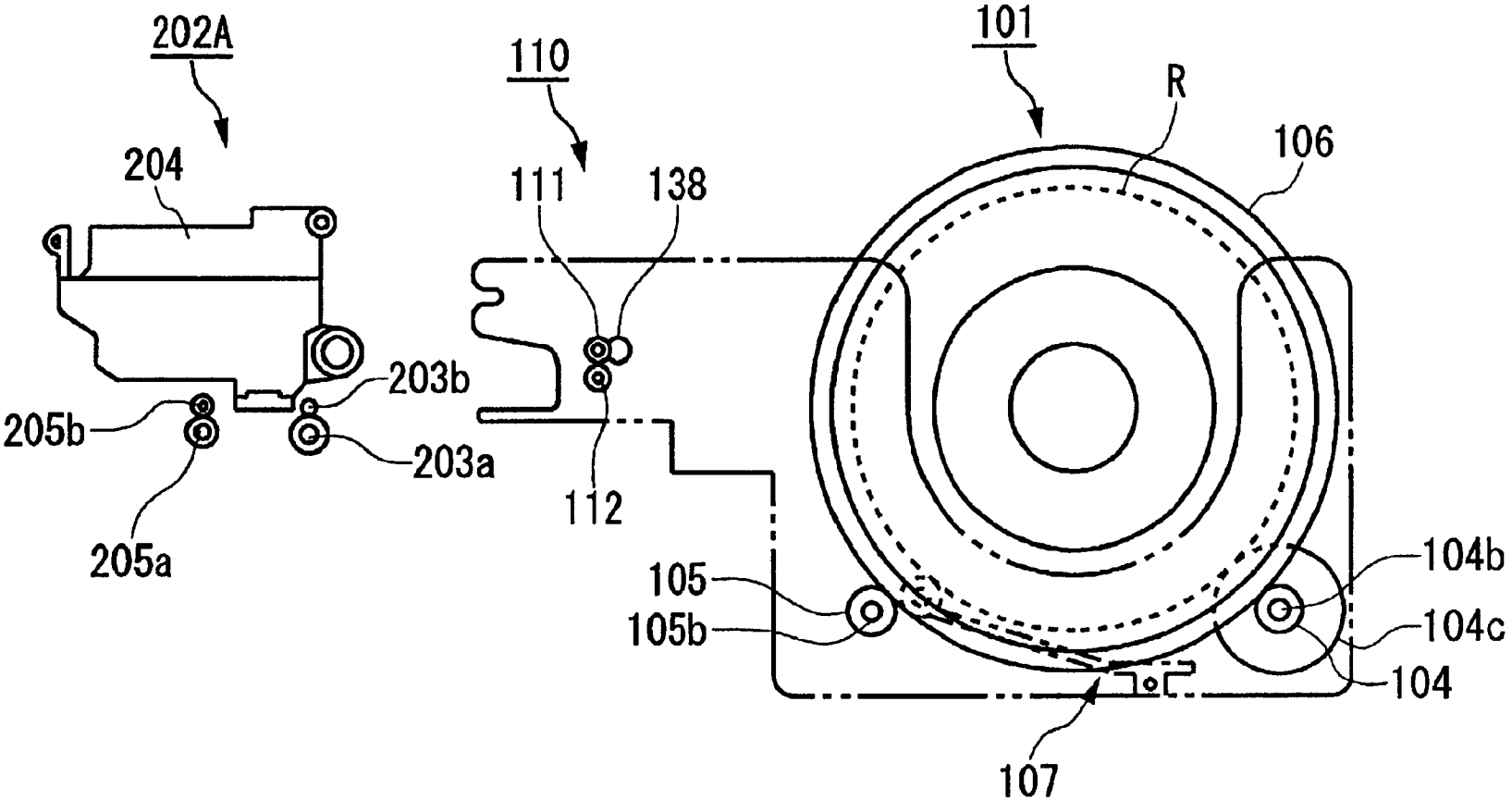
FIG. 10 shows a side view of transportation path of an embodiment of the double-sided printing apparatus of the present invention.
Figure 11:
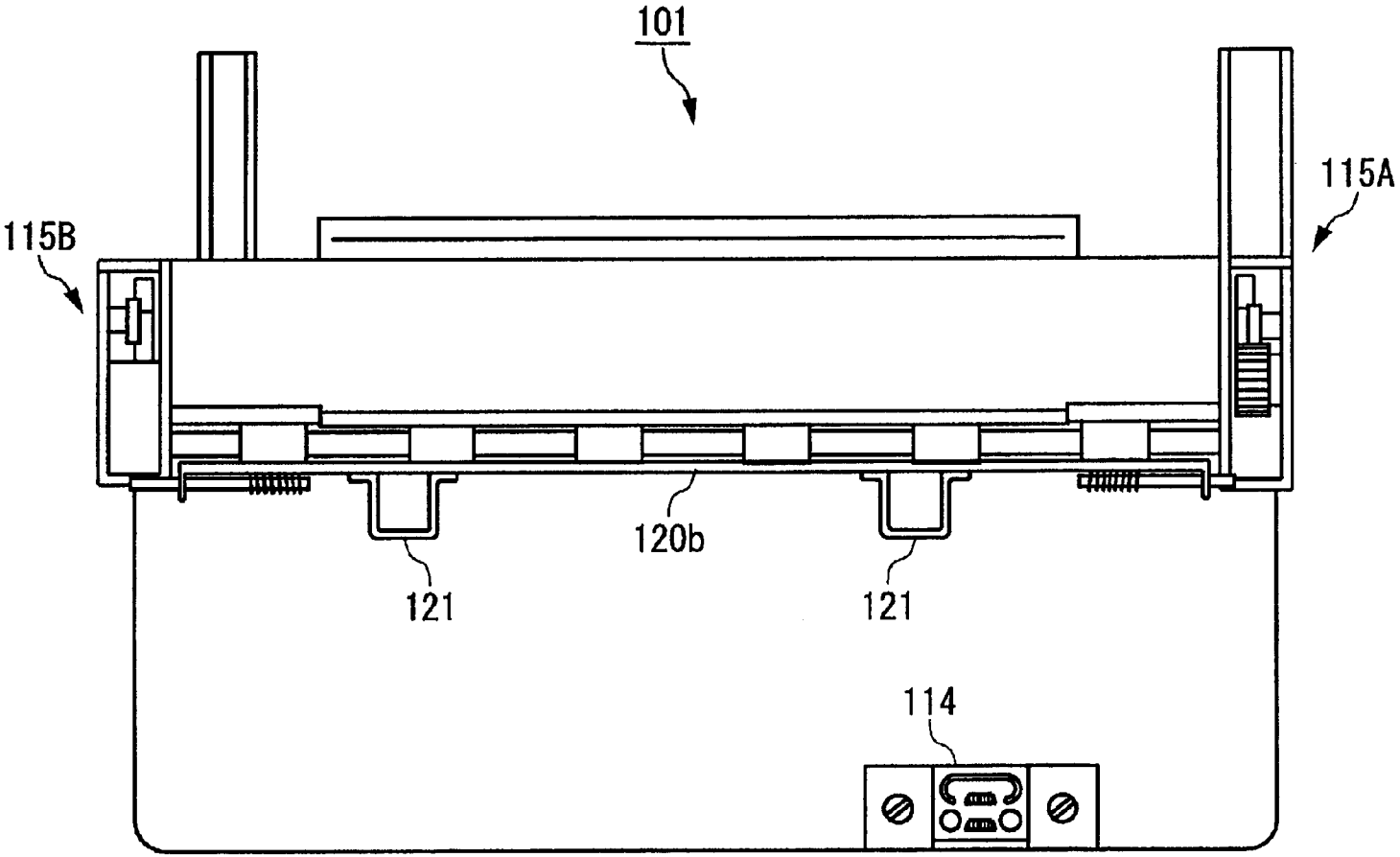
FIG. 11 shows a rear view of the roll paper cassette.

Now, referring to FIG. 7 to FIG. 11, details of the roll paper cassette 101 is described in detail. FIG. 7 shows an elevational view of the roll paper cassette 101 with its cover 102 closed, FIG. 8 shows an elevational view of the roll paper cassette 101 with its cover 102 open, and FIG. 9 shows a plane view of inside of the roll paper cassette 101. FIG. 10 shows a side view of a transportation path between the roll paper cassette 101 and the first printer 202A and FIG. 11 shows a rear view of the roll paper cassette 101 seen from the back of the double-sided printing apparatus 200 of the present invention.

As shown in FIG. 7, the cover 102 is installed on an upper portion of the roll paper cassette 101. The cover 102 has pivots 102*b* on the front portion of the roll paper cassette 101. The cover 102 is turned on the pivot 102*b* to be open as shown in FIG. 8. That is to say, the cover 102 can be open by turning the cover 102 toward the front side of the apparatus 200.

On the rear portion of the cover 102, the dust stacker 102*c* is formed and has a function of gathering cutting dusts generated by the cutting device 150B. As previously described with reference to FIG. 5 and FIG. 6, the cutting device 150B is disposed over the roll paper cassette 101. The cutting dusts generated by the cutting device 150B fall along a guiding slant 210 (see FIG. 5 and FIG. 6) of the double-sided printing apparatus 200, and are eventually gathered up in the dust stacker 102*c* of the cover 102 through the hole 201.

Here, the dust stacker 102*c* is formed as a box. In order to clean up the cutting dusts gathered in the dust stacker 102*c*, it is only required to turn over the dust stacker 102*c* from the state shown in FIG. 7 to the state shown in FIG. 8. As shown in the FIG. 7 and FIG. 8, since turning over the dust stacker 102*c* means opening the cover 102, whenever the cover 102 is opened the dust stacker 102*c* is always cleaned up. In other words, opening operation of the cover 102 includes cleaning operation of the dust stacker 102*c*. Therefore, it is possible to prevent a user from forgetting to clean up cutting dusts in the dust stacker 102*c* and for the cutting dusts from flowing over. According to the present embodiment, since stacking capacity of the dust stacker 102*c* can be made to be enough to stack cutting dusts generated during printing one whole roll of the roll paper R. Therefore, it is possible to prevent the cutting dusts from flowing over because the amount of gathered cutting dusts during printing at least one roll of the roll paper R is not more than the capacity of the dust stacker 102*c*.

According to the present embodiment, it is possible to open the cover of the roll paper cassette 101 and clean up the dust stackers at the same time, and it is useless to mention that this is also true to the case that a plurality of discrete papers are set in a so-called transporting cassette.

Next, referring to FIG. 9 and FIG. 10, inside structure of the roll paper cassette 101 is described in detail. As shown in the drawings, a drum rotating roller 104 as a "means for rotating the roll paper R" is provided on a drum rotating axle 104*b* at a lower front portion (lower side of FIG. 9) of the roll paper cassette 101, and a drum rotating roller gear 104*c* is provided at one end (left end in FIG. 9) of the drum rotating axle 104*b*. When the roll paper cassette 101 is installed on the double-sided printing apparatus 200, the drum rotating roller gear 104*c* receives rotating power by being engaged with a power transmitting gear (not shown in FIG. 9 and FIG. 10) installed on the double-sided printing apparatus 200. Details of the engagement of the drum rotating roller gear 104*c* and the power transmitting gear are described later.

Figure 12:
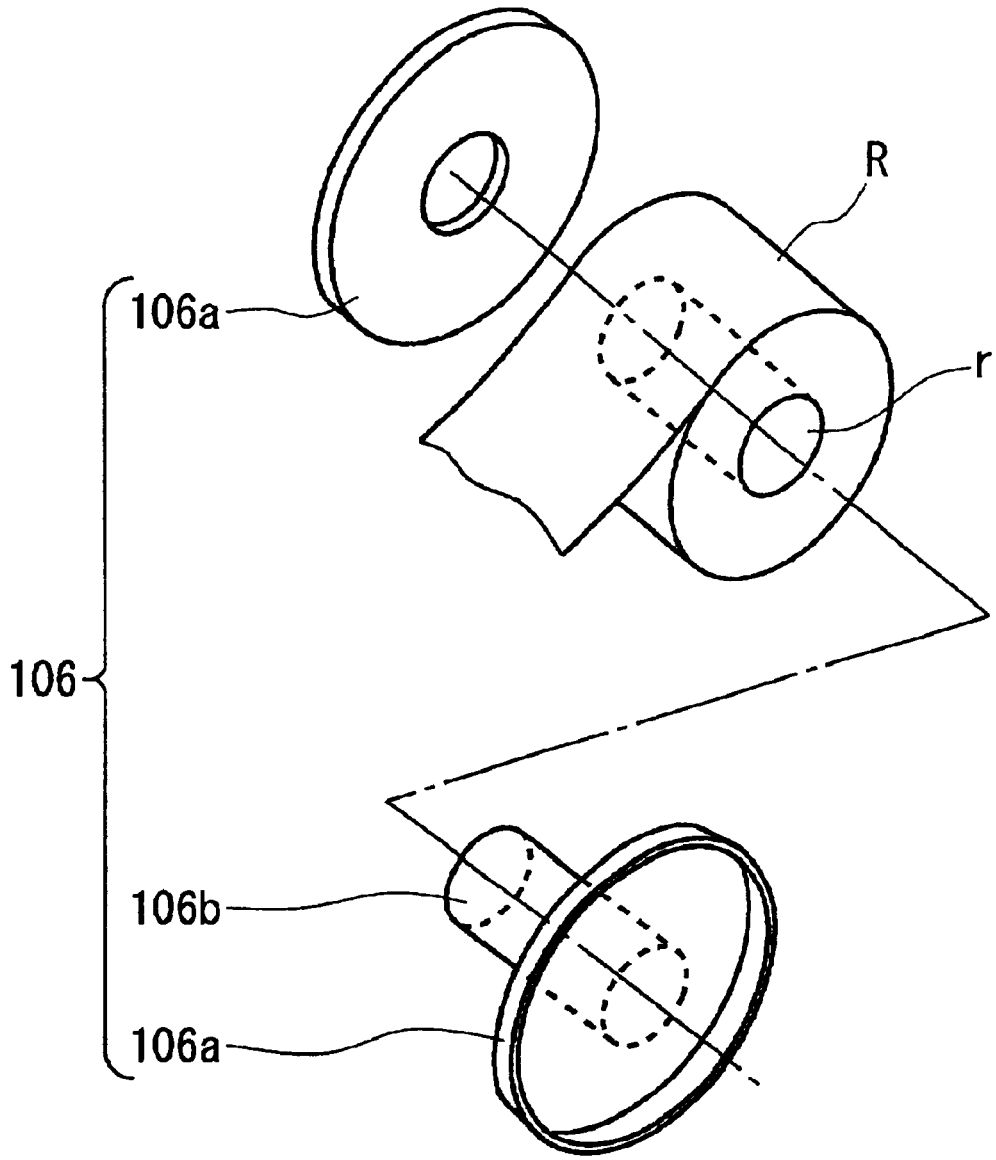
FIG. 12 shows an elevational view of a roll paper and an assembly drawing of a rotating drum used for the roll paper.

The roll paper R is installed on the rotating drum 106, which is rotatably installed in the roll paper cassette 101, as shown in FIG. 12. FIG. 12 shows an elevational view of the roll paper R and an assembly drawing of the rotating drum 106 used for the roll paper R. Axle 106*b* of the rotating drum 106 penetrates the center hollow r of the roll paper R which is frictionally coupled with the axle 106*b* of the rotating drum 106. So, if a rotational force is provided to a lobe 106*a* of the rotating drum 106, the roll paper R can rotate. Since the drum rotating roller 104 provides the rotating force to the lobe 106*a* of the rotating drum 106 and the lobe 106*a* of the rotating drum 106 is supported by the drum rotating roller 104, the roll paper R rotates as the drum rotating roller 104 rotates. As shown in FIG. 9 and FIG. 10, a supplementary drum roller 105 and a supplementary drum roller axle 105*b* are provided at the center of the roll paper cassette 101. The supplementary drum roller 105 supports the rotating drum 106 together with the drum rotating roller 104 and rotates dependently on the rotation of the drum rotating roller 104.

Here, since the rotating drum 106 is simply placed on the drum rotating roller 104, the rotating drum 106 (as a result, roll paper R) can be shifted on the direction of the axle of the drum rotating roller 104. Therefore, it is not required to set the roll paper R in the roll paper cassette 101 at a precise position on the direction of the axle of the drum rotating roller 104 by using a "means for making the roll paper movable", which includes the rotating drum 106 and the drum rotating roller 104, and setting the roll paper R in the roll paper cassette 101 becomes easier than the conventional case.

Next, referring to FIG. 9, a roll paper tail detector 107 is disposed at a lower portion of the roll paper cassette 101 between the drum rotating roller axle 104*b* and the supplementary drum roller axle 105*b*. A tail mark, which shows a predetermined length of paper from the tail of the roll paper R is left, is attached near the tail of the roll paper R. The roll paper tail detector 107 determines remaining length of the roll paper R by detecting the tail mark to prevent void printing operations. Details of the roll paper tail detector 107 are described later.

Next, a looseness detector, which has a rotating unit 118, of a roll paper looseness generating device 109 is provided at a slight back portion from the center of the roll paper cassette 101. Details of the roll paper looseness generating device 109 are described later. The roll paper looseness generating device 109 detects looseness state of the portion of the roll paper P between the roll paper R and the first printer 202A. In case the looseness state is detected to be "improper", the drum rotating roller 104 is driven to rotate in order to make the looseness state of the portion of the roll paper P between the locations "proper".

Here, the "improper" state of the looseness means that there is no or almost no looseness on the portion of the roll paper P between the roll paper R and the first printer 202A, and in this case, the roll paper P has high tension on that portion. The "proper" state of the looseness means that there is some looseness on the portion of the roll paper P between the roll paper R and the first printer 202A.

Therefore, there is no transportation load (or "back tension") on the first printer 202A, and the first printer 202A can perform a stable transportation operation. Details of the roll paper looseness generating device 109 are described later.

Next, a transporting device 110 for transporting the roll paper P to the first printer 202A is disposed at a back portion of the roll paper cassette 101. The transporting device 110 includes a transporting roller 111 and a slave transporting roller 112 (not shown in FIG. 9, see FIG. 10). The roll paper P is nipped by the transporting roller 111 and the slave transporting roller 112 and transported to the first printer 202A as the transporting roller 111 rotates. A supplementary roller 138 is provided on a supplementary roller axle 138*a* at an upstream side of the transporting roller 111. The supplementary roller 138 is in contact with the roll paper P to guide the transportation of the roll paper P while it rotates in response to the rotation of the transporting roller 111.

The above described roll paper tail detector 107 and the roll paper looseness generating device 109 need to be electrically coupled to a control unit (not shown) of the double-sided printing apparatus 200. Therefore, as shown in FIG. 11, a sub-connector 114 is disposed at the back portion of the roll paper cassette 101 for providing electrical signal lines from the double-sided printing apparatus 200. The sub-connector 114 is coupled to a main connector 113 (not shown in FIG. 11, see FIG. 26) disposed on the double-sided printing apparatus 200 when the roll paper cassette 101 is installed on the double-sided printing apparatus 200, so that electrical connection of electrical signal lines between the roll paper cassette 101 and the double-sided printing apparatus 200 is completed. Details of the method for electrically coupling the main connector 113 and the sub-connector 114 are described later.

Next, referring back to FIG. 9, the roll paper cassette 101 includes installation position fixing units 115A and 115B at both side of back portion of it in order to make the roll paper cassette 101 locked on the double-sided printing apparatus 200 when it is installed on the double-sided printing apparatus 200. The installation position fixing units 115A and 115B make sure the engagement of a second transporting roller gear 116*b* (not shown in FIG. 9 and FIG. 10, see FIG. 21) installed on the roll paper cassette 101 and the power transmitting gear 117 (not shown in FIG. 9 and FIG. 10, see FIG. 21) installed on the double-sided printing apparatus for transmitting driving forces to the second transporting roller 116*b*. The installation position fixing units 115A and 115B also make sure the transportation of the roll paper P by the transporting roller 111. Details of the installation position fixing units 115A and 115B are described later.

The above is the outline of the roll paper cassette 101.

2.2. Structure, Function and Result of the Paper Transporting Device

In this specification, the "forward direction" of the roll paper is defined to be "the direction in which the roll paper should rotate when a normal printing job is performed", and the "reverse direction" is defined to be the opposite direction of the "forward direction".

Referring to FIG. 13 to FIG. 17, the structure, function and result of the transporting device 110 are described in detail. Here, FIGS. 13 to 17 show cross-sectional views of a portion of the roll paper cassette 101. In the drawings, a movement of the rotating unit 118 is shown when the roll paper cassette 101 is installed on the double-sided printing apparatus 200.

Figure 13:
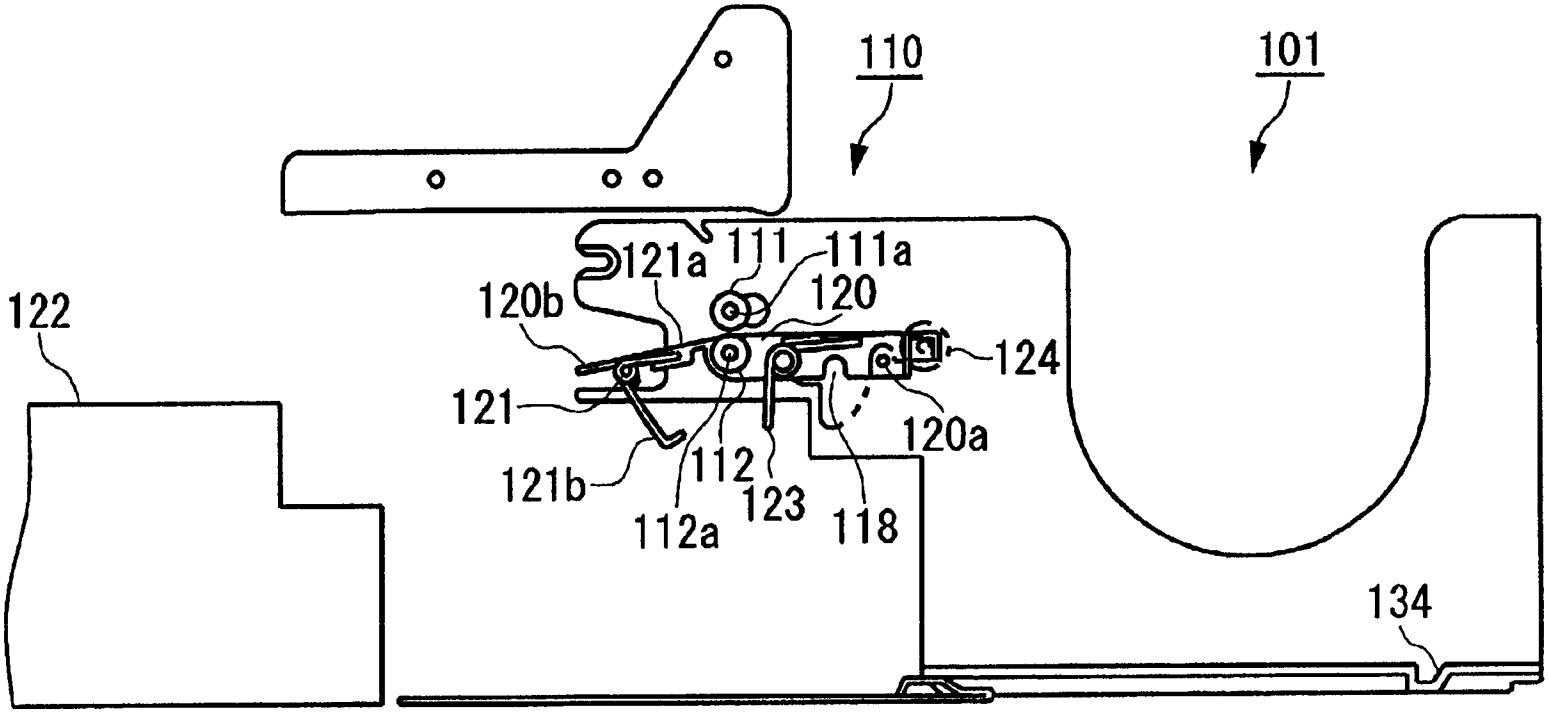
FIG. 13 shows a cross-sectional side view of a roll paper cassette.

First, referring to FIG. 13, structure of the transporting device 110 is described. As shown in FIG. 13, the transporting device 110 includes the transporting roller 111 and the slave transporting roller 112. The roll paper P is nipped between these two rollers 111 and 112 and transported by the rotation of the transporting roller 111. Here, there may be provided a plurality of transporting rollers 111 at predetermined intervals on the transporting roller axle 111*a* (see FIG. 9). The transporting roller axle 111*a* is rotatably driven and installed on the roll paper cassette 101 so as not to be shifted in any direction. The slave transporting roller axle 112*a*, on which the slave transporting roller 112 is provided, is installed on a center portion of the rotating unit 120. The rotating unit 120 can rotate in clockwise or counterclockwise direction on a rotating shaft 120*a*, which is parallel to the slave transporting roller axle 112*a*, as a rotation center, so that the slave transporting roller may be shifted in its vertical position and can be closely contacted with the transporting roller 111.

A pressing unit 120*b* is formed on the opposite end of the rotating unit 120 far from the rotating shaft 120*a*, where the slave transporting roller 112 is located between the pressing unit 120*b* and the rotating shaft 120*a*. A screwed coil spring 121 having an "L"-type side view is disposed under the pressing unit 120*b* with its open side facing the front side (right side of FIG. 13) of the roll paper cassette 101. The screwed coil spring 121 does not provide a pressing force to the pressing unit 120*b* when the roll paper cassette 101 is not installed on the double-sided printing apparatus 200, but when the roll paper cassette 101 is installed on the double-sided printing apparatus 200, the screwed coil spring 121 provides the pressing force to the pressing unit 120*b*, so that the pressing unit 120*b* can make the slave transporting roller 112 closely contact with the transporting roller 111.

In short, one end 121*a* of the screwed coil spring 121 acts as a "pressing force acting unit" for providing the pressing force to the pressing unit 120*b*, and the other end 121*b* of the screwed coil spring 121 acts as a "pressing force supporting unit" for providing the pressing force to the pressing unit 120*b*.

Now, referring FIGS. 13 to 17, the transition of the transporting device 110 is described following the installation procedures in relation with the action of the pressing force of the screwed coil spring 121 on the slave transporting roller 112.

Figure 14:
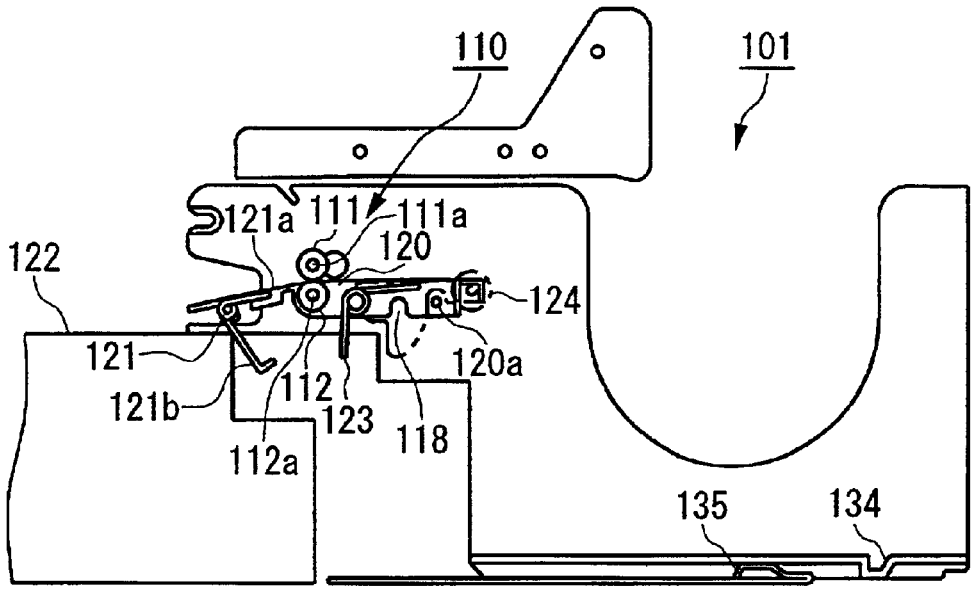
FIG. 14 shows a cross-sectional side view of a roll paper cassette.
Figure 15:
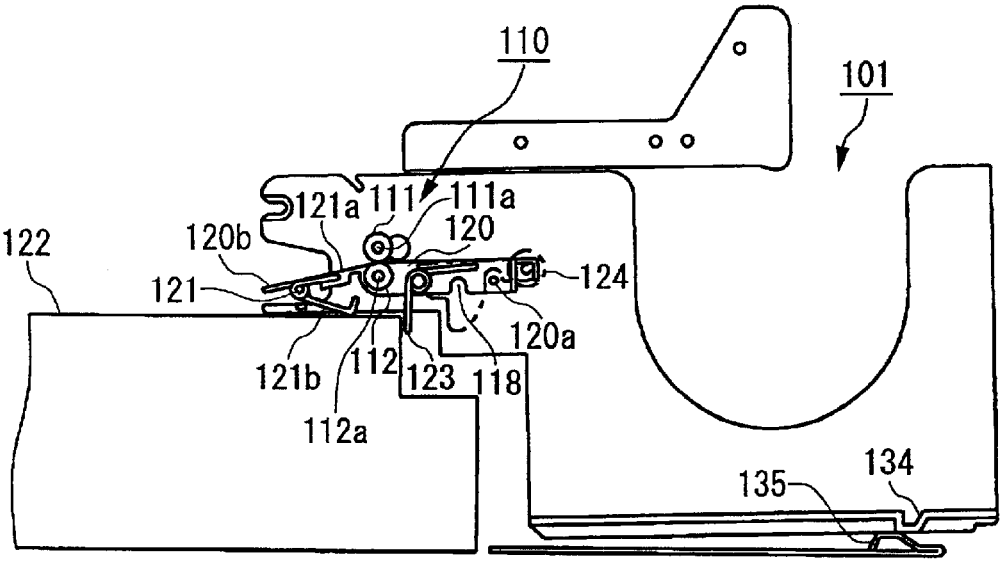
FIG. 15 shows a cross-sectional side view of a roll paper cassette.

In the drawings, reference number 122 designates a body side pressing unit provided on the double-sided printing apparatus 200. As shown in FIG. 13, since the body side pressing unit 122 is not initially engaged with the screwed coil spring 121, the slave transporting roller 112 is not closely contacted with the transporting roller 111 and there is a clearance between the two rollers 111 and 112. Then, as shown in FIG. 14, as the roll paper cassette 101 is installed on the double-sided printing apparatus 200, the one end 121*b* of the screwed coil spring 121 is contacted with the body side pressing unit 122 to provide a force in the upper direction. Therefore, the rotating unit 120 rotates in clockwise direction on a rotating shaft 120*a* as a rotation center to remove the clearance between the two rollers 111 and 112. Then, as the roll paper cassette 101 further proceeds into the double-sided printing apparatus 200, as shown in FIG. 15, the screwed coil spring 121 is completely placed on the body side pressing unit 122, so that complete pressing force is generated between the pressing unit 120*b* and the body side pressing unit 122, and the slave transporting roller 112 is pressed to contact with the transporting roller 111. The above is the transition of the transporting device 110 following the installation procedure of the roll paper cassette 101 on the double-sided printing apparatus 200.

Function and result of the transporting device 110 is described. When the roll paper R is set in the roll paper cassette 101 and the roll paper cassette 101 is installed on the double-sided printing apparatus 200, it is required that a predetermined amount of roll paper P is drawn from the roll paper R and inserted between the transporting roller 111 and the slave transporting roller 112. If the two rollers 111 and 112 are already in closely pressed contact when the roll paper P is to be inserted between the two rollers 111 and 112, the close contact of the two rollers 111 and 112 must be released by a user, and this is very troublesome. However, when the roll paper cassette 101 is dismantled from the double-sided printing apparatus 200, the transporting roller 111 and the slave transporting roller 112 are not in close contact with each other (see FIG. 13), and the close contact of the two rollers 111 and 112 can only be made after the roll paper cassette 101 is installed on the double-sided printing apparatus 200 (see FIG. 15). Therefore, it is very easy to insert the roll paper P between the transporting roller 111 and the slave transporting roller 112.

2.3. Structure of the Roll Paper Looseness Generating Device

The roll paper looseness generating device 109 has a similar structure to the transporting device 110. Referring to FIGS. 13 to 17, the roll paper looseness generating device (simply called as "looseness generating device", hereinafter) 109 mainly includes the rotating unit 118 and the screwed coil spring 123.

Figure 17:
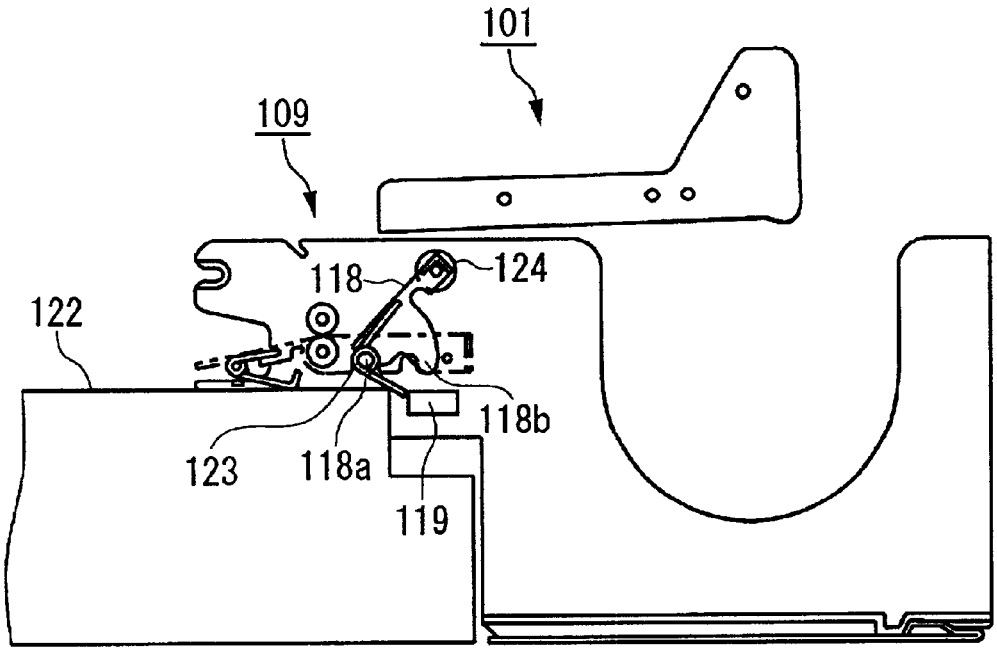
FIG. 17 shows a cross-sectional side view of a roll paper cassette.

First, referring to FIG. 17, structure of the looseness generating device 109 is described. As shown in FIG. 17, the rotating unit 118 can rotate in clockwise or counterclockwise direction on a rotating center 118*a*. A parting from the rotating center 118*a*, a guide roller 124 is installed to be contacted with the roll paper P (see FIG. 19). The guide roller 124 dependently rotates as the roll paper P proceeds, so that the friction between the guide roller 124 and the roll paper P can be reduced. Since the rotating unit 118 includes the screwed coil spring 123, as the roll paper cassette 101 proceeds into the double-sided printing apparatus 200 for installation, one end of the screwed coil spring 123 is pressed by the body side pressing unit 122, so that the rotating unit 118 upwardly rotates to "stand-up".

Figure 19:
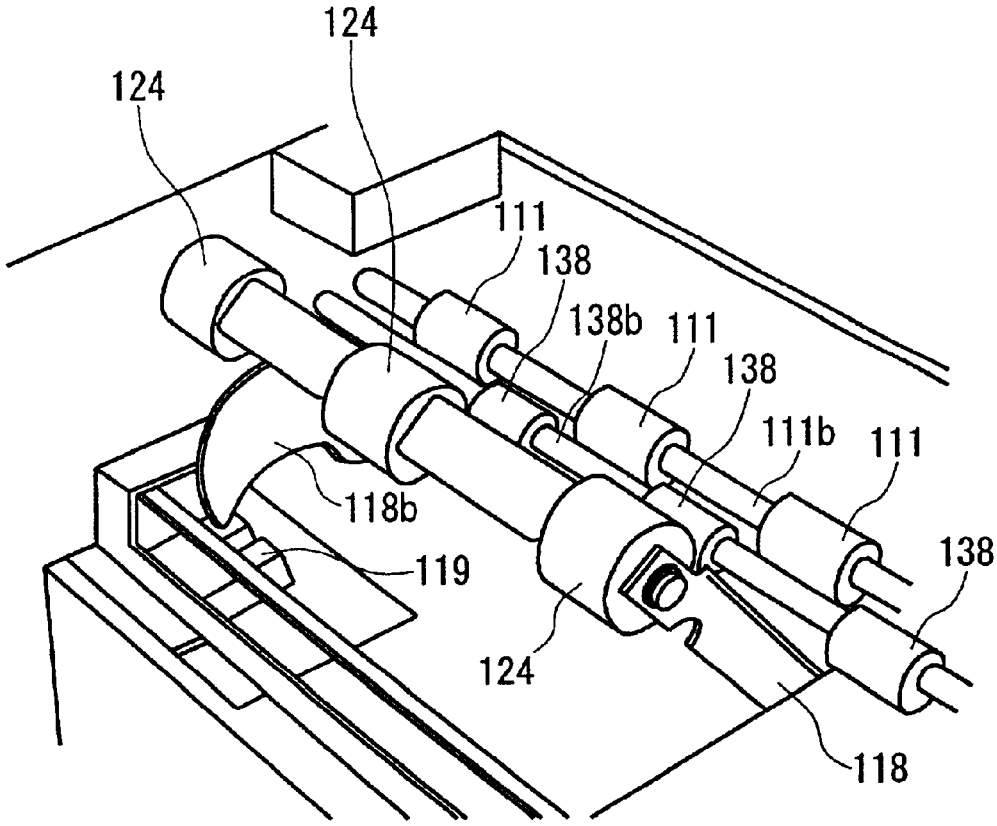
FIG. 19 shows an elevational view of a looseness detecting unit of a looseness generating device.

A sensing projection 118*b* of a crescent shape is formed to be downwardly protruded between the rotating center 118*a* and the guide roller 124. FIG. 19 shows elevational views of the sensing projection 118*b* of the rotating unit 118 when the sensing projection 118*b* is not overlapped on a sensing detector 119 (the rotating unit is in "stand-up" state).As shown in FIG. 19, since the sensing projection 118*b* is installed in combination with the sensing detector 119. When the rotating unit 118 downwardly rotates to "lie down", the sensing projection 118*b* is over lapped on the sensing detector 119, so that the "improper" looseness of the roll paper P is detected. On the contrary, if the roll paper P is loose and the rotating unit 118 upwardly rotates to "stand-up", the sensing projection 118*b* is not overlapped on the sensing detector 119, so that the "proper" looseness of the roll paper P is detected.

Figure 18A:
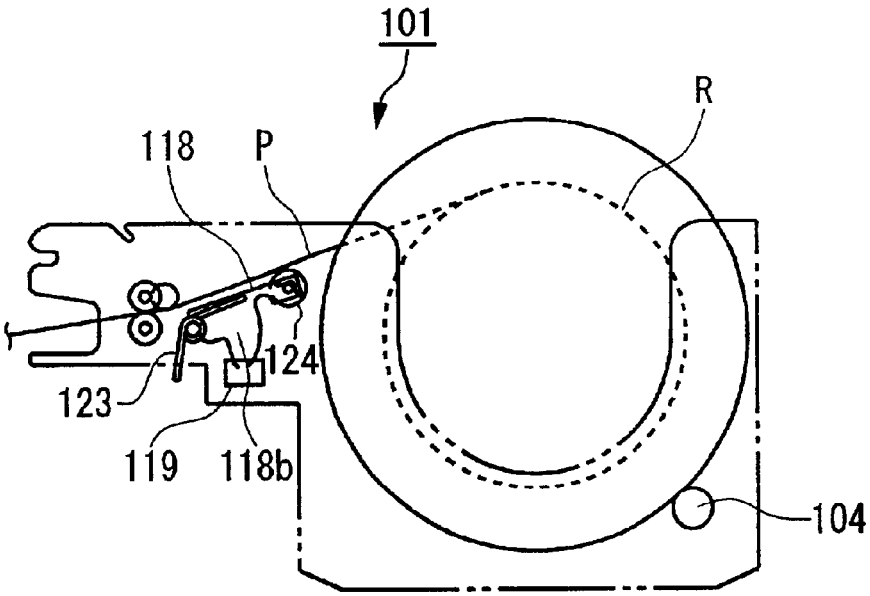
FIG. 18A shows a side view of a roll paper cassette in case looseness of the roll paper is "improper" and FIG. 18B shows a side view of a roll paper cassette in case looseness of the roll paper is "proper".
Figure 18B:
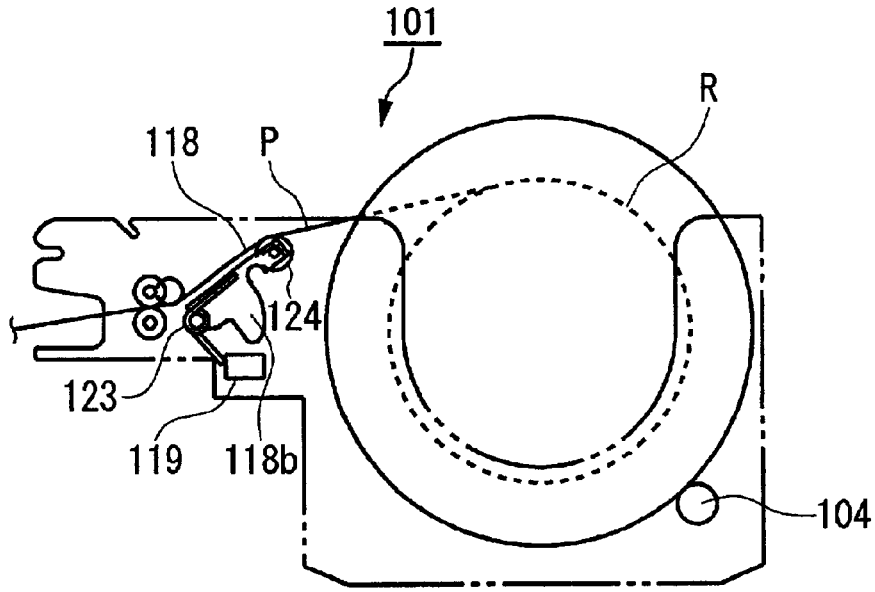

Here, the relationship of the change in looseness of the roll paper P with the rotating direction of the rotating unit 118 is described with reference to FIGS. 18A and 18B. FIG. 18A shows a side view of the roll paper cassette 101 in case looseness of the roll paper P is "improper", and FIG. 18B shows a side view of a roll paper cassette 101 in case looseness of the roll paper P is "proper". As shown in FIG. 18B, if the roll paper is loose enough, the rotating unit 118 stands up by the pressing force of the screwed coil spring 123. However, if the roll paper is not loose enough, the rotating unit 118 lies down against the pressing force of the screwed coil spring 123, and is in the state shown as in FIG. 18A. According to the present embodiment, the roll paper R is wound in counterclockwise direction, but the present invention also applied to the case the roll paper R is wound in clockwise direction.

Figure 16:
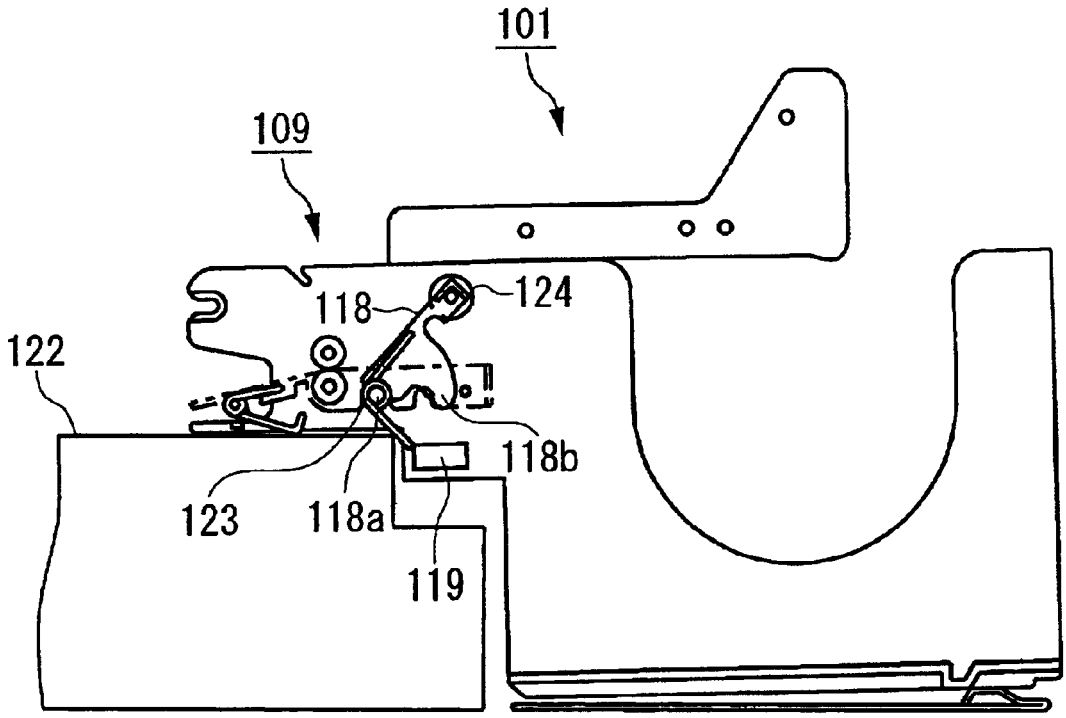
FIG. 16 shows a cross-sectional side view of a roll paper cassette.

The screwed coil spring 123 provides the pressing force to the rotating unit 118 by contacting with the body side pressing unit 122. When the screwed coil spring 123 is not contacted with the body side pressing unit 122, one end of the screwed coil spring 123 is in "free state" and does not provide any pressing force to the rotating unit 118. This free state of the screwed coil spring 123 is shown in FIG. 13, where the screwed coil spring 123 is not contacted with the body side pressing unit 122 and the rotating unit 118 is in "lie down" state. By this, the rotating unit 118 is not an obstacle for the roll paper P to be inserted between the transporting roller 111 and the slave transporting roller 112, and the roll paper P is easily inserted. Therefore, as shown in FIGS. 14 and 15, when the roll paper cassette 101 is installed on the double-sided printing apparatus 200, the screwed coil spring 121 of the transporting device 110 is first contacted with the body side pressing unit 122 and performs the above described function, and then, as shown in FIGS. 15 to 17, the screwed coil spring 123 of the looseness generating device 109 is contacted with the body side pressing unit 122 and performs the above described function, for example, the rotating unit 118 stands up.

Figure 20A:
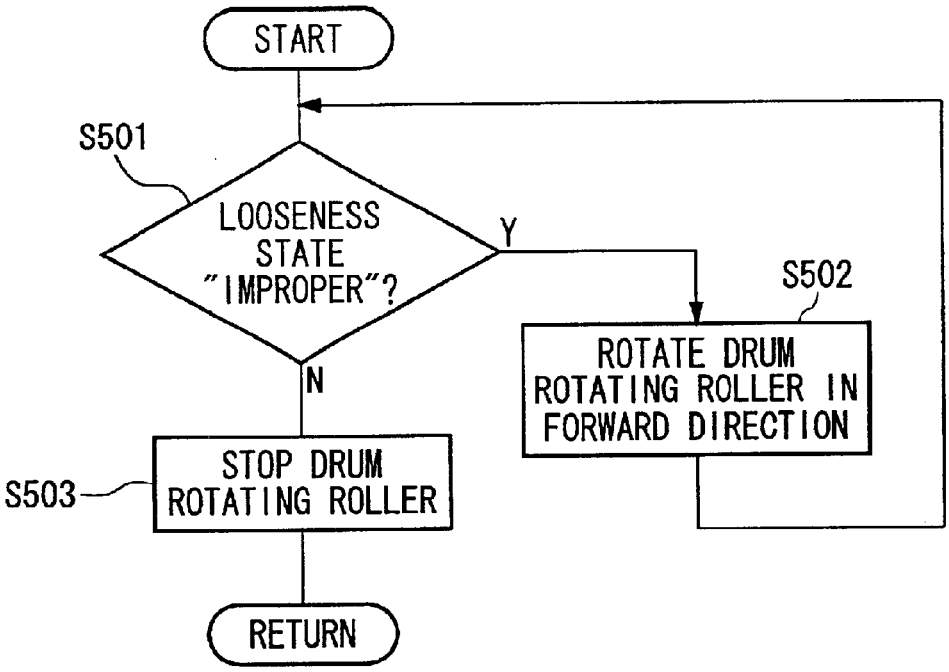
FIG. 20A shows a flowchart of a process flow of the looseness generating device during printing operation.
Figure 20B:
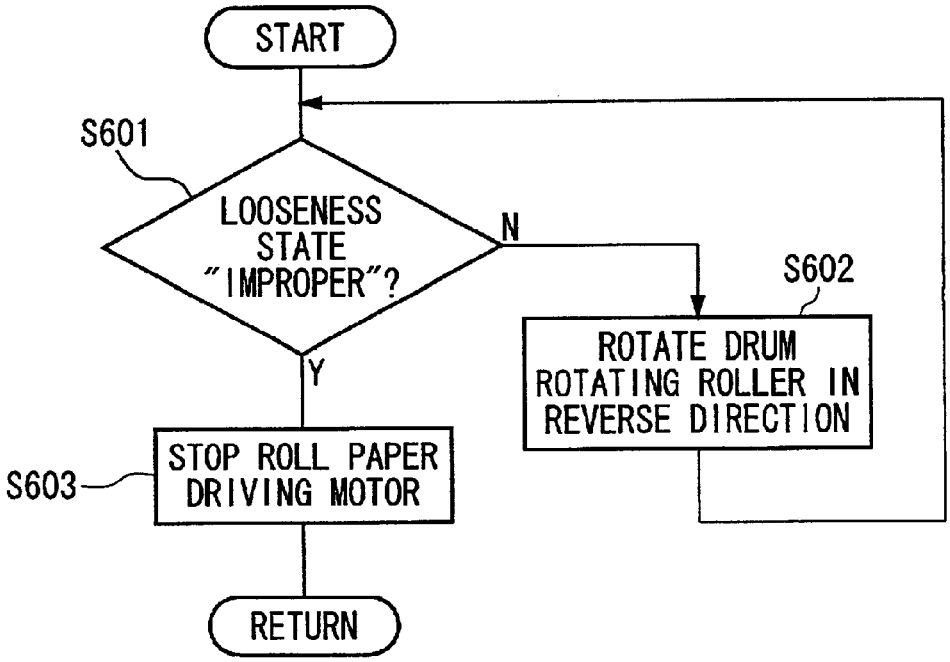
FIG. 20B shows a flowchart of a process flow of the looseness generating device during winding operation.

Next, referring to FIG. 20, the result of the looseness generating device 109 is described. FIG. 20A shows a flowchart of a process flow of the looseness generating device 109 during printing operation, and FIG. 20B shows a flowchart of a process flow of the looseness generating device 109 during winding operation.

First, referring to FIG. 20A, the result of the looseness generating device 109 during printing operation is described. If the looseness generating device 109 detects "improper" looseness of the roll paper R (Y branch of step 501), the roll paper R rotates in a forward direction by rotating the drum rotating roller 104 (step 502), so that the looseness of the roll paper P becomes "proper". Therefore, while the first printer 202A performs a printing job, the looseness condition of the roll paper P can be set to a proper value. Therefore, the first printer 202A does not have any transportation load and can perform a printing job normally. Further, if it is not detected that the roll paper P has an "improper" looseness condition, the drum rotating roller 104 stops rotating (step 503) and waits until the looseness of the roll paper P is detected to be "improper". Owing to this operation, an undesirable excessive feeding of the roll paper P can be prevented. As described above, it is possible for the first printer 202A to normally perform a printing job even when the weight of the roll paper R is increased so that the force needed to rotate the roll paper R (the force to draw out the roll paper P) is increased by using the looseness generating device 109.

Next, referring to FIG. 20B, the result of the looseness generating device 109 during winding operation of the roll paper R. In order to wind the roll paper R when a predetermined amount of the roll paper P is drawn out from the paper transporting roller 203 of the first printer 202A, the paper transporting roller 203 and the transporting roller 111 must be rotated in reverse direction. In this case, the roll paper P between the first printer 202A and the roll paper R is extremely loosened, and the roll paper P can be wrinkled. However, when the looseness of the roll paper P is detected to be "proper" by the looseness generating device 109, it is possible to prevent the roll paper P from being wrinkled by winding the roll paper P as a result of rotating the drum rotating roller 104 and the roll paper R in reverse direction. Therefore, if the looseness generating device 109 does not detect "improper" looseness of the roll paper 109, in other words, the looseness generating device 109 detects "proper" looseness of the roll paper 109 (N branch of step 601), the loose portion of the roll paper P is wound by rotating the drum rotating roller 104 and the roll paper R in reverse direction (step 602). If it is detected that the roll paper P has an "improper" looseness condition (Y branch of step 601), the drum rotating roller 104 stops rotating and waits until "proper" looseness of the roll paper P is generated.

As above, the result of the looseness generating device 109 is described, where it is possible to reduce the transportation load during printing and to prevent the roll paper P from being wrinkled when the roll paper returns.

2.4. Determination of the Roll Paper Cassette and the Installation Position Fixing Units Next, referring to the FIGS. 21 to 25, the determination of the position of the roll paper cassette 101 in relation to the double-sided printing apparatus 200 and installation position fixing units are described. Here, FIGS. 21 to 24 show cross-sectional side views of the roll paper cassette 101, and transitions of the roll paper cassette 101 when the roll paper cassette 101 is installed on the double-sided printing apparatus 200. FIG. 25 shows an elevational rearview of a roll paper cassette.

Figure 21:
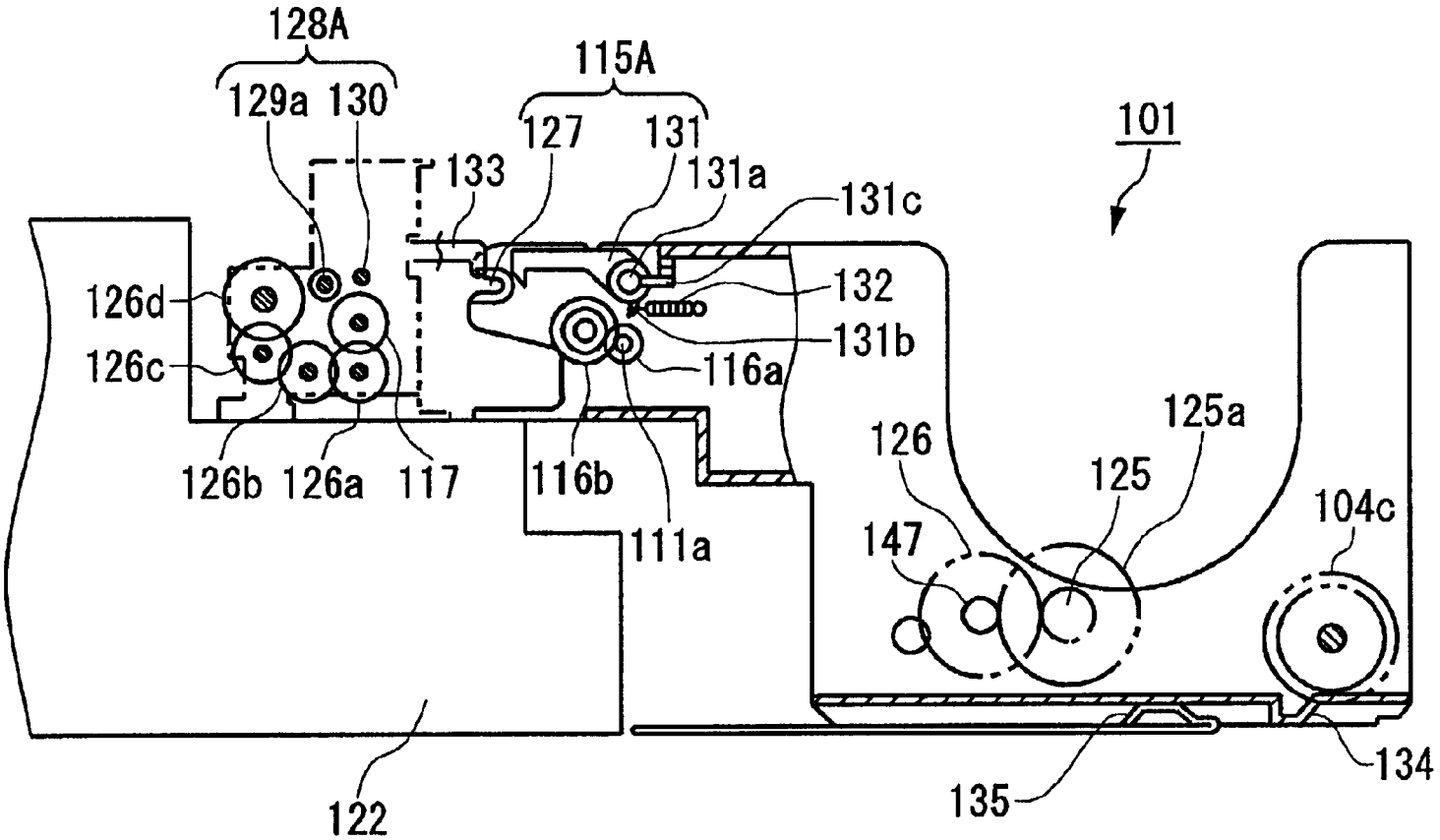
FIG. 21 shows a cross-sectional side view of a roll paper cassette.

First, referring to FIG. 21, the drum rotating roller gear 104*c* is installed at a front portion (right side of the FIG. 21) of the roll paper cassette 101. The drum rotating roller gear 104*c* is engaged with a power transmitting gear 125 for providing power to the drum rotating roller gear 104*c* when the roll paper cassette 101 is installed on the double-sided printing apparatus 200. By this engagement, the drum rotating roller 104 is rotated. A pinion gear 147 installed on a driving motor 126 is always engaged with the power transmitting gear 125 via a gear 125*a*.

Next, at a back portion (left side of FIG. 21) of the roll paper cassette 101, a first transporting roller gear 116*a* installed on the transporting roller axle 11*a* is engaged with a second transporting roller gear 116*b*. When the roll paper cassette 101 is installed on the double-sided printing apparatus 200, the second transporting roller gear 116*b* is engaged with a power transmitting gear 117 installed on the double-sided printing apparatus 200, and by this engagement, the transporting roller axle 111*a* (or the transporting roller 111) is rotated. A series of gears 126*a*, 126*b*, 126*c* and 126*d* transmits rotating power to the power transmitting gear 117 from a driving motor (not shown).

Whether the above described gear engagements, in other words the engagements of the drum rotating roller gear 104*c* with the power transmitting gear 125 and the second transporting roller gear 116*b* with a power transmitting gear 117, are satisfactory or not is determined by the condition of installation of the roll paper cassette 101 on the double-sided printing apparatus 200. In other words, if the roll paper cassette 101 is not precisely installed on the double-sided printing apparatus 200 nor the installation can not be maintained to be strongly fixed, the roll paper cassette 101 can be moved to apart from the double-sided printing apparatus 200 by the rotation of the gears. Therefore, in order for the roll paper cassette 101 to be properly installed on the double-sided printing apparatus 200, the installation position fixing unit 115A is installed on the roll paper cassette 101. If the installation position fixing units 115A is combined with a body side locking unit 128A, the roll paper cassette 101 is precisely installed on the double-sided printing apparatus 200 and the installation can be maintained to be strongly fixed. Now, the structures of the installation position fixing units 115A and the body side locking unit 128A are described in detail.

A U-shaped ditch 127 included in the installation position fixing unit 115A is formed on a protruded area of a back portion (left side of FIG. 21) of the roll paper cassette 101. As shown in the drawing, the U-shape ditch 127 has an opening toward the installation direction (left side of FIG. 21) of the roll paper cassette 101. When the roll paper cassette 101 is installed on the double-sided printing apparatus 200, the U-shaped ditch 127 is engaged with a first position fixing pin 129*a* included in the body side locking unit 128A installed on the doubled-sided printing apparatus 200, so that the U-shaped ditch 127 specifies the movement of the roll paper cassette 101 in the direction of the installation (left side of FIG. 21) and optimizes "back latching" of the engagements of the drum rotating roller gear 104*c* with the power transmitting gear 125 and the second transporting roller gear 116*b* with a power transmitting gear 117.

Next, a hooking unit 131 included in the installation position fixing unit 115A is installed near from the U-shaped ditch 127. The hooking unit 131 is latched on a second position fixing pin 130 included in the body side locking unit 128 to be engaged with the second position fixing pin 130. The hooking unit 131 specifies the movement of the roll paper cassette 101 in the direction of dismantlement (right side of FIG. 21) from the double-sided printing apparatus 200. In detail, the hooking unit 131 has a rotation point 131*a* on which the hooking unit 131 rotates in a direction perpendicular to the axle of the second position fixing pin 130. The hooking unit 131 may or may not be latched on the second position fixing pin 130 by rotating on the rotation point 131*a*. Under the rotation point 131*a*, a spring engaging unit 131*b* is formed, and a coil spring 132 is installed on the spring engaging unit 131*b*, so that the hooking unit 131 receives a spring force in the direction of maintaining the engagement with the second position fixing pin 130.

Further, a rotating force acting unit 131*c* is formed to be elongated in the direction of departing from the rotation point 131*a* at an opposite position of the hooking unit 131 far apart from the second position fixing pin 130. By pressing down the rotating force acting unit 131*c*, the hooking unit 131 is rotates in the direction of releasing the engagement with the second position fixing pin 130. On the double-sided printing apparatus side, a hook rotating unit 133 is installed to be located over the rotating force acting unit 131*c* and to press down the rotating force acting unit 131*c* when the roll paper cassette 101 is installed on the double-sided printing apparatus 200. When the user wants to dismantle the roll paper cassette 101 from the double-sided printing apparatus 200, the user can simply lift the roll paper cassette 101, and then the rotating force acting unit 131*c* is pressed down by the hook rotating unit 133 and the engagement of the hooking unit 131 with the second position fixing pin 130 is easily released.

Next, referring to FIGS. 21 to 24, the transition of engagement of the installation position fixing unit 115A with the body side locking unit 128A when the roll paper cassette 101 is installed on the double-sided printing apparatus 200 is described in detail.

First, referring to FIG. 21, a cassette side projection unit 134 is formed beneath the bottom of the roll paper cassette 101. A body side projection unit 135 is formed to be projected upwardly on the double-sided printing apparatus 200. When the roll paper cassette 101 is installed on the double-sided printing apparatus 200, the roll paper cassette 101 is supported to be slightly lifted on the double-sided printing apparatus 200 (also see FIG. 26).

Figure 22:
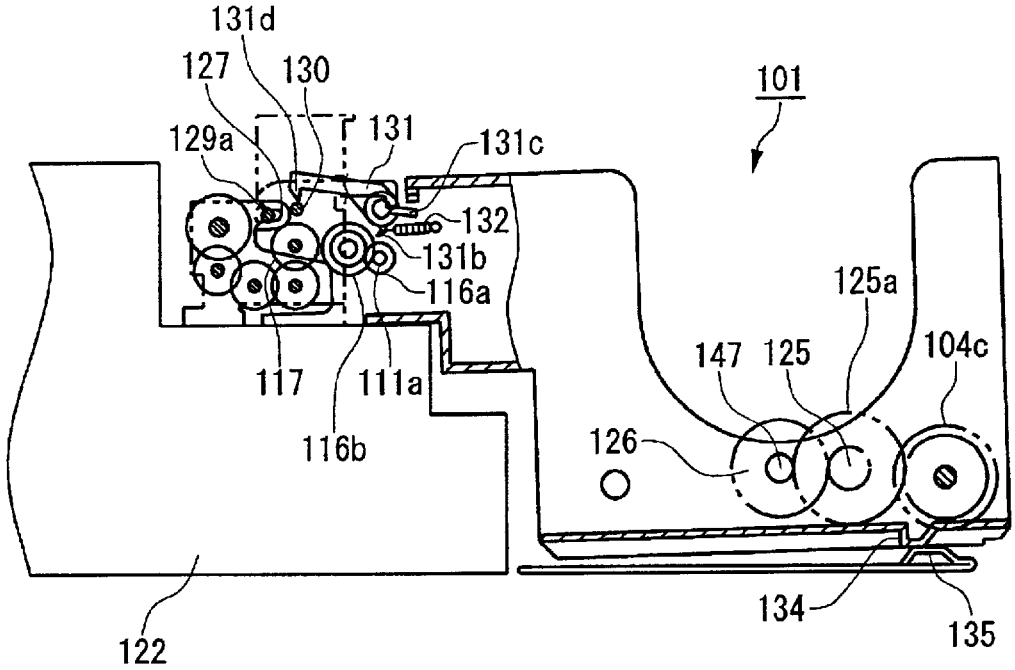
FIG. 22 shows a cross-sectional side view of a roll paper cassette.

Next, FIG. 22 shows the cassette side projection unit 134 is on the body side projection unit 135. As shown in FIG. 22, at this moment, the U-shaped ditch 127 begins to be engaged with the first position fixing pin 129*a*. Further, since a head end 131*d* of the hooking unit 131 in the direction of installation of the roll paper cassette 101 is formed to be inclined in order that the hooking unit 131 can easily be engaged with the second position fixing pin 130, the hooking unit 131 is slightly rotated in clockwise direction when the head end 131*d* is on the second position fixing pin 130.

Figure 23:
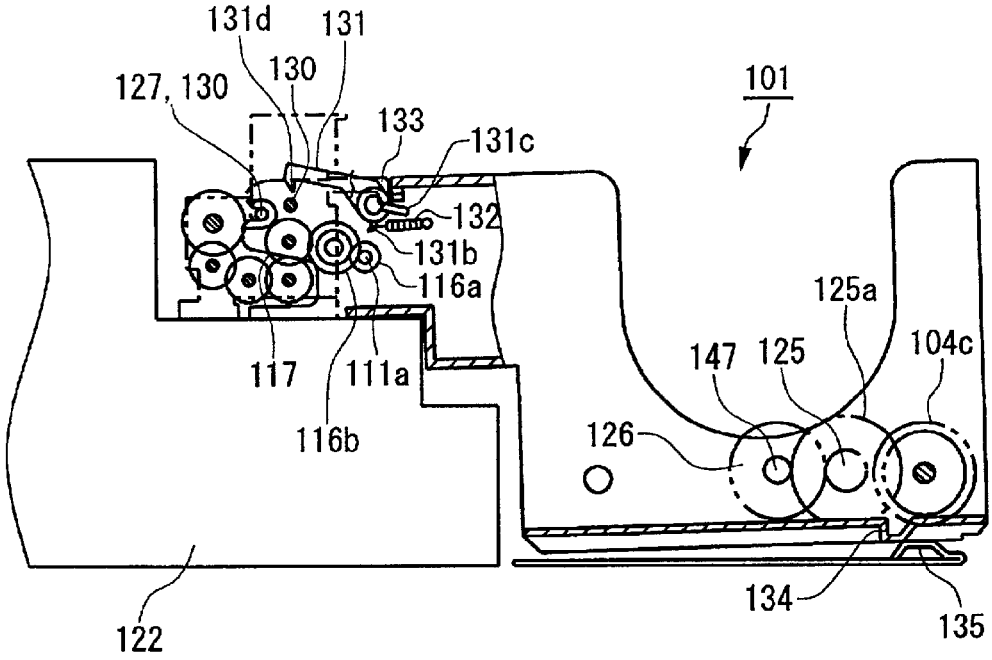
FIG. 23 shows a cross-sectional side view of a roll paper cassette.

As shown in FIG. 23, when the roll paper cassette 101 further proceeds toward the inside of the double-sided printing apparatus and the cassette side projection unit 134 has just passed over the body side projection unit 135, the U-shaped ditch 127 has been completely engaged with the first position fixing pin 129 and the engagements of the second transporting roller gear 116*b* with the power transmitting gear 117 and the drum rotating roller gear 104*c* with the power transmitting gear 125 are in optimum state.

Figure 24:
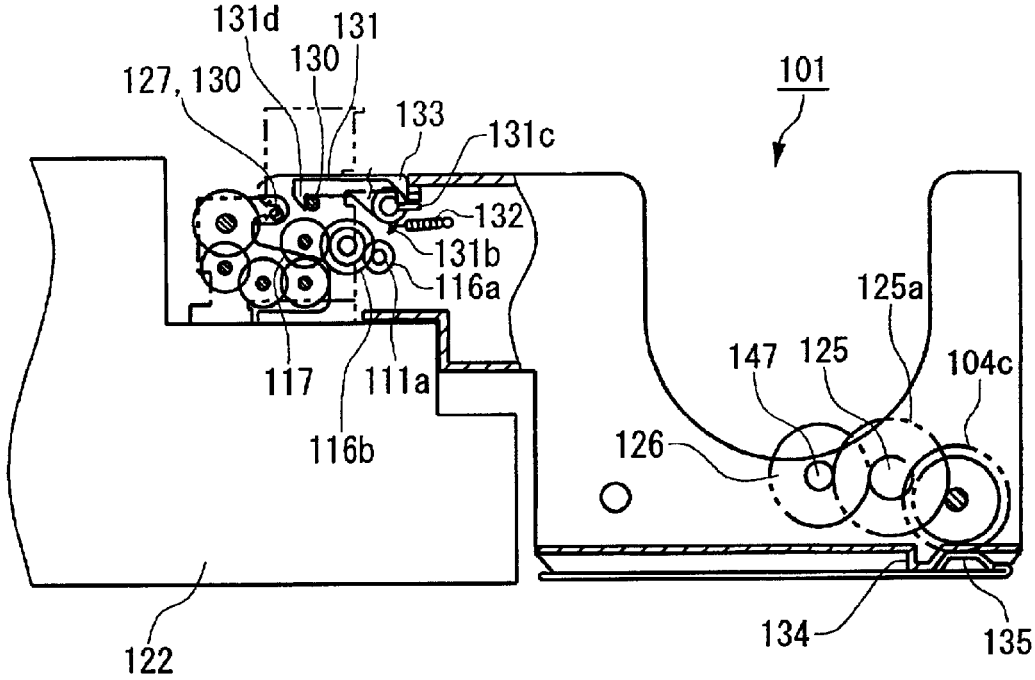
FIG. 24 shows a cross-sectional side view of a roll paper cassette.
Figure 25:
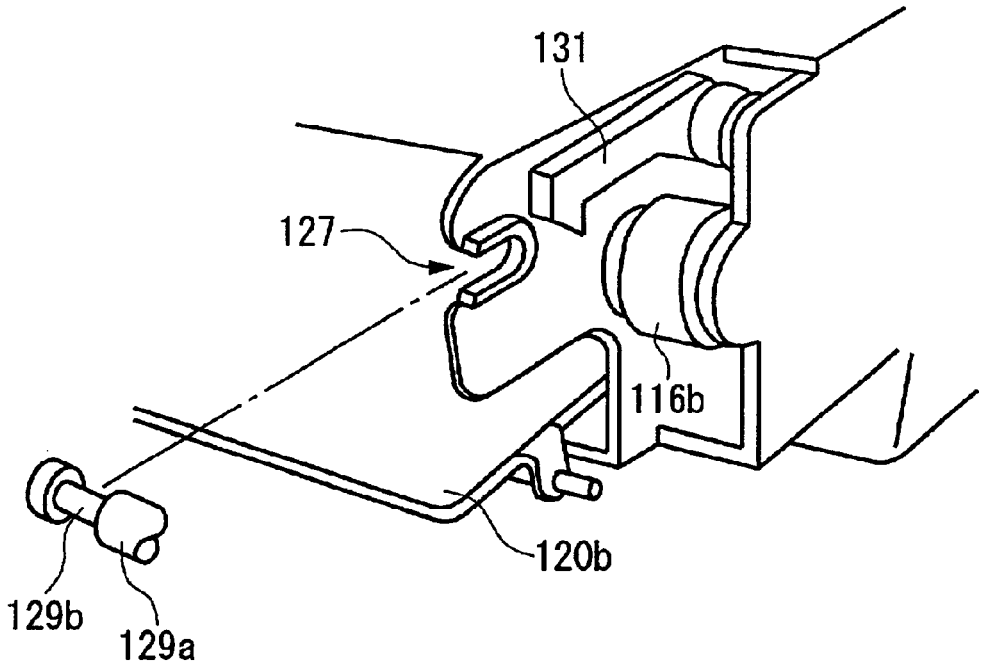
FIG. 25 shows an elevational rear view of a roll paper cassette.

Next, as shown in FIG. 24, when the cassette side projection unit 134 is further inside (left side of FIGS. 23 and 24) of the body side projection unit 135 and the roll paper cassette 101 is horizontally set after complete engagement of the cassette side projection unit 134 with the body side projection unit 135, the hooking unit 131 is completely engaged with the second position fixing pin 130 and the installation of the roll paper cassette 101 on the double-sided printing apparatus 200 is completed. In other words, the roll paper cassette 101 is installed on the double-sided printing apparatus 200 at a proper position and the installation can be maintained firmly.

Control method of the engagement of the second transporting roller gear 116*b* with the power transmitting gear 117 in the axle direction (the direction perpendicular to the surface of the paper of FIG. 24) is described with reference to FIG. 25. The first position fixing pin 129*a* engaged with the U-shaped ditch 127 includes lobes at both side of an engaging portion 129*b* on which the U-shaped ditch 127 is engaged. Since the radius of the lobe is larger than the radius of the U-shaped ditch 127, the lobes at both sides of the engaging protion 129*b* limit shifting of the U-shaped ditch 127 in the axle direction of the first position fixing pin 129*a* when the U-shape ditch 127 is engaged with the first position fixing pin 129*a*. Therefore, the movement of the roll paper cassette 101 in the direction perpendicular to the surface of the paper of FIG. 24 is fixed and the installation of the roll paper cassette 101 on the double-side printing apparatus 200 can be firmly maintained.

The installation position fixing unit 115B is included on the opposite side of the roll paper cassette 101 where the installation position fixing unit 115A is disposed (see FIG. 9: both of the installation position fixing units 115A and 115B have the same structure.), and a body side locking unit (not shown: it has the same structure with the body side locking unit 128A) is disposed on the double-sided printing apparatus 200 to be engaged with the installation position fixing unit 115B. Therefore, the installation of the roll paper cassette 101 on the double-side printing apparatus 200 can be further firmly maintained.

The installation position fixing unit 115A of the above described structure has the result described below as well as making the installation of the roll paper cassette 101 on the double-side printing apparatus 200 firmly maintained. As shown in FIG. 24, the installation position fixing unit 115A is engaged with the body side locking unit 128A disposed near from the power transmitting gear 117 and the second transporting roller gear 116*b* on the double-side printing apparatus 200 when the roll paper cassette 101 is installed on the double-side printing apparatus 200, and performs its function. When the power transmitting gear 117 and the second transporting roller gear 116*b* are engaged with each other and the rotating force is transmitted, the second transporting roller 116*b* receives from the power transmitting gear 117 a force for separating the second transporting roller 116*b* from the power transmitting gear 117, so that the roll paper cassette 101 may be dismantled from the double-sided printing apparatus 200. However, since the installation position fixing unit 115A is disposed near from the power transmitting gear 117 and the second transporting roller gear 116*b*, it is possible to firmly maintain the engagement of the power transmitting gear 117 and the second transporting roller gear 116*b* against the force for separating the second transporting roller 116*b*.

The dismantling of the roll paper cassette 101 from the double-sided printing apparatus 200 is performed in reverse sequence of the installation sequence just described. In other words, from the state shown in FIG. 24, the roll paper cassette 101 is lifted and drawn toward the front side (right side of FIG. 24) of the double-sided printing apparatus 200, and then the roll paper cassette 101 can be dismantled from the double-sided printing apparatus 200. In detail, when the roll paper cassette 101 is lifted, the hook rotating unit 133 presses down the rotating force acting unit 131*c* of the hooking unit 131, and then the engagement of the hooking unit 131 with the second position fixing pin 130 is released and the roll paper cassette 101 is in a state where it can be dismantled. Here, since the user can not see these relations of the hooking unit 131, the second position fixing pin 130 and the hook rotating unit 133, it is possible for the user cannot understand that the roll paper cassette 101 is now in a state where it can be dismantled simply by lifting the roll paper cassette 101. However, since the roll paper cassette 101 and the double-sided printing apparatus 200 respectively have the cassette side projection unit 134 and the body side projection unit 135 disposed at places where the user can see the relation between them, it is possible for a user to understand that the roll paper cassette 101 needs to be lifted in order to dismantle the roll paper cassette 101 through understanding the relation between the cassette side projection unit 134 and the body side projection unit 135, and to easily perform the dismantling job.

2.5. Connector Installation Device and a Connection Method

Figure 26:
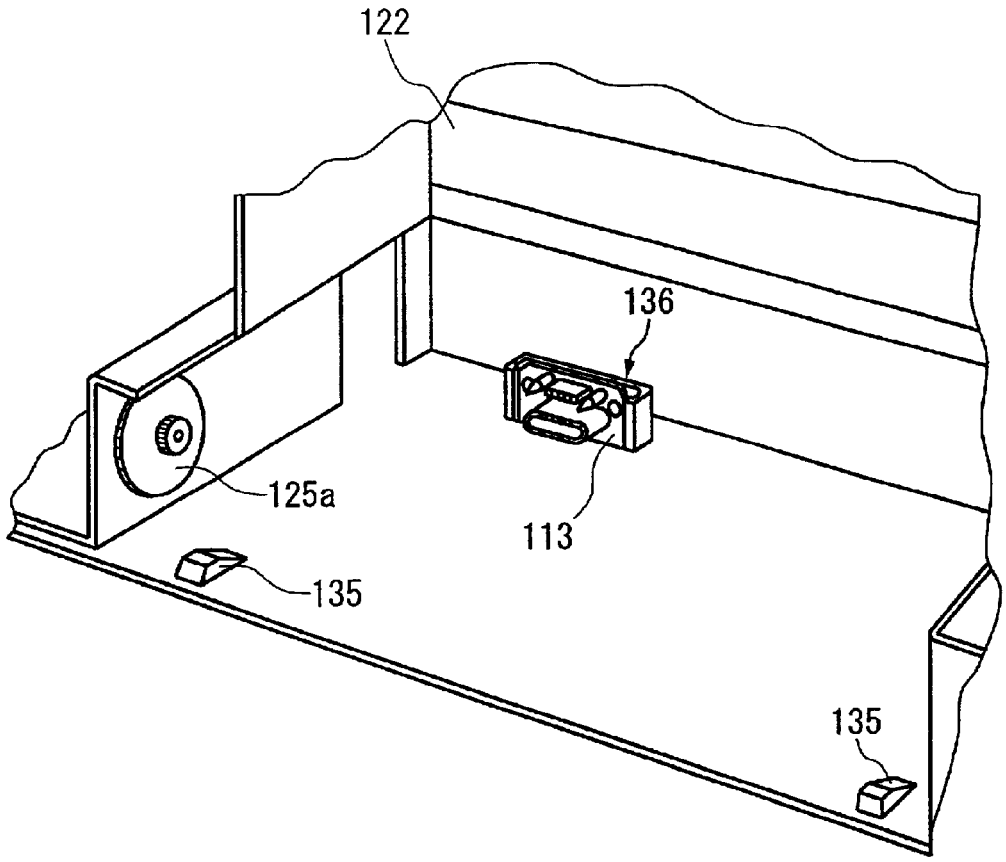
FIG. 26 shows an elevational view of a connecting device.
Figure 27A:
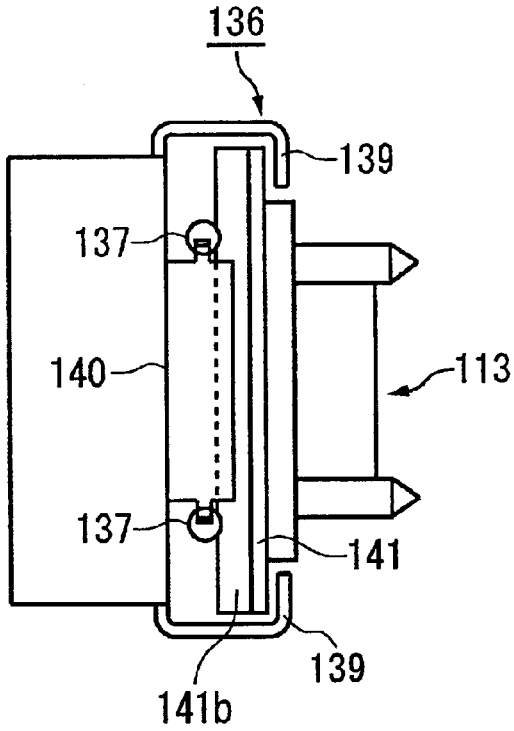
FIG. 27A shows a plane view of the connecting device.
Figure 27B:
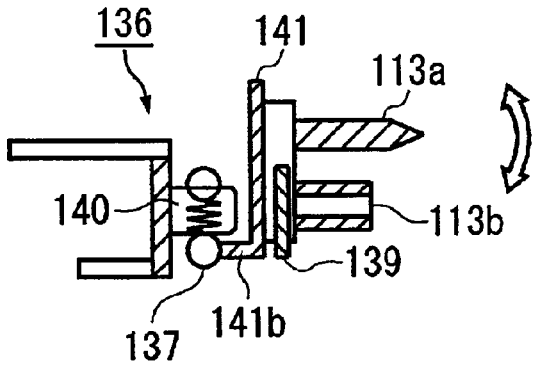
FIG. 27B shows across-sectional side view of the connecting device.

Next, referring to FIGS. 26 to 28, details of the installation device of the main connector 113 and a method for connecting the main connector 113 with the sub-connector 114. Here, FIG. 26 shows an elevational view of the main connector 113, FIG. 27A shows a plane view of the connector installation device 136 on which the main connector 113 is installed, and FIG. 27B shows a cross-sectional side view of the connector installation device 136. FIGS. 28A to 28E show cross-sectional side views of a method for connecting the main connector 113 and the sub-connector 114.

First, as shown in FIG. 26, the main connector 113 is installed on the connector installation device 136, and then the connector installation device 136 is installed on the front center portion (where the roll paper cassette 101 is faced) of the double-sided printing apparatus with its connecting opening toward the roll paper cassette 101. The main connector 113 is installed on a place where the sub-connector 114, installed at a lower portion of the roll paper cassette 101 (see FIG. 11), can be connected with it when the roll paper cassette 101 is installed on the double-sided printing apparatus 200. Here, the sub-connector 114 is firmly fixed on the roll paper cassette 101, but the main connector 113 is installed by the connector installation device 136 to be movable in a predetermined range against the sub-connector 114.

Next, referring to FIG. 27, the structure of the connector installation device 136 is described in detail. As shown in FIG. 27, the main connector 113 is installed on a connector installation panel 141. As shown in FIG. 27B, the connector installation panel 141 has an L-shaped cross-section with the lower end elongated toward back (left side of FIG. 27) of the apparatus 200. A first a second guiding units 140 and 139 are respectively disposed on both sides of the connector installation panel 141, and predetermined sized clearances are formed between the connector installation panel 141 and the first guiding unit 140 and between the connector installation panel 141 and the first guiding unit 140. A stopper unit 141*b* of the connector installation panel 141 is disposed to be able to contact with a lower portion of the first guiding unit 140. According to the above-described structure, the vertical movement of the connector installation panel 141 (or the main connector 113) is limited.

A coil spring 137 is disposed between the first guiding unit 140 and the stopper unit 141*b*, so that the stopper 141 (or the main connector 113) always receives an upward force.

Therefore, the connector installation panel 141 is movable in a range between the first guiding unit 140 and the second guiding unit 139, so that the main connector 113 is also movable in that range. The above is the structure of the connector installation device 136.

Next, referring to FIG. 28, result of the connector installation device 136 is described in detail. As shown in FIG. 28, reference number 114 designates the sub-connector installed on the roll paper cassette 101. The main connector 113 includes a male type connector 113*a* and a female type connector 113*b*, and the sub-connector 114 also includes a male type connector 114*a* and a female type connector 114*b*, where the male type connector 113*a* is connected to the female type connector 114*b* and the female type connector 113*b* is connected to the male type connector 114*a*.

Figure 28A:
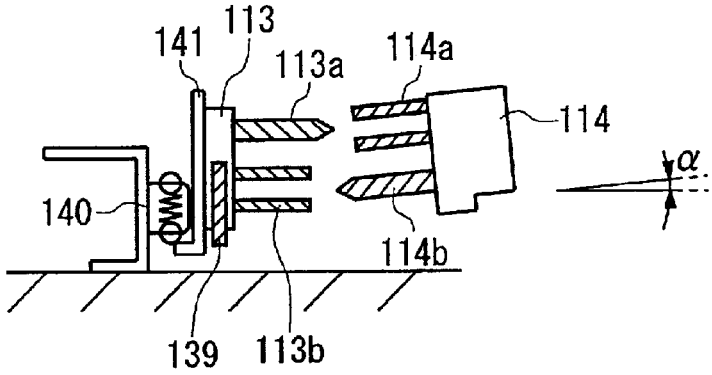
FIGS. 28A to 28E show cross-sectional side views of the connector installation device during operation.

First, as shown in FIG. 28A, the main connector 113 is maintained in nearly horizontal position before connected to the sub-connector 114. On the other hand, the sub-connector 114 fixed on the roll paper cassette 101 (where the roll paper R is set) approaches the main connector 114 at an angle $\alpha$ (alpha).

Figure 28B:
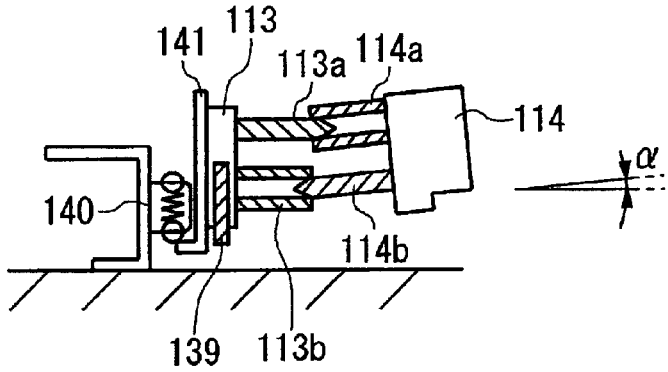
Figure 28C:
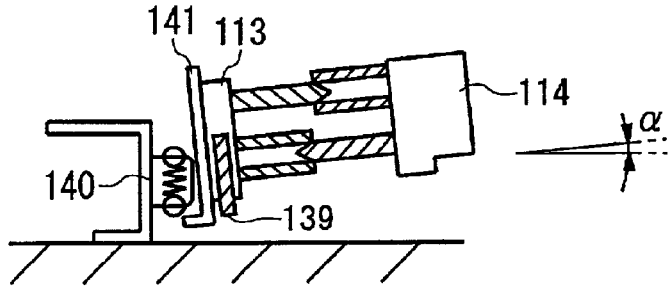

Next, as shown in FIG. 28B, head of the sub-connector 114 begins to be inserted into the main connector 113, and after a little while, the head of the sub-connector 114 is being inserted into the main connector 113, which is shown in FIG. 28C. Here, since the sub-connector 114 proceeds at the angle $\alpha$ and the main connector 113 can be movable in the direction of an arrow as shown in FIG. 27B, the main connector 113 is now in a position corresponding to the approaching angle $\alpha$ of the sub-connector 114.

Figure 28D:
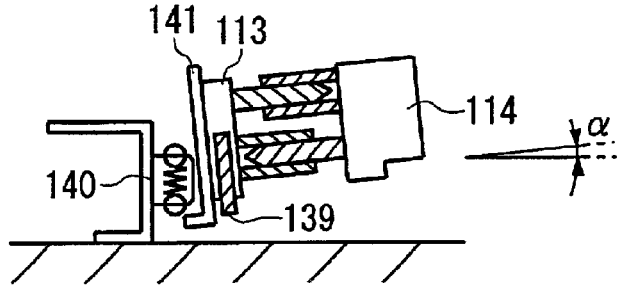

Next, as shown in FIG. 28D, the sub-connector 114 is completely inserted into the main connector 113 (where the roll paper R is set in the roll paper cassette 101), and then the roll paper cassette 101 is in horizontal position (as shown in FIG. 24). Then, as shown in FIG. 28E, the sub-connector 114 makes the main connector 113 be in horizontal position and provides a downward force to the main connector 113 against the upward force of the coil spring 137.

Figure 28E:
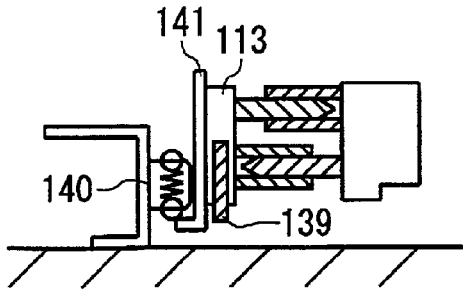

As described above, the main connector 113 is installed to be able to freely adjust its own position corresponding to the "connector angle in reception" as shown in FIG. 28C and the "connector angle in connection" as shown in FIG. 28E in accordance with the engagement state with the sub-connector 114. Therefore, it is possible for the main connector 113 to be responsive to the approaching angle of the sub-connector 114 and to make easy and smooth connection with the sub-connector 114 even though the approaching angle of the sub-connector 114 (or the roll paper cassette 101) to the double-sided printing apparatus 200 changes variously as shown in FIGS. 21 to 24 when the roll paper cassette 101 as a sub-apparatus is installed on the double-sided printing apparatus 200 as a main apparatus.

According to the present embodiment, the main connector 113 is in a nearly horizontal position when it is not connected with the sub-connector 114, but it is also possible to make the main connector 113 already be in a position of the approaching angle a of the sub-connector 114 for smoother connection or separation of the main connector 113 and the sub-connector 114. Further, according to the present embodiment, the connector installation device 136 is used for the connection of the double-sided printing apparatus 200 and the roll paper cassette 101, but of course it may be also used for different connections of main apparatuses and a sub-apparatuses which can be connected to the main apparatuses.

2.6. Structure, Function and Result of the Roll Paper Tail Detector

Figure 29:
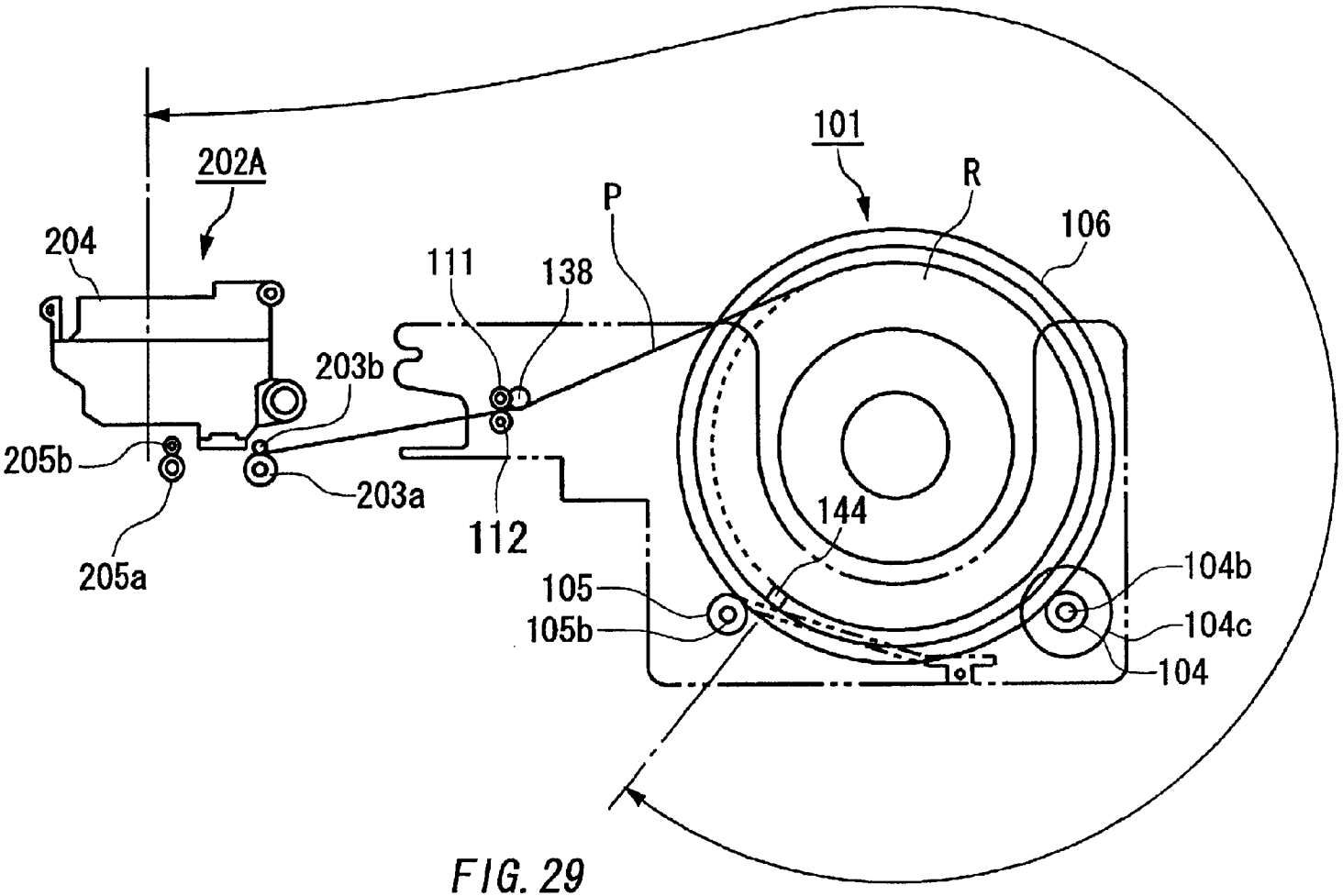
FIG. 29 shows a side view of transportation path of an embodiment of the double-sided printing apparatus of the present invention.

Next, referring to FIGS. 7, 9 and 29, the roll paper tail detector 107 is described in detail. Here, FIG. 29 shows a side view of transportation path of the roll paper P from the roll paper cassette 101 to the first printer 202A. As shown in FIGS. 7 and 9, the roll paper tail detector (hereinafter, "tail detector") 107 is installed at a lower portion of the roll paper cassette 101. The tail detector 107 includes a rotating unit 142 having a rotating axle 142*a* parallel to the axle of the roll paper R, and a reflection sensor 144 as a "tail mark reading sensor" disposed on a portion of the rotating unit 142 apart from the rotating axle 142*a*.

The rotating unit 142 is supported by a pressing unit (not shown) to be closely contacted to the roll paper R. Therefore, even when the radius of the roll paper R is decreased as the remaining amount of the roll paper is decreased, guide rollers 143 disposed apart from the rotating axle 142*a* can remained contacted with the circumference of the roll paper R and dependently rotate as the roll paper R rotates.

The roll paper R has a tail mark (for example, of a specific color) attached at a predetermined place from the tail end of the roll paper R. The reflection sensor 144 detects difference in reflectivity of colors between the roll paper P (i.e. white), on which the tail mark is not attached, and the tail mark. When the reflection sensor 144 detects the difference in reflectivity, the tail detector 107 informs a control unit (not shown) that the reflection sensor 144 approaches the tail end of the roll paper R.

Next, referring to FIG. 29, reference character 1 designates the length of the path or the length of the roll paper P from the position of reflection sensor 144, where it detects the tail mark of the roll paper R, to the position of the head end of the roll paper, where the printing job of the first printer 202A begins.

Here, the longest length of the roll paper P required for one printing job of the double-sided printing apparatus 200 is defined to be m. Then, the disposition of the reflection sensor 144 and the first printer 202A may be so determined that the relationship between the path length l and the length of the roll paper P required for one printing job m is l>m.

Therefore, in case the reflection sensor 144 does not detect the tail mark, it is decided that remaining amount of the roll paper R is at least enough for one new printing job, so that it is possible to perform a new printing job under this condition without making a void printing job. Therefore, if the tail mark is detected, it is possible to decide that remaining amount of the roll paper R is not enough for a new printing job. In this case, a printing job is not started and the paper transportation driving roller 203*a*, the paper transporting roller 111 and the drum rotating roller 104 are rotated in reverse direction for winding the roll paper P.

As described above, according to the present invention, even though the roll paper R, of which the remaining amount is hard to be detected, is used, it is possible to determine whether at least the last one new printing job can be started or not and to prevent a void printing job from being performed.

Further, even in case the length of the roll paper P required for one printing job m is long and the path length l can not be prepared, first a predetermined amount of the roll paper P is drawn out toward the first printer 202A so that the length of the roll paper P from the head end to the portion corresponding to the reflection sensor 144 becomes longer than m. Under this condition, if the tail mark is not detected by the reflection detector, the roll paper R is rotated in reverse direction to wind the roll paper P until the head end is located the original place where a printing job is started. Then, it is possible to safely perform a valid printing job.

3. Structure, Function and Result of the Cutting Device:

3.1. Outline of the Cutting Device

Figure 30:
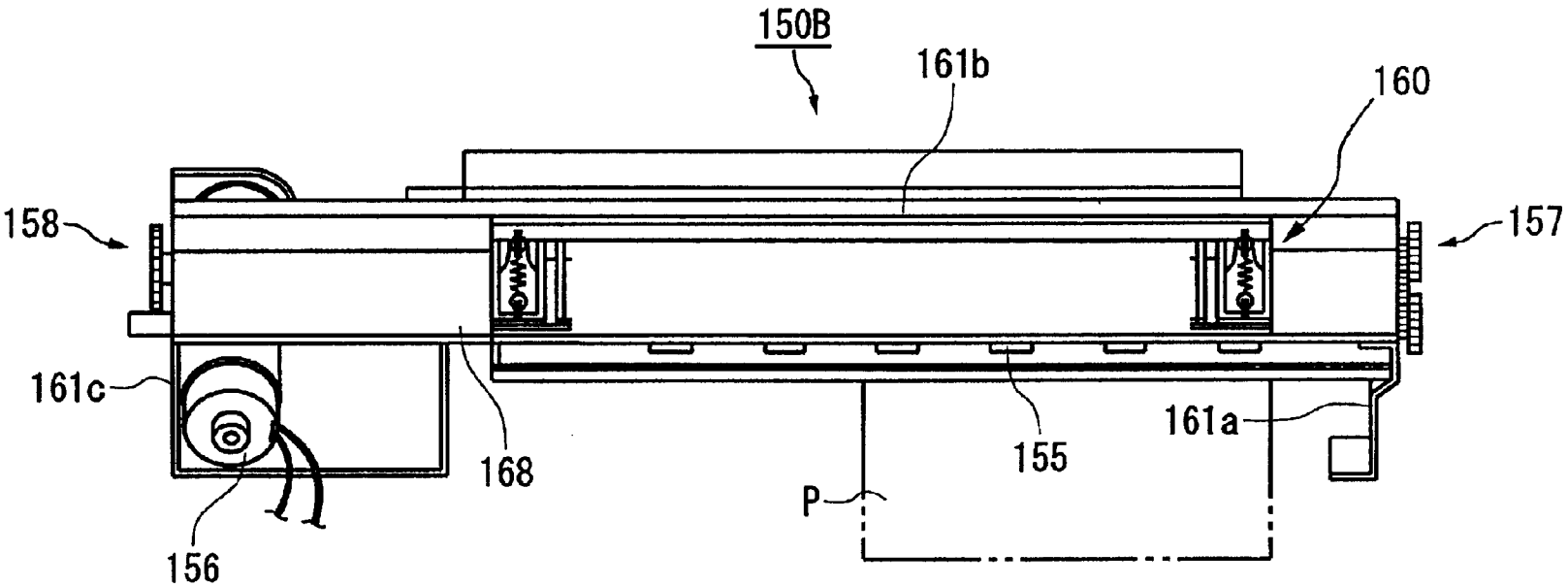
FIG. 30 shows an elevational view of a cutting device.
Figure 31:
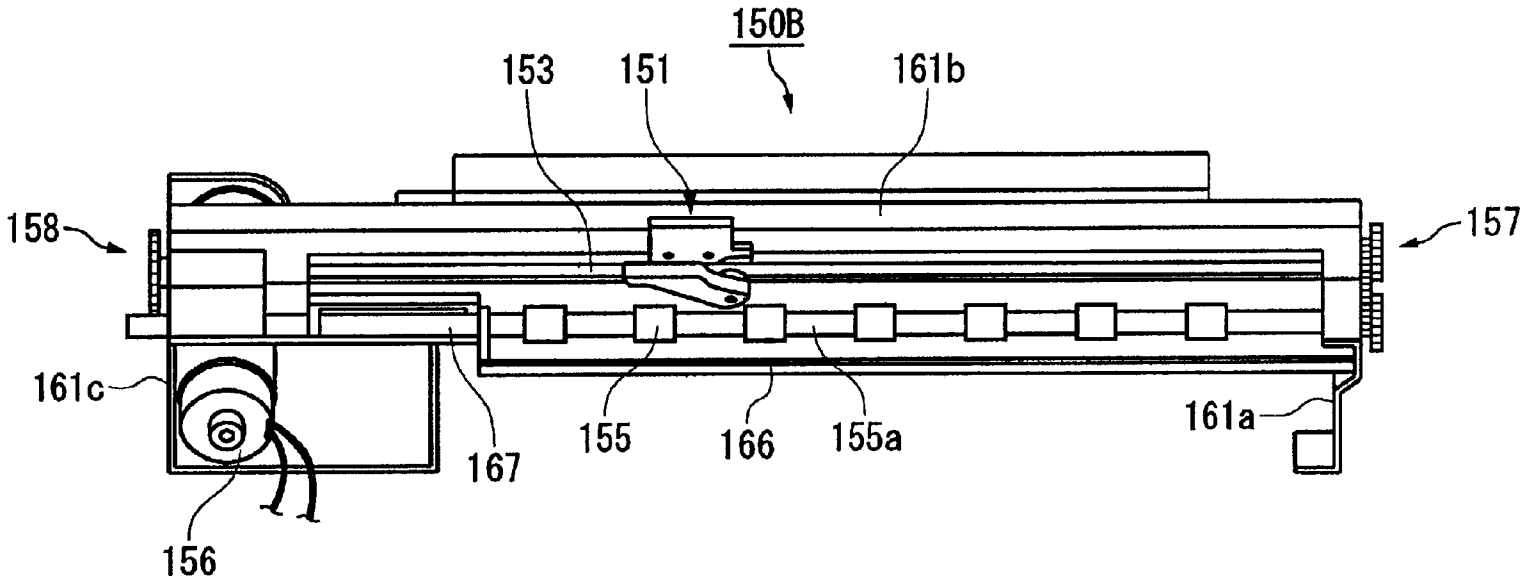
FIG. 31 shows an elevational view of the cutting device while a paper discharging frame is taken off.
Figure 32:
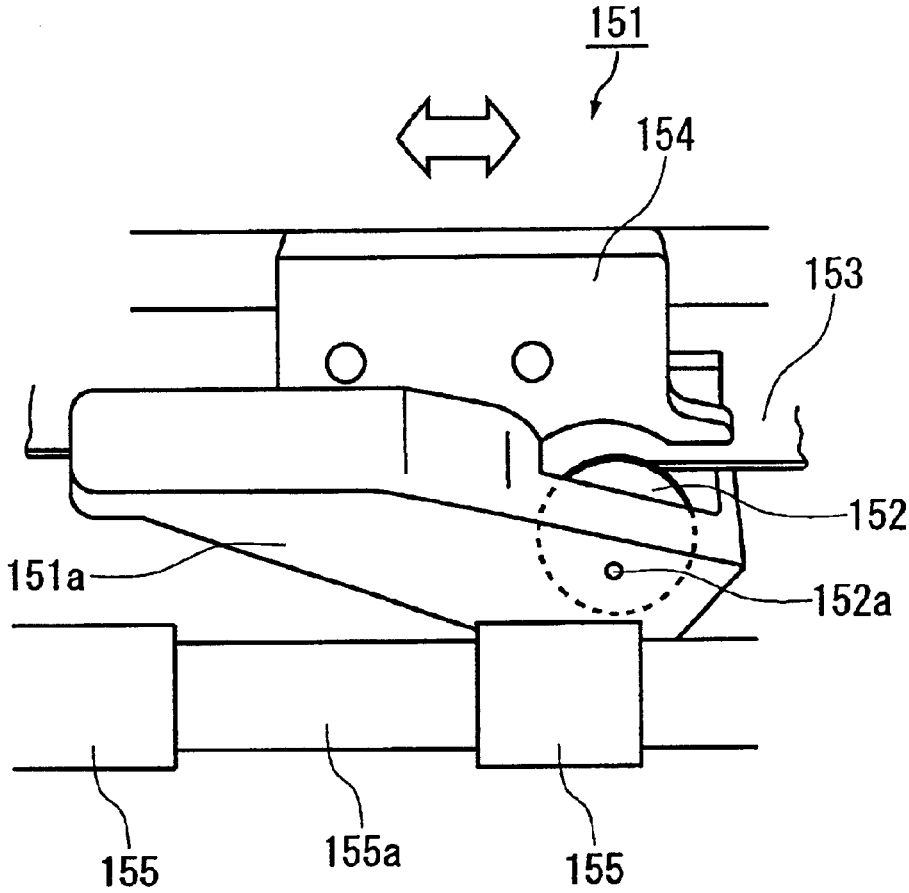
FIG. 32 shows an elevational view of a cutting blade of the cutting device.

Next, referring to FIG. 30 to 33, outline of the cutting device 150B is described. FIG. 30 shows an elevational view of the cutting device 150B, and FIG. 31 shows an elevational view of the cutting device 150B while a paper discharging frame is taken off. FIG. 32 shows an elevational view of a cutter blade unit 151 of the cutting device 150B, and FIGS. 33A and 33B show views of both sides of the cutting device 150B.

According to FIGS. 30 and 31, the cutting device 150B has frame units including side frames 161*a* and 161*c*, a main frame 161*b* elongated in the direction of width of the roll paper P and disposed between the side frames 161*a* and 161*c* and a paper discharging frame 168 elongated in the direction of width of the roll paper P. The roll paper P cut by the cutting device 150B proceeds and then released from the back of the cutting device 150B to the front of it. As shown in FIGS. 5 and 6, the second printer 202B is disposed at the backside (the upstream side) of the cutting device 150B, and the cutting device 150B cuts the roll paper P on which a printing job is performed by the second printer 202B.

The cutter blade unit 151 is disposed at the backside of the paper discharging frame 168. The cutter blade unit 151 is fixed on a driving belt (not shown) installed on a driving pulley (not shown) and a slave pulley (now shown), respectively disposed on both sides of the main frame 161*b*. The cutter blade unit 151 moves back and forth in the direction of the width of the roll paper P (left and right direction of FIGS. 30 and 31) according to the rotation of the driving pulley driven by the driving motor 156 disposed on the side frame 161*c*.

FIG. 32 shows an enlarged elevational view of the cutter blade unit 151. The cutter blade unit 151 includes a rotary cutter blade 152 and a cutter blade holder 154 on which the rotary cutter blade 152 is disposed. The rotary cutter blade 152 has its disc surface on a plane perpendicular to the roll paper P's flowing direction. As shown in FIG. 31, the rotary cutter blade 152 is disposed to slightly protrude from and to contact with a cutting plate 153 which is horizontally disposed and elongated in the direction of width of the roll paper P. Further, the rotary cutter blade 152 is rotatably supported by the cutter blade holder 154 with a rotating axle 152*a* on its center. The rotary cutter blade 152 is rotated by frictional force from the cutting plate 153, and the roll paper P is cut by the rotary cutter blade 152 at a place between the cutting plate 153 and the rotary cutter blade 152.

Figure 33A:
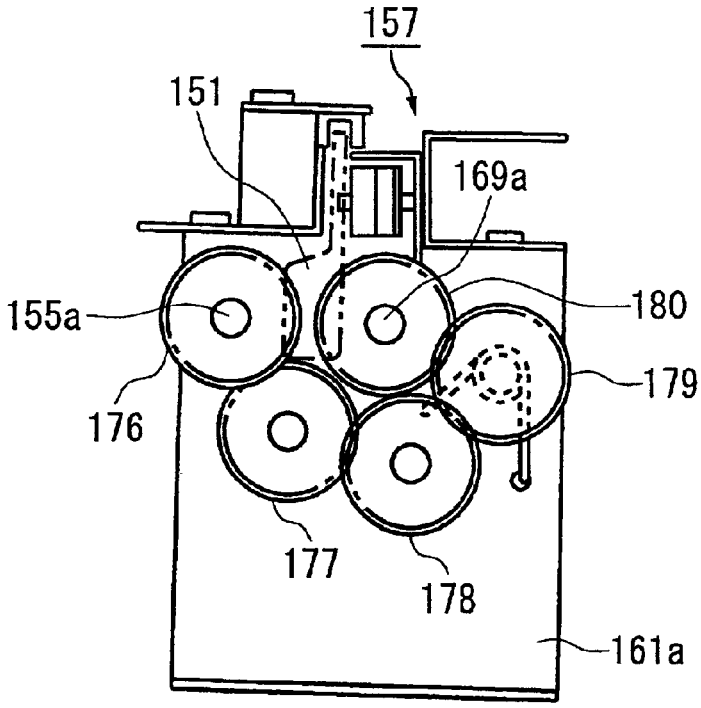
FIGS. 33A and 33B show views of both sides of the cutting device.
Figure 33B:
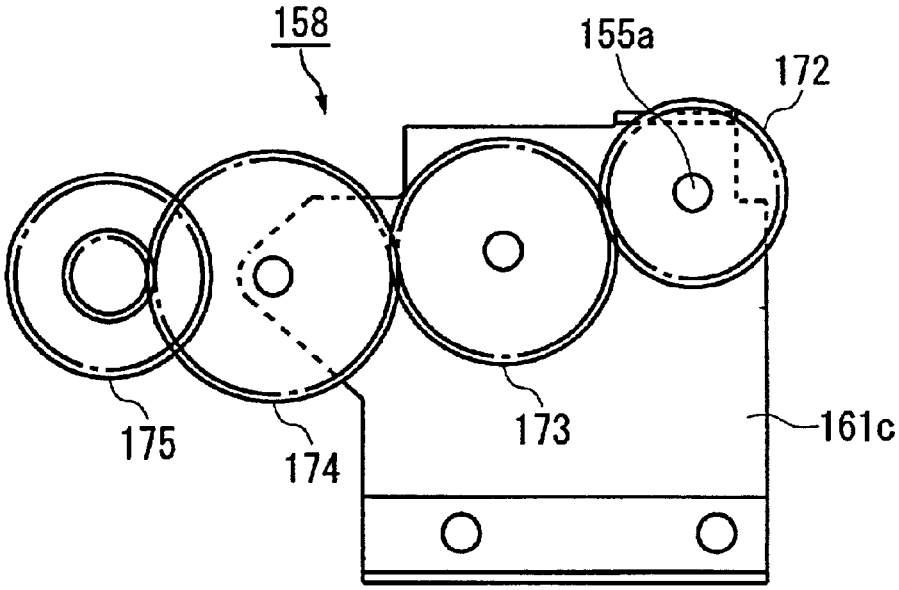

Next, referring back to FIGS. 30 and 31, a paper discharge driving roller axle 155*a* is disposed on the side frames 161*a* and 161*c* under the paper discharging frame 168. On the paper discharge driving roller axle 155*a*, a plurality of paper discharge driving roller 155 are disposed at predetermined intervals in the direction of the axle 155*a*. The driving motor (not shown) installed on the double-sided printing apparatus 200 provides rotation driving forces to the paper discharge driving roller axle 155*a* through a series of gears 158 disposed on the side frame 161*c* to rotate the paper discharge driving roller 155. FIG. 33B shows the series of gears 158. As shown in FIG. 33B, the series of gears 158 includes a gear 174 disposed at most upstream position (left side of FIG. 33), a gear 172 installed on one end of the paper discharge driving roller axle 155*a* and a coupling gear 173 for coupling the gears 174 and 172. The gear 174 is engaged with a power transmitting gear 175 installed on the double-sided printing apparatus 200, so that the paper discharge driving roller axle 155*a* can be rotated.

Next, referring back to FIG. 30, a plurality of paper discharge slave roller installation device 160 are disposed on the paper discharging frame 168 at predetermined intervals in the direction of the width of the roll paper P. The paper discharge slave roller 163 (not shown) is installed by the paper discharge slave roller installation device 160, where the paper discharge slave roller 163 dependently rotates by contacting with the paper discharge driving roller 155. Therefore, the roll paper P cut by the rotary cutter blade 152 is nipped by the paper discharge driving roller 155 and the paper discharge slave roller 163 and released by the paper discharge driving roller 155 along the releasing direction (front side of the paper of FIG. 30). Details of the paper discharge slave roller installation device 160 are described later.

The above is the structure of the cutting device 150B.

3.2. Structure, Function and Result of the Paper Discharge Slave Roller Installation Device Next, referring to FIGS. 34 and 35, structure, function and result of the paper discharge slave roller installation device are described. Here, FIG. 34 shows an elevational view of the paper discharge slave roller installation device 160, and FIGS. 35A and 35B shows cross-sectional side views of the paper discharging slave roller installation device 160.

Figure 34:
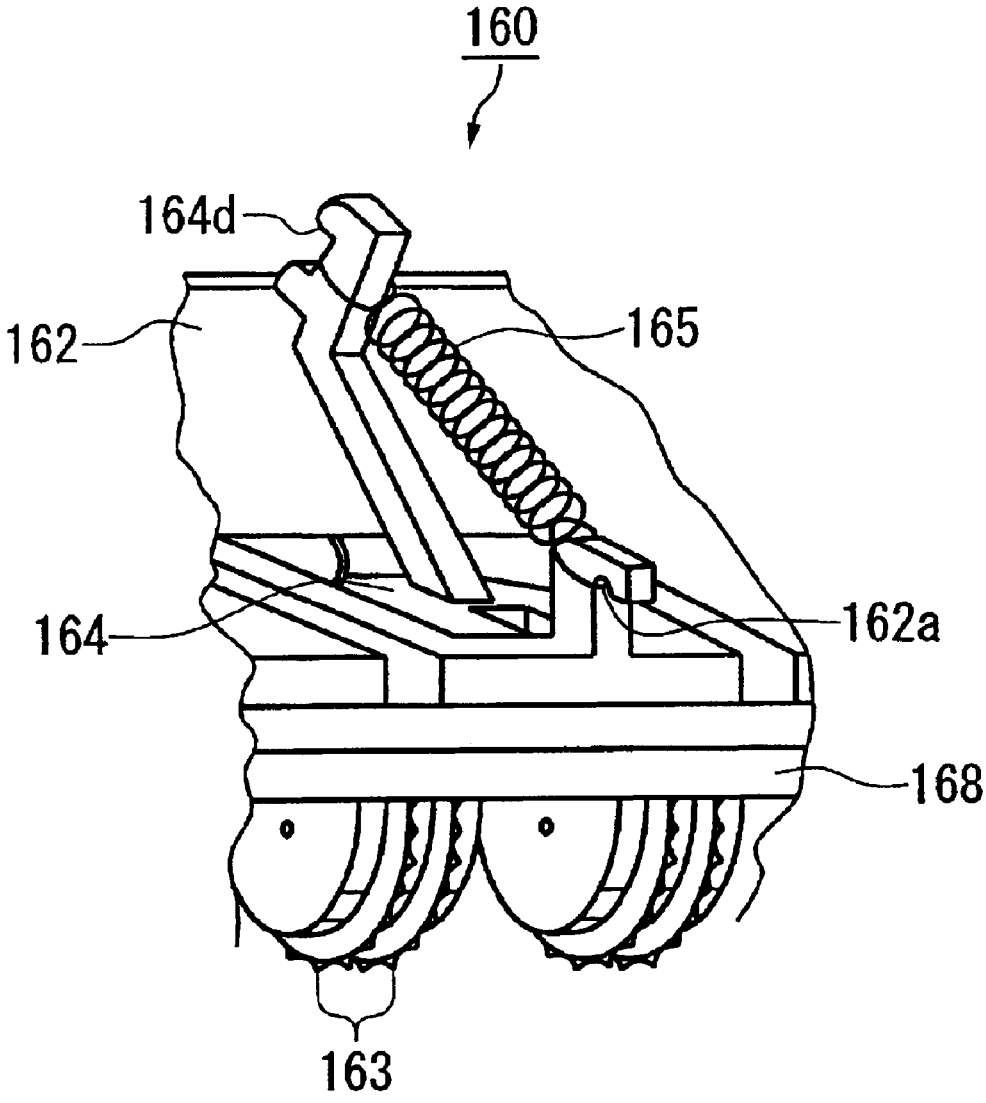
FIG. 34 shows an elevational view of a paper discharging slave roller installation device.
Figure 35A:
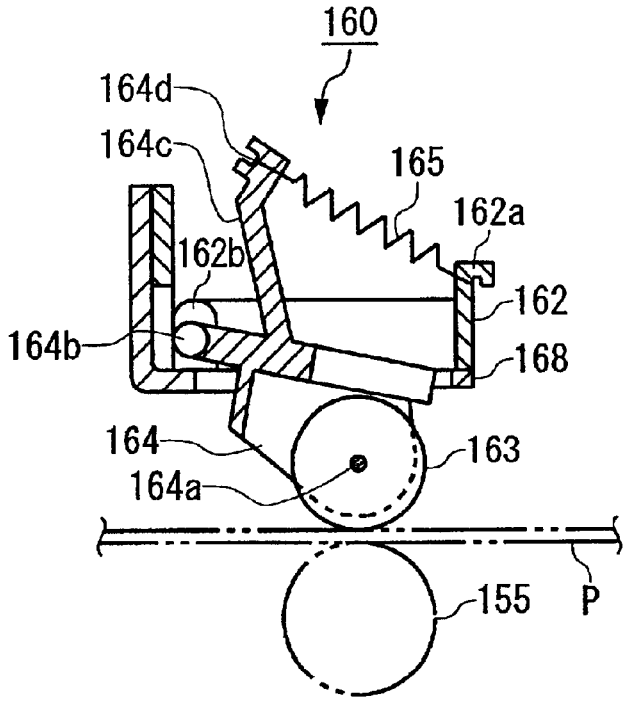
FIG. 35 shows a cross-sectional side view of a paper discharging slave roller installation device.
Figure 35B:
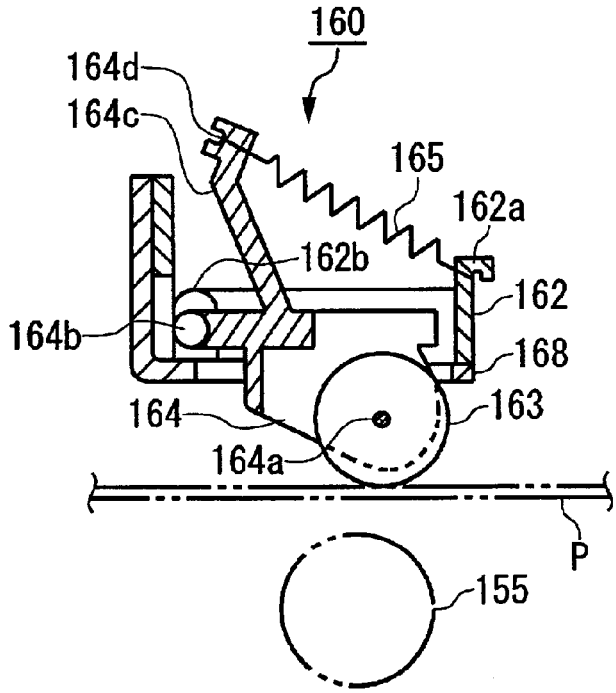

As shown in FIG. 34, the paper discharge slave roller installation device 160 includes a frame unit 162 disposed on the paper discharging frame 168, a rotating unit 164, which supports the paper discharge slave roller 163, rotatably installed on the frame unit 162 and a coil spring 165 disposed between the frame unit 162 and the rotating unit 164.

The frame unit 162 is formed to enclose the rotating unit 164. As shown in FIG. 35, the frame unit 162 includes an axle receiving unit 162*b* for receiving a rotating axle 164*b* of the rotating unit 164 at a place near from the corner of the paper discharging frame 168 having an L-shape cross-section. At the downstream side (right side of FIG. 35), a spring engaging unit 162*a*, on which the coil spring 165 is engaged, is formed.

The rotating unit 164 supports the two (2) paper discharge slave rollers 163 (see FIG. 34) through an axle supporting unit 164*a* (see FIG. 35). The paper discharge slave roller 163 includes a star-wheel formed like a gear, and can be in a "point-contact" with the printed roll paper P in semi-dried condition, so that the ink on the roll paper P is not smeared. According to the present embodiment, the star-wheel is used for the printed roll paper P to be in point-contact with the paper discharge slave roller 163. But, if the printed face can be properly dried, it is also possible to use elastic roller which can be in an elastic contact with the roll paper P for better protection of the printed surface.

Here, as shown in FIG. 35, the rotating unit 164 can rotate in clockwise or counterclockwise direction on the rotating axle 164*b* disposed on an upstream side (left side of FIG. 35), so that the paper discharge slave roller 163 can either approach or withdraw from the paper discharge driving roller 155 shown by imaginary line. The rotating unit 164 further includes an arm unit 164*c* elongated toward upper upstream direction (upper-left side of FIG. 35). The arm unit 164*c* has an engaging unit 164*d* on which the coil spring 165 is engaged. Since the coil spring is disposed between the engaging unit 164*d* and the engaging unit 162*a* of the frame unit 162, the rotating unit 164 always receives a force in the clockwise direction in FIG. 35. Therefore, the paper discharge slave roller 163 always receives a force pressing it toward the paper discharge driving roller 155.

Now, referring to FIG. 35, result of the paper discharge slave roller installation device 160 of the above described structure is described. First, in the cutting device 150B, the rotary cutter blade 152 moves along the direction of the width of the roll paper P and cuts the roll paper P at the place between the cutting plate 153 and the rotary cutter blade 152. Here, the cut roll paper P may be lifted as shown in FIG. 35B, but the paper discharge slave roller 163, which receives a pressing force from the coil spring 165, presses the lifted portion of the roll paper P.

Figure 37:
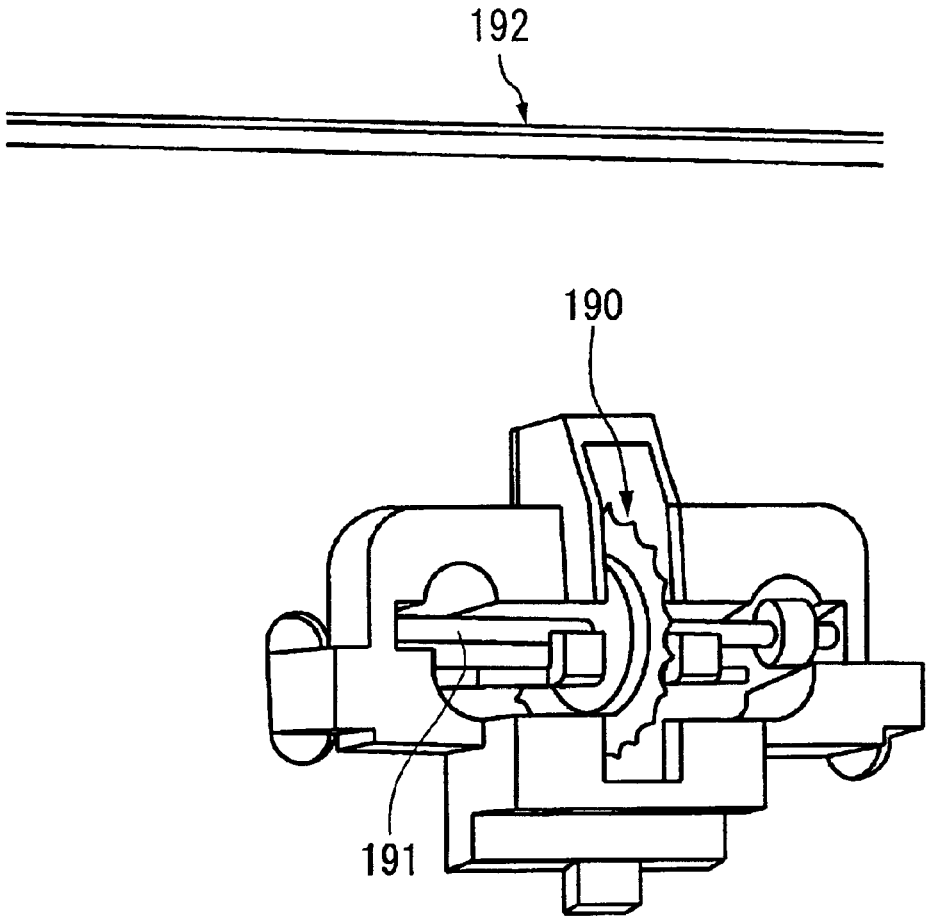
FIG. 37 shows an elevational view of a conventional paper discharging slave roller installation device.

Here, as the extent of the roll paper lifting changes according to the roll paper P's thickness or quality, the pressing force on the lifted roll paper P must be adjusted, and this adjustment of the pressing force can be achieved by adjusting the spring constant of the coil spring 165. In other words, since the function of the coil spring 165 disposed between the engagement units 164*d* and 162*a* is only to provide the pressing force to the rotating unit 164, it is relatively simple job to change the spring constant of the coil spring 165 compared to the conventional case where the axle unit of the paper discharge slave roller 190 is also used as the pressing unit, such as a bar spring 191, as shown in FIG. 37.

As shown in FIG. 30, since a plurality of the paper discharge slave roller installation devices 160 are installed along the direction of the width of the roll paper P and each of the paper discharge slave roller 163 of the paper discharge slave roller installation devices 160 can independently move up and down, it is possible to more properly press lifted portion(s) of the cut roll paper P according to the lifted extent than the conventional case where all of the plurality of paper discharge slave rollers 163 altogether approaches or withdraws from the paper discharge driving roller 155.

According to the present invention, the above described paper discharge slave roller installation device 160 is applied to the paper discharge slave roller 163 installed on the cutting device 150B, but it is also applicable to the paper discharge slave roller 205*b* of the first or second printer 202A or 202B, as shown in FIG. 6.

3.3. Structure, Function and Result of Roll Paper Nipping Means

Figure 36A:
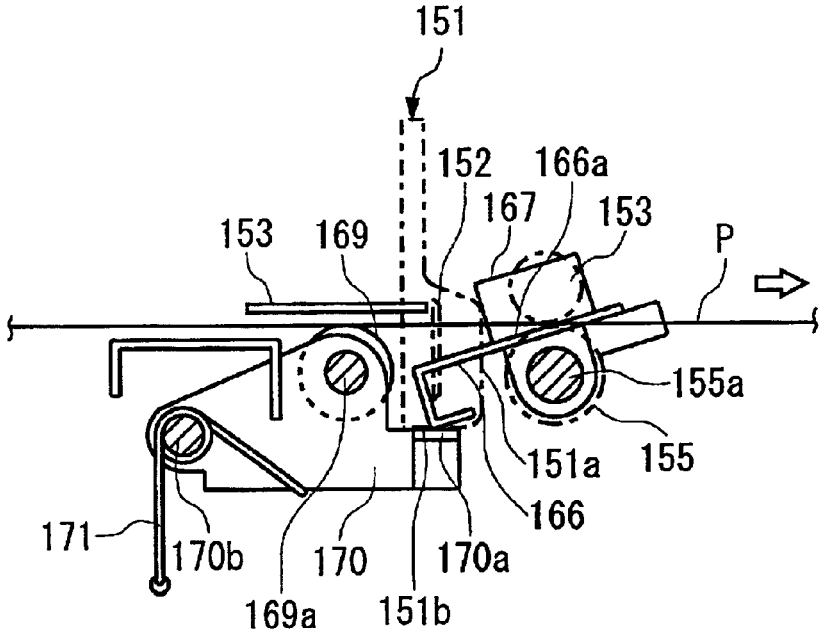
FIG. 36 shows across-sectional side view of a cutting device.
Figure 36B:
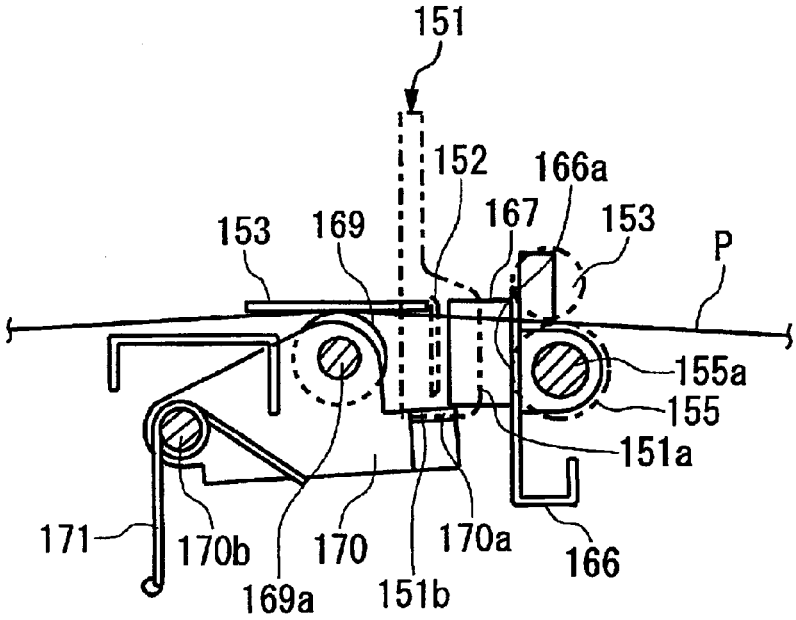

Next, referring to FIG. 36, a paper nipping means installed at an upstream side of the rotary cutter blade 152 for nipping and holding the roll paper P is described. Here, FIG. 36 shows a cross-sectional side view of the cutting device 150B, and FIG. 36A shows a cross-sectional side view of the cutting device 150 B in a state where the rotary cutter blade 152 (or cutter blade unit 151) is at a waiting position (left end of FIG. 8), and FIG. 36B shows a cross-sectional side view of the cutting device 150B in a state where the rotary cutter blade 152 (or cutter blade unit 151) is not at the waiting position (the state where the rotary cutter blade 152 is cutting the roll paper P).

As shown in FIG. 36, the paper discharge driving roller 155 and the paper discharge slave roller 153 are disposed on the downstream side of the rotary cutter blade 152. The paper discharge driving roller 155 is installed on the paper discharge driving roller axle 155*a*, and a first cam-follower 167 is installed on one end of the paper discharge driving roller axle 155*a* (see FIG. 31). An intercepting plate 166 elongated in the direction of the width of the roll paper P is installed on the first cam-follower 167 (see FIG. 31). As shown in FIG. 36, the first cam-follower 167 can rotate in clockwise or counterclockwise direction on the paper discharge driving roller axle 155*a* and the intercepting plate 166 coupled to the first cam-follower 167 can also rotate in clockwise or counterclockwise direction on the paper discharge driving roller axle 155*a*. The first cam-follower 167 receives a pressing force in the counterclockwise direction (the direction where the intercepting surface 166*a* becomes in vertical position) by a screwed coil spring (not shown), as shown in FIG. 36.

When the cutter blade unit 151 is not in the waiting position (when the roll paper P is being cut), the first cam-follower 167 is released from the engagement with the cutter blade unit 151, so that the intercepting surface 166*a* is in vertical position by the force of the screwed coil spring (not shown), as shown in FIG. 36B. On the other hand, when the cutter blade unit 151 is in the waiting position, the first cam surface 151*a* (see FIG. 32) of the cutter blade unit 151 is engaged to be in the position shown in FIG. 36A, so that the intercepting surface 166*a* of the intercepting plate 166 forms an acute angle with the horizon.

Here, the roll paper P passes through a clearance between the cutting plate 153 and a nipping driving roller 169 described later when the cutting device 150B is in non-cutting operation state. Then the roll paper P is nipped by the paper discharge driving roller 155 and the paper discharge slave roller 153 and transported toward downstream side (the direction designated by an arrow in FIG. 36A). At this moment, in certain conventional circumstance, the head of the roll paper P, passed through the intercepting plate 153 and the nipping driving roller 169, goes under the paper discharge driving roller 155 and proceeds out of the regulated path. However, since the intercepting surface 166*a* of the intercepting plate 166 forms an acute angle with the horizon as shown in FIG. 36A, it is possible to prevent the head of the roll paper P from going under the paper discharge driving roller 155 and to make the roll paper P proceed on the normal path.

Next, a rotating unit 170 is installed on a rotating axle 170*b* under the intercepting plate 153 as shown in FIG. 36, and the rotating unit 170 can rotate in clockwise or counterclockwise direction on the rotating axle 170*b*. A screwed coil spring 171 always provides a force in the counterclockwise direction to the rotating unit 170. The rotating unit 170 supports a nipping driving roller axle 169*a* on a place apart from the rotating axle 170*b*, and the nipping driving roller 169 is installed on the nipping driving roller axle 169*a*. The nipping driving roller 169 can be closely contacted with the cutting plate 153 by the rotation of the rotating unit 170.

A second cam-follower 170*a* is formed on a portion of the rotating unit 170 located under the cutter blade unit 151. As the case of the first cam-follower 167, when the cutter blade unit 151 is not in the waiting position (when the roll paper P is being cut), the second cam-follower 170*a* is released from the engagement with the second cam surface 151*b* under the cutter blade unit 151, so that the nipping driving roller 169 is in contact with the cutting plate 153 by the force of the screwed coil spring 171, as shown in FIG. 36B. On the other hand, when the cutter blade unit 151 is in the waiting position, the second cam-follower 170*a* is engaged with the second cam surface 151*b*, as shown in FIG. 36A, so that a predetermined sized clearance, through which the roll paper P can pass, is made between the cutting plate 153 and the nipping driving roller 169.

Since the nipping driving roller axle 169*a* receives rotating forces, the nipping driving roller 169 is in a state where it can rotate. FIG. 33A shows a series of gears for making the nipping driving roller be able to rotate, where reference number 180 designates a gear disposed on one end of the nipping driving roller axle 169*a*. A gear mechanism 157 is installed on the side frame 161*a* of the cutting device 150B as shown in FIG. 30, and the gears 176 to 179 are engaged to be able to rotate on the side frame 161*a*. Since the gear 180 is always engaged with the gear 179, and the position of the nipping driving roller axle 169*a*, on which the gear 180 is installed, is changed by the rotation of the rotating unit 170, the gear 179 is a sun gear to the gear 180, which is a planet gear. The gear 176, which provides powers to the gear 180, is installed on the paper discharge driving roller axle 155*a*, therefore the nipping driving roller axle 169*a* is rotated by the rotation of the paper discharge driving roller axle 155*a*. The details of the gear mechanism 158 which rotates the paper discharge driving roller axle 155*a* are the same with those described with reference to the FIG. 33B.

Referring to FIG. 36, result of roll paper nipping means having the nipping driving roller 169 of the above described structure is described. When the roll paper P is cut at a predetermined place by using the cutting device 150B, if a short portion from the head of the roll paper P is cut, the roll paper P can be set in a stable position and cut clearly and precisely without slipping because there is enough length of roll paper P in the upstream side (left side of FIG. 36) of the rotary cutter blade 152. To the contrary, if a short portion from the tail of the roll paper P is cut, the roll paper P may not be set in a stable position nor cut clearly or precisely because there is not enough length of roll paper P in the upstream side (left side of FIG. 36) of the rotary cutter blade 152. However, the above described roll paper P nipping means, or the nipping driving roller 169, nips and holds the roll paper P between the cutting plate 153 and the nipping driving roller 169, so that it is possible to set the roll paper P in a stable position and to cut the roll paper P clearly and precisely even when a short portion from the tail of the roll paper P is cut. Of course, under other circumstances, it is natural that the roll paper P can be cut precisely and stably if the roll paper P is nipped.

For example, in case the tail portion of the roll paper is cut, even though the cut fragment is still nipped and hold between the nipping driving roller 169 and the cutting plate 153, it may be impossible to determine which side (upstream or downstream side of the nipping driving roller 169) the cut fragment proceeds to after it is released, and to gather the fragments in a desired place. However, according to the present invention, since the nipping driving roller 169 can rotate even when the cut fragment is nipped, it is possible to gather the cut fragments in a desired place. In other words, by rotating the nipping driving roller 169 in forward direction (clockwise in FIG. 36) while the cut fragment is nipped, it is possible to gather the fragments in a downstream place, alternately, by rotating the nipping driving roller 169 in reverse direction (counterclockwise in FIG. 36) while the cut fragment is nipped, it is possible to gather the fragments in an upstream place.

According to the present invention, it is possible to provide a transportation path where the continuous paper is horizontally transported, proceeds upwardly and again horizontally transported from the first printer to the second printer. Therefore, no wrinkle nor dust can happen during the transportation, it is impossible to break away from the transportation path, and no jamming or aberration can happen.

On the way of guiding path, if a portion of the continuous paper printed by the first printer is cut before the second printer starts to print on the paper, it is possible to make the continuous paper be a discrete paper before the second printer starts to print on the paper, so that it is not needed to synchronize the transportation speed of the first printer to that of the second printer.

Since the opening operation of the cover of the roll paper cassette includes the cleaning operation of the cutting dusts gathered in the dust stacker, it is possible to effectively prevent a user from forgetting to clean the cutting dusts.

Even though the total weight of the roll paper is increased by lengthening the roll paper, since the looseness generating device makes a "proper" looseness state of the roll paper between the roll paper cassette and the transportation roller, it is possible to precisely perform the transportation operation even when the required drawing out force is increased.

Further, according to the present invention, a roller pressing unit for pressing a transporting roller and a transporting slave roller provides a pressing force to the transporting roller or the transporting slave roller which is engaged with a portion of the printing apparatus when the transporting device is installed, and the roller pressing unit does not provide the pressing force when the transporting device is dismantled from the printing apparatus. In other words, before the installation of the transporting device, the transporting roller and the transporting slave roller is not closely contacted with each other, and only after the transporting device is installed, the transporting roller and the transporting slave roller is closely contacted with each other. Therefore, it is possible to easily insert the recording medium (continuous paper or roll paper) between the transporting roller and the transporting slave roller. As a result, the manipulation of the transporting device becomes easier.

What is claimed is:

1. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first printer is guided, wherein said guiding path comprises a U-shaped reversing path;

a cutting device disposed between said first printer and said second printer, wherein said cutting device cuts a portion of said recording medium printed by said first printer before said second printer begins printing on said recording medium; and a roll paper looseness generating device for detecting looseness of said recording medium, wherein said first discharging unit and said second transporting unit are disposed on the same side of said double-sided printing apparatus.

2. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium; and a roll paper cassette for setting said recording medium wound in a roll shape, wherein said roll paper cassette can be removably installed on said double-sided printing apparatus, wherein:

said recording medium is wound in a roll shape, and transporting and releasing of said recording medium are performed on one side of said double-sided printing apparatus by forming said transportation path in a U-shape, and said roll paper cassette comprises a cover having a dust stacker, in which cutting dust generated by a cutting device for cutting said discharged recording medium at a predetermined position falls into and gathers, and an opening operation of said cover of said roll paper cassette performs a cleaning operation of said cutting dust; and said cover further comprises a released paper stacker for stacking said recording medium which is cut by said cutting device to be of a predetermined size.

3. A double-sided printing apparatus as claimed in claim 2, wherein said cover comprises a rotating axle on a portion of said roll paper cassette at a side of dismantle direction of said roll paper cassette from said double-sided printing apparatus, and said opening operation of said cover is performed by rotating said cover to said dismantle direction of said rotating axle.

4. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium;

means for making said recording medium movable, wherein said means for making said recording medium movable can move said recording medium in a roll shape;

a transportation roller for transporting said recording medium in a roll shape to said first printer; and wherein said roll paper looseness generating device is disposed on an upstream side of said transportation roller in the direction of said roll paper transportation and comprises a roll paper rotating device for rotating said recording medium of a roll shape in a forward or reverse direction, and when said looseness detector detects improper looseness of said roll paper, said roll paper rotating device rotates said recording medium in said forward direction, and when said looseness detector detects proper looseness of said roll paper, said roll paper rotating device rotates said recording medium in said reverse direction wherein said roll paper rotating device comprises a rotating drum comprising a drum axle, which penetrates center hollow of said recording medium in a roll shape and provides a rotational force to said center hollow, and lobes, of which radius is larger than that of said recording medium in a roll shape, disposed on both ends of said drum axle, and a drum rotating roller for providing a rotating force to said lobes and supporting said rotating drum.

5. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium; and a transporting device, which can be removably installed on said double-sided printing apparatus, for transporting said recording medium, wherein said first transporting unit comprises a paper transporting roller for transporting said recording medium, a paper transporting slave roller dependently rotating for nipping said recording medium between said paper transporting roller and itself, and a roller pressing unit for embodying transportation of said recording medium by pressing said paper transporting roller or paper transporting slave roller in a closely contacting direction, and said roller pressing unit provides a pressing force to said transporting roller or said transporting slave roller which is engaged with a portion of said double-sided printing apparatus when said transporting device is installed on said double-sided printing apparatus, and said roller pressing unit does not provide said pressing force when said transporting device is dismantled from said double-sided printing apparatus.

6. A double-sided printing apparatus as claimed in any one of claims 5 to 9, wherein said paper transporting slave roller is installed on a rotating unit having an rotating axle parallel to a rotating axle of said paper transporting slave roller, and said roller pressing unit makes said paper transporting slave roller be in close contact with said paper transporting roller by pressing said rotating unit.

7. A double-sided printing apparatus as claimed in claim 6, further comprising:

a paper transporting roller gear, which can be engaged with and released from a power transmitting gear installed on said double-sided printing apparatus, for transmitting rotating force of said power transmitting gear to said paper transporting roller by engaging with said power transmitting gear; and an installation position fixing unit, disposed at a place near from said paper transporting roller gear, for fixing relative position of said paper transporting device to said double-sided printing apparatus by engaging with a locking unit disposed on a place near from said power transmitting gear on said double-sided printing apparatus when said paper transporting device is installed on said double-sided printing apparatus.

8. A double-sided printing apparatus as claimed in any one of claims 5 to 10 further comprising:

a paper transporting roller gear, which can be engaged with and released from a power transmitting gear installed on said double-sided printing apparatus, for transmitting rotating force of said power transmitting gear to said paper transporting roller by engaging with said power transmitting gear; and an installation position fixing unit, disposed at a place close to said paper transporting roller gear, for fixing a relative position of said paper transporting device to said double-sided printing apparatus by engaging with a locking unit disposed on a place close to said power transmitting gear on said double-sided printing apparatus when said paper transporting device is installed on said double-sided printing apparatus.

9. A double-sided printing apparatus, comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium; and a transporting device, which can be removably installed on said double-sided printing apparatus, for transporting said recording medium, wherein said first transporting unit comprises a paper transporting roller for transporting said recording medium, a paper transporting slave roller dependently rotating for nipping said recording medium between said paper transporting roller and itself, a roller pressing unit for embodying transportation of said recording medium by pressing said paper transporting roller or paper transporting slave roller in a closely contacting direction, and said roller pressing unit comprises a pressing force supporting unit for engaging with a portion of said double-sided printing apparatus when said paper transporting device is installed on said double-sided printing apparatus and being released from said portion of said double-sided printing apparatus when paper transporting device is dismantled from said double-sided printing apparatus, and a pressing force acting unit for acting said pressing force on said paper transporting roller or said paper transporting slave roller by using said pressing force supporting unit engaged with said portion of said double-sided printing apparatus as a supporting point of said pressing force.

10. A double-sided printing apparatus as claimed in claim 9, wherein said roller pressing unit is a screwed coil spring having an L-shape, wherein a first end of said screwed coil spring is said body side engaging unit and a second end of said screwed coil spring is said pressing force acting unit, and an opening side of said L-shaped screwed coil spring is in the direction of dismantle of said paper transporting device.

11. A double-sided printing apparatus as claimed in claim 10 further comprising a roll paper cassette, which can be removably installed on said double-sided printing apparatus, for setting said recording medium wound in a roll shape, wherein said roll paper cassette comprises said paper transporting device.

12. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium;

a transportation roller for transporting said recording medium in a roll shape to said first printer; and wherein said roll paper looseness generating device is disposed on an upstream side of said transportation roller in the direction of said roll paper transportation and comprises a roll paper rotating device for rotating said recording medium of a roll shape in a forward or reverse direction, and when said looseness detector detects improper looseness of said roll paper, said roll paper rotating device rotates said recording medium in said forward direction, and when said looseness detector detects proper looseness of said roll paper, said roll paper rotating device rotates said recording medium in said reverse direction, wherein said roll paper rotating device comprises a rotating drum comprising a drum axle, which penetrates center hollow of said recording medium in a roll shape and provides a rotational force to said center hollow, and lobes, of which radius is larger than that of said recording medium in a roll shape, disposed on both ends of said drum axle, and a drum rotating roller for providing a rotating force to said lobes and supporting said rotating drum, wherein said looseness detector comprises:

a rotating unit, which can rotate in clockwise or counterclockwise direction, comprising a contact terminal contacted with said recording medium at inside of said looseness generating device, a rotating center disposed apart from said contact terminal, and a sensor engaging unit disposed apart from said rotating center;

a sensor detector for detecting a rotating state of said rotating unit by engaging with said sensor engaging unit; and a pressing unit for pressing said rotating unit toward the direction of looseness detection, wherein when said looseness of said recording medium changes from "proper" state to "improper" state, said recording medium rotates said rotating unit against said pressing unit, thereby an engagement state of said sensor engaging unit and said sensor detector is changed.

13. A double-sided printing apparatus as claimed in claim 12, further comprising a means for making said recording medium movable, wherein said means for making said recording medium movable can move said recording medium in a roll shape.

14. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first printer is guided, wherein said guiding path comprises a U-shaped reversing path;

a cutting device disposed between said first printer and said second printer, wherein said cutting device cuts a portion of said recording medium printed by said first printer before said second printer begins printing on said recording medium; and a roll paper looseness generating device which detects looseness of said recording medium and rotates said recording medium to adjust said looseness, wherein said first discharging unit and said second transporting unit are disposed on the same side of said double-sided printing apparatus.

15. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium; and a roll paper cassette for setting said recording medium wound in a roll shape, wherein said roll paper cassette can be removably installed on said double-sided printing apparatus, wherein:

said recording medium is wound in a roll shape, and transporting and releasing of said recording medium are performed on one side of said double-sided printing apparatus by forming said transportation path in a U-shape, and said roll paper cassette comprises a cover having a dust stacker, in which cutting dust generated by a cutting device for cutting said discharged recording medium at a predetermined position falls into and gathers, and an opening operation of said cover of said roll paper cassette performs a cleaning operation of said cutting dust; and wherein said cover comprises a rotating axle on a portion of said roll paper cassette at a side of dismantle direction of said roll paper cassette from said double-sided printing apparatus, and said opening operation of said cover is performed by rotating said cover to said dismantle direction of said rotating axle.

16. A double-sided printing apparatus comprising:

a first printer comprising a first transporting unit; a first recording unit disposed upstream of a guiding path, said recording medium being horizontally transported from said first transporting unit; and a first discharging unit for discharging said recording medium after printing;

a second printer comprising a second transporting unit; a second recording unit disposed upstream of said guiding path, said recording medium being horizontally transported from said second transporting unit, wherein said second recording unit is disposed on the same side where said first recording unit is disposed; and a second discharging unit for discharging said recording medium;

said guiding path is disposed from said first discharging unit to said second discharging unit through which said recording medium printed by said first recording unit is guided, wherein a surface of said recording medium is maintained relatively flat while said recording medium is guided by said guiding path;

a cutting device disposed between said first printer and said second printer, wherein said cutting device cuts a portion of said recording medium printed by said first printer before said second printer begins printing on said recording medium, wherein said recording medium is continuous paper;

a roll paper looseness generating device for detecting looseness of said recording medium;

a transportation roller for transporting said recording medium in a roll shape to said first printer; and wherein said roll paper looseness generating device is disposed on an upstream side of said transportation roller in the direction of said roll paper transportation and comprises a roll paper rotating device for rotating said recording medium of a roll shape in a forward or reverse direction, and when said looseness detector detects improper looseness of said roll paper, said roll paper rotating device rotates said recording medium in said forward direction, and when said looseness detector detects proper looseness of said roll paper, said roll paper rotating device rotates said recording medium in said reverse direction, wherein said roll paper rotating device comprises a rotating drum comprising a drum axle, which penetrates center hollow of said recording medium in a roll shape and provides a rotational force to said center hollow, and lobes, of which radius is larger than that of said recording medium in a roll shape, disposed on both ends of said drum axle, and a drum rotating roller for providing a rotating force to said lobes and supporting said rotating drum.

* * * * *

UNITED STATES PATENT AND TRADEMARK OFFICE

CERTIFICATE OF CORRECTION

PATENT NO. : 6,916,132 B2
APPLICATION NO. : 09/947670
DATED : July 12, 2005
INVENTOR(S) : Kazuo Otsuka et al.

It is certified that error appears in the above-identified patent and that said Letters Patent is hereby corrected as shown below:

On The Title Page, Item (75)
Add Inventor: Kiyoto Komuro **

Signed and Sealed this

Fifth Day of February, 2008

JON W. DUDAS
*Director of the United States Patent and Trademark Office*